US010749233B2

(12) United States Patent
Mizutani et al.

(10) Patent No.: US 10,749,233 B2
(45) Date of Patent: Aug. 18, 2020

(54) IN-PHASE CORPORATE-FEED CIRCUIT AND ARRAY ANTENNA APPARATUS

(71) Applicant: MITSUBISHI ELECTRIC CORPORATION, Tokyo (JP)

(72) Inventors: Hiroyuki Mizutani, Tokyo (JP); Kenichi Tajima, Tokyo (JP); Morishige Hieda, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 135 days.

(21) Appl. No.: 15/771,188

(22) PCT Filed: Feb. 2, 2016

(86) PCT No.: PCT/JP2016/053058
§ 371 (c)(1),
(2) Date: Apr. 26, 2018

(87) PCT Pub. No.: WO2017/134741
PCT Pub. Date: Aug. 10, 2017

(65) Prior Publication Data
US 2018/0309179 A1 Oct. 25, 2018

(51) Int. Cl.
*H01P 1/18* (2006.01)
*H01P 5/12* (2006.01)
(Continued)

(52) U.S. Cl.
CPC ..... *H01P 1/18* (2013.01); *H01P 1/213* (2013.01); *H01P 5/12* (2013.01); *H01Q 3/30* (2013.01);
(Continued)

(58) Field of Classification Search
CPC .... H01P 1/18; H01P 5/12; H01P 1/213; H01P 1/24; H01P 1/36; H01P 1/38; H01P 5/18;
(Continued)

(56) References Cited

U.S. PATENT DOCUMENTS 4,451,832 A 5/1984 Stites
9,118,113 B2 * 8/2015 Mortazawi ..... H01Q 21/0006
(Continued)

FOREIGN PATENT DOCUMENTS

JP H02-224505 9/1990
JP 2006-108741 A 4/2006
JP 5056665 B2 10/2012

OTHER PUBLICATIONS

Danial Ehyaie, "Novel Approaches to the Design of Phased Array Antennas"; Jan. 1, 2011.
(Continued)

*Primary Examiner* — Robert J Pascal
*Assistant Examiner* — Kimberly E Glenn
(74) *Attorney, Agent, or Firm* — Birch, Stewart, Kolash & Birch, LLP

(57) ABSTRACT

As a layout requirement imposed on an in-phase corporate-feed circuit, there is provided only a layout requirement to equalize the electric length of a transmission line (4) between one of N T-branch units (6) which is m-th when counted from a start point of a path A, and another one of the T-branch units (6) which is (m+1)-th when counted from the start point of the path A, to that of a transmission line (8) between one of N T-branch units (10) which is m-th when counted from an end point of a path B, and another one of the T-branch units (10) which is (m+1)-th when counted from the end point of the path B. Therefore, the in-phase corporate-feed circuit can be formed in a space smaller than that in which its circuit configuration of tournament type is formed, and downsizing of the circuit size can be achieved.

18 Claims, 23 Drawing Sheets

(51) Int. Cl.

| | |
|---|---|
| ***H01Q 21/00*** | (2006.01) |
| ***H01Q 3/30*** | (2006.01) |
| ***H01P 1/213*** | (2006.01) |
| ***H01Q 21/22*** | (2006.01) |
| ***H01P 1/24*** | (2006.01) |
| ***H01P 1/36*** | (2006.01) |
| ***H01P 1/38*** | (2006.01) |
| ***H01P 5/18*** | (2006.01) |

(52) U.S. Cl.
CPC ..... *H01Q 21/0006* (2013.01); *H01Q 21/0037* (2013.01); *H01Q 21/22* (2013.01); *H01P 1/24* (2013.01); *H01P 1/36* (2013.01); *H01P 1/38* (2013.01); *H01P 5/18* (2013.01)

(58) Field of Classification Search
CPC .... H01Q 21/006; H01Q 3/30; H01Q 21/0037; H01Q 21/22
USPC ..... 333/1
See application file for complete search history.

(56) References Cited

U.S. PATENT DOCUMENTS

| | | | |
|---|---|---|---|
| 2011/0156694 | A1 | 6/2011 | de Graauw |
| 2012/0050107 | A1 | 3/2012 | Mortazawi et al. |

OTHER PUBLICATIONS

Extended European Search Report issued in corresponding EP Application No. 16 889 231.3 dated Nov. 28, 2018.
Mailloux et al., "An Experimental Array Program for Limited Scanning Studies", Antennas and Propagation Society International Symposium, IEEE, 1973, vol. 11, pp. 329-331.

* cited by examiner

IN-PHASE CORPORATE-FEED CIRCUIT AND ARRAY ANTENNA APPARATUS

TECHNICAL FIELD

The present invention relates to an in-phase corporate-feed circuit that generates plural signals having equal phases from a single signal, and an array antenna apparatus in which the in-phase corporate-feed circuit is mounted.

BACKGROUND ART

As an in-phase corporate-feed circuit that generates plural signals having equal phases from a single signal, an in-phase corporate-feed circuit having a circuit configuration of tournament type is disclosed in Patent Literature 1 listed below.

In this in-phase corporate-feed circuit, plural power dividers of Wilkinson type each of which is provided as a power divider that divides a single signal into two signals in phase are formed in a plane circuit.

Further, transmission lines that connect the plural power dividers in the shape of a binary tree are formed in the plane circuit.

An in-phase corporate-feed circuit can be used for an array antenna apparatus which is typified by a phased array antenna.

A phased array antenna is one in which plural element antennas are arranged, and can vary the transmission directions of electromagnetic waves which are transmission waves by changing the phases of signals to be outputted to the element antennas.

Typically, a transmitter is connected to each of the element antennas, and is equipped with a phase shifter that can vary the phase of a signal.

Therefore, in order to control the phase of an electromagnetic wave emitted from each of the element antennas, it is necessary to input a signal to the transmitter equipped with the phase shifter.

Because there are many cases in which the phase shifters mounted in the plural transmitters can control the phases of signals more easily when the phases of the signals inputted to the plural transmitters are equal, there is a case in which the in-phase corporate-feed circuit is configured to generate plural signals having equal phases from a single signal, and provide the signals in phase for the plural transmitters.

CITATION LIST

Patent Literature

Patent Literature 1: Japanese Patent Application Publication No. 2006-108741 (for example, see FIG. 2)

SUMMARY OF INVENTION

Technical Problem

Because the conventional in-phase corporate-feed circuit is formed as above, the conventional in-phase corporate-feed circuit needs to satisfy a layout requirement to arrange the plural power dividers in the shape of a binary tree, and a layout requirement to equalize all of the lengths of transmission lines which are the output lines of power dividers arranged at the same level of the binary tree. A problem is that in order for the conventional in-phase corporate-feed circuit to satisfy the two layout requirements, the in-phase corporate-feed circuit cannot be formed in a plane circuit unless a space spreading out greatly in two dimensions is ensured, and this results in upsizing of the circuit size.

Particularly, in a case in which the plural element antennas and the plural transmitters are arranged at unequal intervals, the symmetry of the arrangement of the element antennas is broken. Therefore, it is necessary to match the lengths of transmission lines which are the output lines of plural power dividers at the final stage connected to plural transmitters to that of the transmission line of the power divider at the final stage which is located at the longest distance to the corresponding transmitter. Therefore, it is necessary to bend and route the transmission lines of the other power dividers at the final stage which are located at shorter distances to the corresponding transmitters, as appropriate. For this reason, it is necessary to ensure a space which is larger than that in a case in which the plural transmitters are arranged at equal intervals.

The present invention is made in order to solve the above-mentioned problems, and it is therefore an object of the present invention to provide an in-phase corporate-feed circuit and an array antenna apparatus capable of easing a layout requirement and achieving downsizing of the circuit size.

Solution to Problem

According to the present invention, there is provided an in-phase corporate-feed circuit including: a signal generating circuit configured to divide a signal generated thereby; a first transmission line having an end connected to the signal generating circuit, and another end terminated; a second transmission line having an end connected to the signal generating circuit, and another end terminated; N first branch circuits where N is an integer equal to or greater than 2, each first branch circuit being configured to take, from the first transmission line, a part of one of signals obtained by the division in the signal generating circuit; N second branch circuits, each second branch circuit being configured to take, from the second transmission line, a part of another one of the signals after division by the signal generating circuit; and N phase adding circuits, each phase adding circuit being configured to add a phase of a signal taken by one of the N first branch circuits which is n-th when counted from the end of the first transmission line where n is a positive integer equal to or less than N, and a phase of a signal taken by one of the N second branch circuits which is n-th when counted from the other end of the second transmission line. An electric length of the first transmission line between one of the first branch circuits which is m-th when counted from the end of the first transmission line where m is a positive integer equal to or less than N−1, and another one of the first branch circuits which is (m+1)-th when counted from the end of the first transmission line, is equal to an electric length of the second transmission line between one of the second branch circuits which is m-th when counted from the other end of the second transmission line, and another one of the second branch circuits which is (m+1)-th when counted from the other end of the second transmission line.

Advantageous Effects of Invention

According to the present invention, because as a layout requirement imposed on the in-phase corporate-feed circuit, there is provided only a requirement to equalize the electric length of the first transmission line between a first branch circuit which is m-th when counted from the end of the first transmission line, and another first branch circuit which is (m+1)-th when counted from the end of the first transmission line, to that of the second transmission line between a second branch circuit which is m-th when counted from the other end of the second transmission line, and another second branch circuit which is (m+1)-th when counted from the other end of the second transmission line, there is provided an advantage of being able to achieve downsizing of the circuit size.

DESCRIPTION OF EMBODIMENTS

Hereafter, in order to explain this invention in greater detail, the embodiments of the present invention will be described with reference to the accompanying drawings.

Embodiment 1

Figure 1:
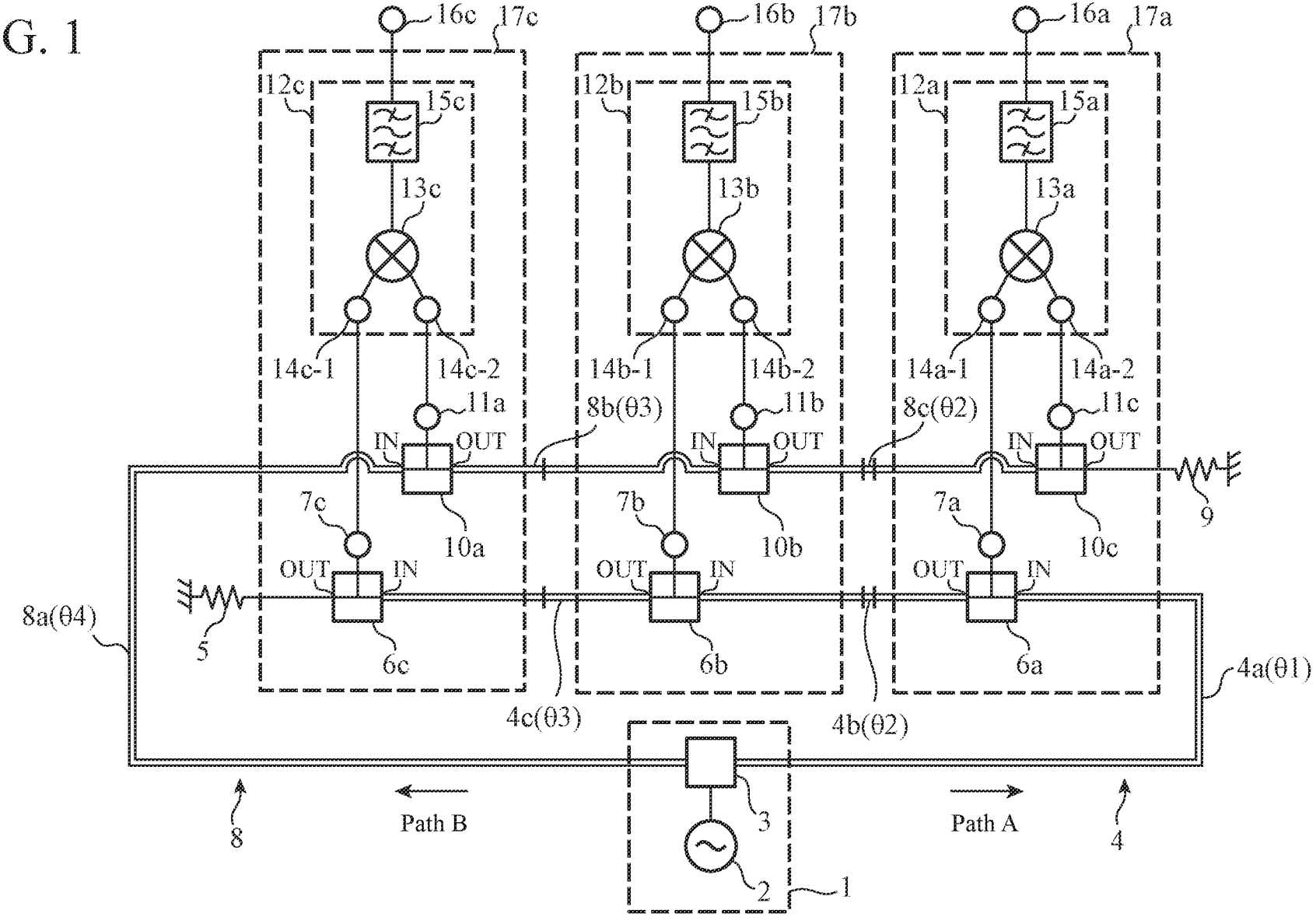
FIG. 1 is a schematic diagram showing an in-phase corporate-feed circuit according to Embodiment 1 of the present invention.

FIG. 1 is a schematic diagram showing an in-phase corporate-feed circuit according to Embodiment 1 of the present invention.

In FIG. 1, each double line shows a transmission line having a physical length. Further, each single line simply shows a connecting relationship between components, and it is assumed that this connecting line does not have a physical length. As an alternative, it is assumed that when an operation and an advantage are explained, its length can be neglected.

A signal generating circuit 1 includes a signal generator 2 and a power divider 3.

The signal generator 2 is an oscillator that generates a signal. As this signal generator, for example, a quartz oscillator, a phase locked oscillator (PLO), or the like can be considered.

The power divider 3 has one input terminal and two output terminals, and, when a signal generated by the signal generator 2 is provided for the input terminal, divides the power of the signal into two parts and outputs signals in phase from the two output terminals.

As the configuration of the power divider 3, for example, a circuit configuration of resistance type or Wilkinson type is used.

A transmission line 4 is a first transmission line having an end connected to the power divider 3 of the signal generating circuit 1, and another end connected to a terminator 5. At points of the transmission line 4, T-branch units 6*a*, 6*b*, and 6*c* are inserted. A signal path extending from the power divider 3 to the terminator 5 is referred to as a path A. As the transmission line 4, for example, a coaxial cable, a waveguide, a microstrip line formed on a printed circuit board, or the like is used.

Hereafter, a transmission line between the power divider 3 and the T-branch unit 6*a* is denoted by 4*a*, a transmission line between the T-branch unit 6*a* and the T-branch unit 6*b* is denoted by 4*b*, and a transmission line between the T-branch unit 6*b* and the T-branch unit 6*c* is denoted by 4*c*. Thus, the transmission line 4 includes the transmission lines

4*a*, 4*b*, and 4*c*. It is desirable that all of the characteristic impedances of the transmission lines 4*a*, 4*b*, and 4*c* are equal.

The terminator 5 consists of, for example, a resistor or the like, and terminates the other end of the transmission line 4 in order to prevent an unnecessary reflection of a signal at the other end of the transmission line 4. As a result, because a signal outputted from the power divider 3 is terminated by the terminator 5, the signal is not reflected at the other end of the transmission line 4 and does not flow backward toward the power divider 3.

An input port IN of the T-branch unit 6*a* is connected to the transmission line 4*a*, an output port OUT of the T-branch unit 6*a* is connected to the transmission line 4*b*, and an output terminal 7*a* is connected to a line branching from a line connecting between the input port IN and the output port OUT. As a result, a signal inputted from the input port IN of the T-branch unit 6*a* is branched into signals, and the branch signals are outputted from the output port OUT and the output terminal 7*a*.

An input port IN of the T-branch unit 6*b* is connected to the transmission line 4*b*, an output port OUT of the T-branch unit 6*b* is connected to the transmission line 4*c*, and an output terminal 7*b* is connected to a line branching from a line connecting between the input port IN and the output port OUT. As a result, a signal inputted from the input port IN of the T-branch unit 6*b* is branched into signals, and the branch signals are outputted from the output port OUT and the output terminal 7*b*.

An input port IN of the T-branch unit 6*c* is connected to the transmission line 4*c*, an output port OUT of the T-branch unit 6*c* is connected to the terminator 5, and an output terminal 7*c* is connected to a line branching from a line connecting between the input port IN and the output port OUT. As a result, a signal inputted from the input port IN of the T-branch unit 6*c* is branched into signals, and the branch signals are outputted from the output port OUT and the output terminal 7*c*.

The T-branch units 6*a*, 6*b*, and 6*c* construct first branch circuits.

A transmission line 8 consists of, for example, a coaxial cable, a waveguide, a microstrip line formed on a printed circuit board, or the like. The transmission line 8 is a second transmission line having an end connected to the power divider 3 of the signal generating circuit 1, and another end connected to a terminator 9. At points of the transmission line 8, T-branch units 10*a*, 10*b*, and 10*c* are inserted. A signal path extending from the power divider 3 to the terminator 9 is referred to as a path B.

Hereafter, a transmission line between the power divider 3 and the T-branch unit 10*a* is denoted by 8*a*, a transmission line between the T-branch unit 10*a* and the T-branch unit 10*b* is denoted by 8*b*, and a transmission line between the T-branch unit 10*b* and the T-branch unit 10*c* is denoted by 8*c*. Thus, the transmission line 8 includes the transmission lines 8*a*, 8*b*, and 8*c*. It is desirable that all of the characteristic impedances of the transmission lines 8*a*, 8*b*, and 8*c* are equal.

The terminator 9 consists of, for example, a resistor or the like, and terminates the other end of the transmission line 8 in order to prevent an unnecessary reflection of a signal at the other end of the transmission line 8. As a result, because a signal outputted from the power divider 3 is terminated by the terminator 9, the signal is not reflected at the other end of the transmission line 8 and does not flow backward toward the power divider 3.

An input port IN of the T-branch unit 10*a* is connected to the transmission line 8*a*, an output port OUT of the T-branch unit 10*a* is connected to the transmission line 8*b*, and an output terminal 11*a* is connected to a line branching from a line connecting between the input port IN and the output port OUT. As a result, a signal inputted from the input port IN of the T-branch unit 10*a* is branched into signals, and the branch signals are outputted from the output port OUT and the output terminal 11*a*.

An input port IN of the T-branch unit 10*b* is connected to the transmission line 8*b*, an output port OUT of the T-branch unit 10*b* is connected to the transmission line 8*c*, and an output terminal 11*b* is connected to a line branching from a line connecting between the input port IN and the output port OUT. As a result, a signal inputted from the input port IN of the T-branch unit 10*b* is branched into signals, and the branch signals are outputted from the output port OUT and the output terminal 11*b*.

An input port IN of the T-branch unit 10*c* is connected to the transmission line 8*c*, an output port OUT of the T-branch unit 10*c* is connected to the terminator 9, and an output terminal 11*c* is connected to a line branching from a line connecting between the input port IN and the output port OUT. As a result, a signal inputted from the input port IN of the T-branch unit 10*c* is branched into signals, and the branch signals are outputted from the output port OUT and the output terminal 11*c*.

The T-branch units 10*a*, 10*b*, and 10*c* construct second branch circuits.

A phase adding circuit 12*a* includes a mixer 13*a* and a filter 15*a*.

The mixer 13*a* has an input terminal 14*a*-1 and an input terminal 14*a*-2, and, when a signal after branching by the T-branch unit 6*a* is inputted from the input terminal 14*a*-1 and a signal after branching by the T-branch unit 10*c* is inputted from the input terminal 14*a*-2, mixes the two signals inputted thereto and outputs a mixed signal to the filter 15*a*.

The filter 15*a* passes a component having a phase which is the sum of the phases of the two signals included in the mixed signal outputted from the mixer 13*a*. As a result, the component passing through the filter 15*a* and having a phase which is the sum of the phases of the two signals is outputted from an output terminal 16*a*.

A phase adding circuit 12*b* includes a mixer 13*b* and a filter 15*b*.

The mixer 13*b* has an input terminal 14*b*-1 and an input terminal 14*b*-2, and, when a signal after branching by the T-branch unit 6*b* is inputted from the input terminal 14*b*-1 and a signal after branching by the T-branch unit 10*b* is inputted from the input terminal 14*b*-2, mixes the two signals inputted thereto and outputs a mixed signal to the filter 15*b*.

The filter 15*b* passes a component having a phase which is the sum of the phases of the two signals included in the mixed signal outputted from the mixer 13*b*. As a result, the component passing through the filter 15*b* and having a phase which is the sum of the phases of the two signals is outputted from an output terminal 16*b*.

A phase adding circuit 12*c* includes a mixer 13*c* and a filter 15*c*.

The mixer 13*c* has an input terminal 14*c*-1 and an input terminal 14*c*-2, and, when a signal after branching by the T-branch unit 6*c* is inputted from the input terminal 14*c*-1 and a signal after branching by the T-branch unit 10*a* is inputted from the input terminal 14c-2, mixes the two signals inputted thereto and outputs a mixed signal to the filter 15c.

The filter 15c passes a component having a phase which is the sum of the phases of the two signals included in the mixed signal outputted from the mixer 13c. As a result, the component passing through the filter 15c and having a phase which is the sum of the phases of the two signals is outputted from an output terminal 16c.

In Embodiment 1, a circuit comprised of the two T-branch units 6a and 10c and the phase adding circuit 12a is referred to as a circuit element 17a, and a circuit comprised of the two T-branch units 6b and 10b and the phase adding circuit 12b is referred to as a circuit element 17b. Further, a circuit comprised of the two T-branch units 6c and 10a and the phase adding circuit 12c is referred to as a circuit element 17c.

Although in FIG. 1 the example in which the three circuit elements 17a, 17b, and 17c are mounted in the in-phase corporate-feed circuit is shown, an arbitrary number of circuit elements can be mounted as long as the number of circuit elements mounted is two or more.

In Embodiment 1, the angular frequency of a signal outputted from the signal generator 2 is ω, and it is assumed that, at a time t, the voltage of the signal outputted from the signal generator 2 is expressed by cos(ωt).

Further, it is assumed that the electric length of the transmission line 4a at the angular frequency ω is θ1, the electric length of the transmission line 4b at the angular frequency ω is θ2, and the electric length of the transmission line 4c at the angular frequency ω is θ3.

In addition, it is assumed that the electric length of the transmission line 8a at the angular frequency ω is θ4, the electric length of the transmission line 8b at the angular frequency ω is θ3, and the electric length of the transmission line 8c at the angular frequency ω is θ2

Therefore, the electric length θ2 of the transmission line 4b between the T-branch unit 6a which is first when counted from the end of the transmission line 4 connected to the power divider 3, i.e., from a start point of the path A, and the T-branch unit 6b which is second when counted from the start point of the path A, is equal to the electric length θ2 of the transmission line 8c between the T-branch unit 10c which is first when counted from the other end of the transmission line 8 connected to the terminator 9, i.e., from an end point of the path B, and the T-branch unit 10b which is second when counted from the end point of the path B.

Further, the electric length θ3 of the transmission line 4c between the T-branch unit 6b which is second when counted from the start point of the path A, and the T-branch unit 6c which is third when counted from the start point of the path A, is equal to the electric length θ3 of the transmission line 8b between the T-branch unit 10b which is second when counted from the end point of the path B, and the T-branch unit 10a which is third when counted from the end point of the path B.

Next, operations will be explained. In Embodiment 1, for the sake of simplicity, it is assumed that the transmission time required for a signal generated by the signal generator 2 to reach the power divider 3 can be neglected, and the signal is divided into signals in phase by the power divider 3, because the signal generator 2 and the power divider 3 are connected directly to each other, not via any transmission path. More specifically, it is assumed that the phase of a signal outputted from the power divider 3 to the transmission line 4 and the phase of a signal outputted from the power divider 3 to the transmission line 8 are not out of phase with each other.

It is further assumed that phase variations which are caused by the transmission of signals by the power divider 3, the T-branch units 6a to 6c and 10a to 10c, and the filters 15a to 15c can be neglected.

In addition, it is assumed that the T-branch unit 6c and the terminator 5 are connected directly to each other, not via any transmission path, the T-branch unit 10c and the terminator 9 are connected directly to each other, not via any transmission path, and the mixers 13a to 13c and the filters 15a to 15c are connected directly to each other, not via any transmission paths.

It is further assumed that the input impedances of the mixers 13a to 13c are high.

When the signal generator 2 generates a signal, the power divider 3 of the signal generating circuit 1 divides the power of the signal into two parts and outputs signals in phase to the transmission line 4 and the transmission line 8.

The signal outputted from the power divider 3 to the transmission line 4 passes through the T-branch units 6a to 6c and is terminated by the terminator 5.

Further, the signal outputted from the power divider 3 to the transmission line 8 passes through the T-branch units 10a to 10c and is terminated by the terminator 9.

At this time, when a signal is inputted from the input port IN, each of the T-branch units 6a to 6c inserted onto the transmission line 4 outputs a part of the signal to a corresponding one of the output terminals 7a to 7c because the branch line is disposed for the line connecting between the input port IN and the output port OUT.

Further, when a signal is inputted from the input port IN, each of the T-branch units 10a to 10c inserted onto the transmission line 8 outputs a part of the signal to a corresponding one of the output terminals 11a to 11c because the branch line is disposed for the line connecting between the input port IN and the output port OUT.

In the mixers 13a to 13c of the phase adding circuits 12a to 12c, the input terminals 14a-1 to 14c-1 are connected to the output terminals 7a to 7c, and the input terminals 14a-2 to 14c-2 are connected to the output terminals 11c to 11a.

However, because the input impedances of the mixers 13a to 13c are high, voltages appear at the output terminals 7a to 7c and 11c to 11a, but no currents flow toward the input terminal 14a-1 to 14c-1 and 14a-2 to 14c-2 of the mixers 13a to 13c.

The phases of signals appearing at the output terminals 7a to 7c and 11a to 11c of the T-branch units 6a to 6c and 10a to 10c are shown by the following equation (1), and all of the phases of these signals differ from one another.

Output terminal 7a:ωt+θ1

Output terminal 7b:ωt+θ1+θ2

Output terminal 7c:ωt+θ1+θ2+θ3

Output terminal 11a:ωt+θ4

Output terminal 11b:ωt+θ4+θ3

Output terminal 11c:ωt+θ4+θ3+θ2 (1)

When the signal outputted from the output terminal 7a of the T-branch unit 6a is inputted to the input terminal 14a-1 of the mixer 13a and the signal outputted from the output terminal 11c of the T-branch unit 10c is inputted to the input terminal 14*a*-2 of the mixer 13*a*, the mixer 13*a* mixes the two signals inputted thereto and outputs a mixed signal to the filter 15*a*.

When the signal outputted from the output terminal 7*b* of the T-branch unit 6*b* is inputted to the input terminal 14*b*-1 of the mixer 13*b* and the signal outputted from the output terminal 11*b* of the T-branch unit 10*b* is inputted to the input terminal 14*b*-2 of the mixer 13*b*, the mixer 13*b* mixes the two signals inputted thereto and outputs a mixed signal to the filter 15*b*.

When the signal outputted from the output terminal 7*c* of the T-branch unit 6*c* is inputted to the input terminal 14*c*-1 of the mixer 13*c* and the signal outputted from the output terminal 11*a* of the T-branch unit 10*a* is inputted to the input terminal 14*c*-2 of the mixer 13*c*, the mixer 13*c* mixes the two signals inputted thereto and outputs a mixed signal to the filter 15*c*.

Each of the mixed signals outputted from the mixers 13*a* to 13*c* includes a component having a phase which is the sum of the phases of the two signals, a component having a phase which is the difference between the phases of the two signals, and higher-order mixed wave components.

When receiving the mixed signal from the mixer 13*a*, the filter 15*a* prevents the passage of the component having a phase which is the difference between the phases of the two signals and the higher-order mixed wave components, which are included in the mixed signal, and passes only the component having a phase which is the sum of the phases of the two signals, which is included in the mixed signal. As a result, the component passing through the filter 15*a* and having a phase which is the sum of the phases of the two signals is outputted from the output terminal 16*a*.

When receiving the mixed signal from the mixer 13*b*, the filter 15*b* prevents the passage of the component having a phase which is the difference between the phases of the two signals and the higher-order mixed wave components, which are included in the mixed signal, and passes only the component having a phase which is the sum of the phases of the two signals, which is included in the mixed signal. As a result, the component passing through the filter 15*b* and having a phase which is the sum of the phases of the two signals is outputted from the output terminal 16*b*.

When receiving the mixed signal from the mixer 13*c*, the filter 15*c* prevents the passage of the component having a phase which is the difference between the phases of the two signals and the higher-order mixed wave components, which are included in the mixed signal, and passes only the component having a phase which is the sum of the phases of the two signals, which is included in the mixed signal. As a result, the component passing through the filter 15*c* and having a phase which is the sum of the phases of the two signals is outputted from the output terminal 16*c*.

The phases of the signals appearing at the output terminals 16*a* to 16*c* of the circuit elements 17*a* to 17*c* are shown by the following equation (2).

$$\text{Output terminal } 16a:(\omega t+\theta 1)+(\omega t+\theta 4+\theta 3+\theta 2)=2\omega t+\theta 1+\theta 2+\theta 3+\theta 4$$

$$\text{Output terminal } 16b:(\omega t+\theta 1+\theta 2)+(\omega t+\propto 4+\theta 3)=2\omega t+\theta 1+\theta 2+\theta 3+\theta 4$$

$$\text{Output terminal } 16c:(\omega t+\theta 1+\theta 2+\theta 3)+(\omega t+\theta 4)=2\omega t+\theta 1+\theta 2+\theta 3+\theta 4 \quad (2)$$

As is clear from the equation (2), all of the phases of the signals appearing at the output terminals 16*a* to 16*c* of the circuit elements 17*a* to 17*c* are equal.

Although in Embodiment 1 the example in which the in-phase corporate-feed circuit is equipped with the three circuit elements 17*a*, 17*b*, and 17*c* is shown, the present embodiment can also be applied even to a case in which the number of circuit elements mounted is two, or four or more.

Concretely, in a case in which the number of circuit elements mounted is N (where N is an integer equal to or greater than 2), when the electric length of a transmission line 4 between one of N T-branch units 6 which is m-th (where m is a positive integer equal to or less than N−1) when counted from the start point of the path A, and another one of the N T-branch units 6 which is (m+1)-th when counted from the start point of the path A, is equal to that of a transmission line 8 between one of N T-branch units 10 which is m-th when counted from the end point of the path B, and another one of the N T-branch units 10 which is (m+1)-th when counted from the end point of the path B, all of the phases of the signals appearing at N output terminals 16 are equal.

The T-branch units 6 correspond to the T-branch units 6*a* to 6*c* shown in FIG. 1, and the T-branch units 10 correspond to the T-branch units 10*a* to 10*c* shown in FIG. 1. Further, the output terminals 16 correspond to the output terminals 16*a* to 16*c* shown in FIG. 1.

In Embodiment 1, as a layout requirement imposed on the in-phase corporate-feed circuit, there is provided only a requirement to equalize the electric length of the transmission line 4 between one of the N T-branch units 6 which is m-th when counted from the start point of the path A, and another one of the N T-branch units 6 which is (m+1)-th when counted from the start point of the path A, to that of the transmission line 8 between one of the N T-branch units 10 which is m-th when counted from the end point of the path B, and another one of the N T-branch units 10 which is (m+1)-th when counted from the end point of the path B.

Therefore, it is not necessary to connect plural power dividers in the shape of a binary tree by using transmission lines, unlike in the case of an in-phase corporate-feed circuit having a circuit configuration of tournament type, and what is necessary is only to connect the N circuit elements 17 by using the transmission lines 4 and 8 having equal electric lengths.

For this reason, the in-phase corporate-feed circuit can be formed in a space smaller than that in which an in-phase corporate-feed circuit having a circuit configuration of tournament type is formed, and downsizing of the circuit size can be achieved.

In a case in which transmitters connected to plural element antennas are arranged at unequal intervals, and in a case in which the number of element antennas is large, the advantage of being able to achieve downsizing of the circuit size is particularly great.

FIG. 2 is an explanatory drawing showing examples of the layouts of in-phase corporate-feed circuits.

Figure 2A:
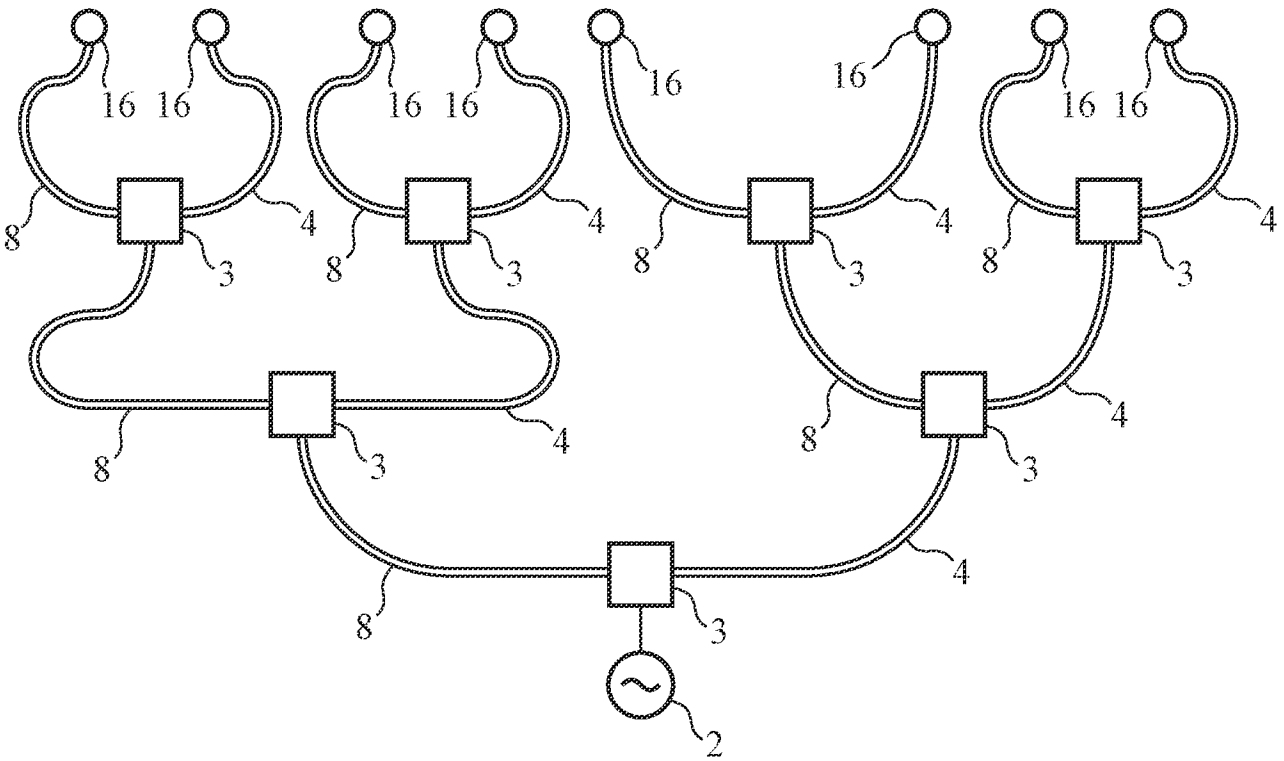
FIG. 2A is an explanatory drawing showing an example of the layout of an in-phase corporate-feed circuit having a circuit configuration of tournament type.
Figure 2B:
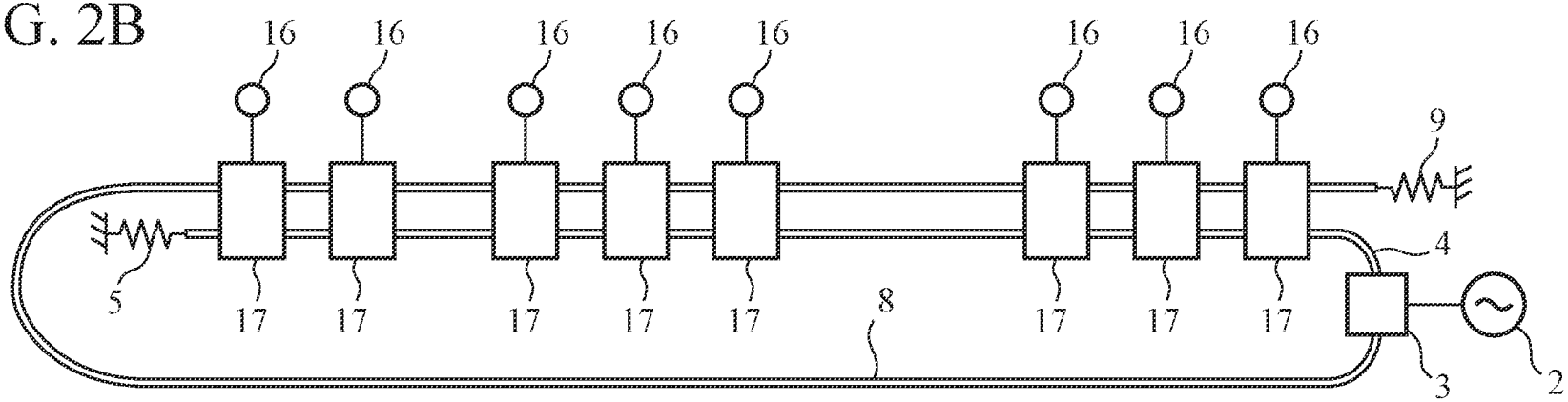
FIG. 2B is an explanatory drawing showing an example of the layout of the in-phase corporate-feed circuit according to Embodiment 1.

Particularly, FIG. 2A shows an example of the layout of an in-phase corporate-feed circuit having a circuit configuration of tournament type, and FIG. 2B shows an example of the layout of the in-phase corporate-feed circuit according to Embodiment 1.

In FIG. 2, examples of in-phase corporate-feed circuits each of which generates eight signals having equal phases from a single signal are shown.

Further, in the example shown in FIG. 2, on the assumption that the transmitters connected to the plural element antennas are arranged at unequal intervals, the output terminals 16 via which the eight signals having equal phases are outputted are arranged in a straight line, but at unequal intervals.

In FIGS. 2A and B, the same components or like components are denoted by the same reference numerals.

In the case of an in-phase corporate-feed circuit having a circuit configuration of tournament type, seven power dividers are connected in the shape of a binary tree by using transmission lines 4 and 8, as shown in FIG. 2A. Therefore, it is necessary to ensure a space spreading out greatly in two dimensions.

Particularly in a case in which the transmission lines 4 and 8 consist of coaxial cables or waveguides, because it is difficult to bend these transmission lines deeply, it is necessary to ensure a space spreading out greatly in two dimensions. In the example shown in FIG. 2A, it is necessary to ensure a space spreading out greatly in vertical and horizontal directions.

In contrast with this, because in the case of the in-phase corporate-feed circuit according to Embodiment 1, the layout requirement imposed on the in-phase corporate-feed circuit is eased as compared with the case of an in-phase corporate-feed circuit having a circuit configuration of tournament type, eight circuit elements 17 can be arranged even in a straight line, as shown in FIG. 2B. Therefore, it is not necessary to ensure a large space in two dimensions.

As is clear from the above description, according to Embodiment 1, because as the layout requirement imposed on the in-phase corporate-feed circuit, there is provided only a layout requirement to equalize the electric length of the transmission line 4 between one of the N T-branch units 6 which is m-th when counted from the start point of the path A, and another one of the T-branch units 6 which is (m+1)-th when counted from the start point of the path A, to that of the transmission line 8 between one of the N T-branch units 10 which is m-th when counted from the end point of the path B, and another one of the T-branch units 10 which is (m+1)-th when counted from the end point of the path B, there is provided an advantage of being able to achieve downsizing of the circuit size.

Although in Embodiment 1 the example in which the electric lengths of the transmission lines 4*b* and 8*c* at the angular frequency ω are equal, and the electric lengths of the transmission lines 4*c* and 8*b* at the angular frequency ω are equal is shown, the physical lengths of the transmission lines 4*b* and 8*c* can be equal or different and the physical lengths of the transmission lines 4*c* and 8*b* can be equal or different.

For example, in a case in which the dielectric constants of two transmission lines are equal, the electric lengths of the two transmission lines at the angular frequency ω are equal, and the physical lengths of the two transmission lines are equal. In contrast, in a case in which the dielectric constants of two transmission lines are different, when the electric lengths of the two transmission lines at the angular frequency ω are equal, the physical lengths of the two transmission lines are different.

In Embodiment 1, the example in which the input impedances of the mixers 13*a* to 13*c* are high is explained.

However, in a case in which the input impedances of the mixers 13*a* to 13*c* are not high, for example, in a case in which the input impedances of the mixers 13*a* to 13*c* are designed to be 50Ω, or in a case in which the input capacitances of the mixers are so large that they cannot be neglected, an impedance mismatch occurs in each of the T-branch units 6*a* to 6*c* and 10*a* to 10*c*. More specifically, there occurs a phenomenon in which at each of the T-branch units 6*a* to 6*c* and 10*a* to 10*c*, a part of a signal is reflected, and a signal flows through the path A or the path B in the opposite direction.

In this case, there occurs a phenomenon in which at each of the T-branch units 6*a* to 6*c* and 10*a* to 10*c*, a signal flowing through the path A or the path B in the forward direction and a signal flowing through the path A or the path B in the opposite direction overlap, and, as a result, the phases of the signals appearing at the output terminals 7*a* to 7*c* and 11*a* to 11*c* of the T-branch units 6*a* to 6*c* and 10*a* to 10*c* are shifted from those given by the above-mentioned equation (1).

To solve such a problem, in the case in which the input impedances of the mixers 13*a* to 13*c* are not high, what is necessary is just to connect circuits each having a high input impedance between the T-branch units 6*a* to 6*c* and 10*a* to 10*c* and the mixers 13*a* to 13*c*.

Figure 3:
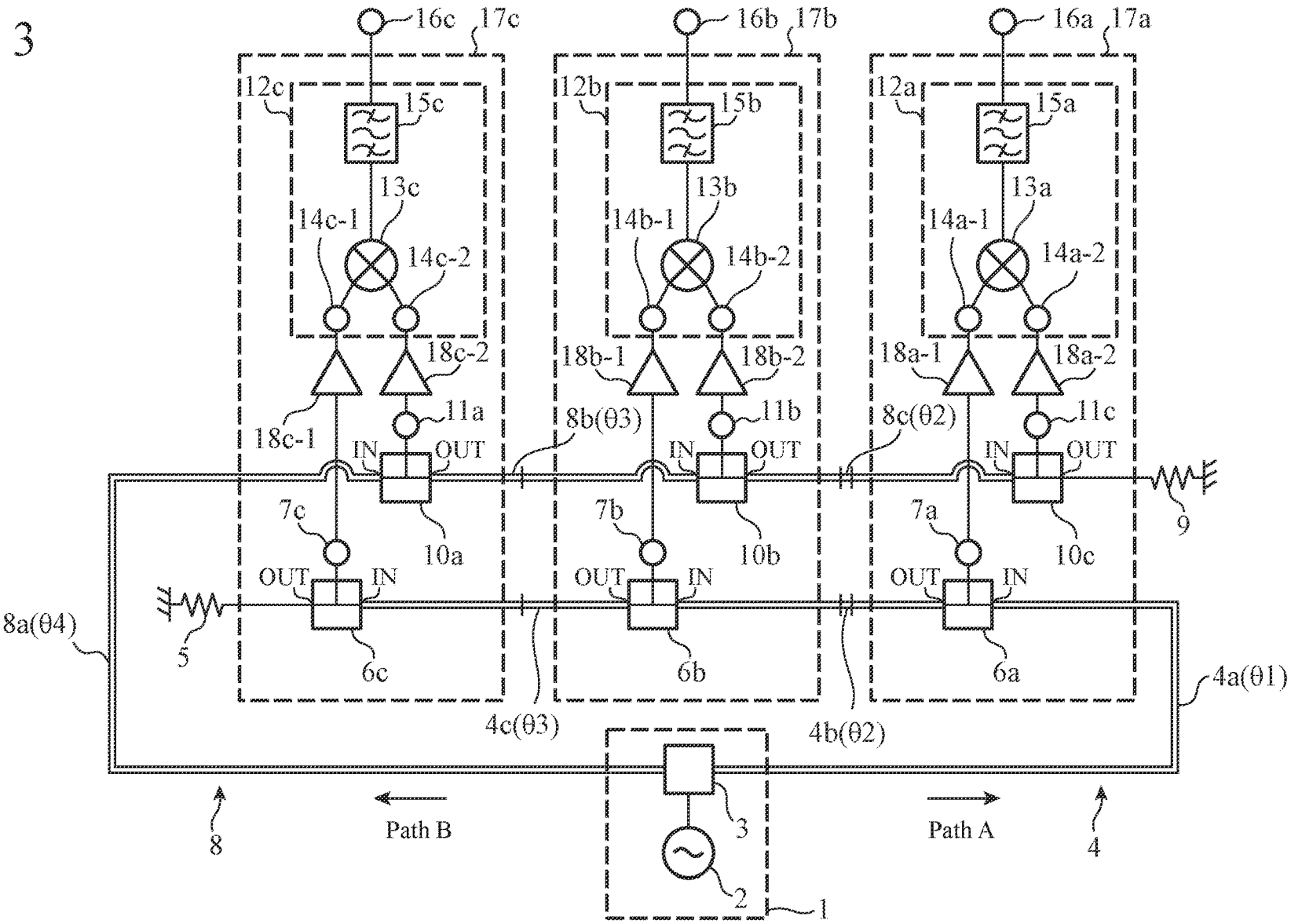
FIG. 3 is a schematic diagram showing an in-phase corporate-feed circuit in which circuits each having a high input impedance are connected.

FIG. 3 is a schematic diagram showing an in-phase corporate-feed circuit in which circuits each having a high input impedance are connected. In FIG. 3, the same reference numerals as those shown in FIG. 1 denote the same components or like components.

In the example shown in FIG. 3, as the circuits each having a high input impedance, amplifiers 18*a*-1 to 18*c*-1 are connected between the output terminals 7*a* to 7*c* of the T-branch units 6*a* to 6*c* and the input terminals 14*a*-1 to 14*c*-1 of the mixers 13*a* to 13*c*, and amplifiers 18*c*-2 to 18*a*-2 are connected between the output terminals 11*a* to 11*c* of the T-branch units 10*a* to 10*c* and the input terminals 14*c*-2 to 14*a*-2 of the mixers 13*c* to 13*a*.

As each of the amplifiers 18*a*-1 to 18*c*-1 and 18*a*-2 to 18*c*-2, for example, a voltage follower using an operational amplifier can be used. A voltage follower has a high input impedance, and is used as a buffer having a voltage amplification rate of 1.

However, the voltage amplification rate does not necessarily have to be 1, and another circuit having a voltage amplification rate greater than 1 or less than 1 can be used.

As mentioned above, by connecting the amplifiers 18*a*-1 to 18*c*-1 between the output terminals 7*a* to 7*c* of the T-branch units 6*a* to 6*c* and the input terminals 14*a*-1 to 14*c*-1 of the mixers 13*a* to 13*c*, and also connecting the amplifiers 18*c*-2 to 18*a*-2 between the output terminals 11*a* to 11*c* of the T-branch units 10*a* to 10*c* and the input terminals 14*c*-2 to 14*a*-2 of the mixers 13*c* to 13*a*, an impedance mismatch can be prevented from occurring at each of the T-branch units 6*a* to 6*c* and 10*a* to 10*c* even in the case in which the input impedances of the mixers 13*a* to 13*c* are not high.

It is desirable to connect directly between the output terminals 7*a* to 7*c* and 11*a* to 11*c* of the T-branch units 6*a* to 6*c* and 10*a* to 10*c*, and the input terminals of the amplifiers 18*a*-1 to 18*c*-1 and 18*a*-2 to 18*c*-2, not via any transmission lines.

Although in Embodiment 1 the example in which signals in phase are outputted from the two output terminals of the power divider 3 is shown, the phases of the signals outputted from the two output terminals can be different.

It is clear from the above-mentioned equation (2) that because it is clear that the phases of the signals outputted from the output terminals 16*a* to 16*c* are equal even if the electric length 81 of the transmission line 4*a* at the angular frequency ω differs from the electric length θ4 of the transmission line 8*a* at the angular frequency ω, the phases of the signals outputted from the two output terminals of the power divider 3 can be different.

As the power divider 3 that outputs signals having different phases from the two output terminals, for example, a 90 degree hybrid, a 180 degree hybrid, or the like can be considered.

Although in Embodiment 1 the example of using the T-branch units 6*a*, 6*b*, and 6*c* as the first T-branch circuits, and using the T-branch units 10*a* to 10*c* as the second branch circuits is shown, directional couplers can be used instead of the T-branch units 6*a* to 6*c* and 10*a* to 10*c*.

FIG. 4 is an explanatory drawing showing a directional coupler which is used instead of each of the T-branch units 6*a* to 6*c* and 10*a* to 10*c*.

Figure 4A:
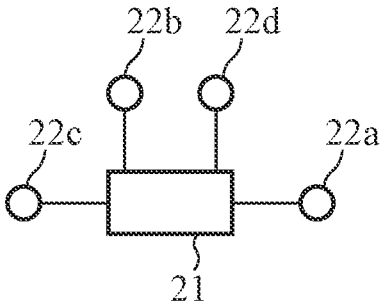
FIG. 4A is an explanatory drawing showing a directional coupler 21 having four terminals.
Figure 4B:
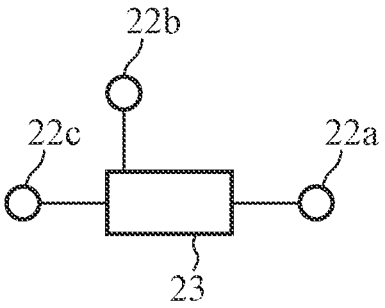
FIG. 4B is an explanatory drawing showing a directional coupler 23 having three terminals.

FIG. 4A shows a directional coupler 21 having four terminals, and FIG. 4B shows a directional coupler 23 having three terminals.

In a case of using the directional coupler 21 having four terminals, it is assumed that a part of a signal inputted from a terminal 22*a* is outputted from a terminal 22*b*, and the remaining part of the signal is outputted from a terminal 22*c*, but is not outputted from a terminal 22*d*. It is further assumed that a part of a signal inputted from the terminal 22*c* is outputted from the terminal 22*d*, and the remaining signal is outputted from the terminal 22*a*, but is not outputted from the terminal 22*b*.

The directional coupler 23 having three terminals is the one in which the terminal 22*d* is removed from the directional coupler 21 having the four terminals.

For example, by bringing each of the output terminals 7*a* to 7*c* and 11*a* to 11*c* of the T-branch units 6*a* to 6*c* and 10*a* to 10*c* into correspondence with the terminal 22*b* of a directional coupler 21 or 23, and connecting the terminal 22*a* to a transmission line on an input side and also connecting the terminal 22*c* to a transmission line on an output side, the same operations as those performed by the T-branch units 6*a* to 6*c* and 10*a* to 10*c* can be implemented.

In Embodiment 1, the example in which the signal generator 2 generates a signal is shown. This signal generator 2 can vary the frequency of the signal generated thereby with time.

Even if the frequency of the signal generated by the signal generator 2 varies with time, all of the phases of the signals appearing at the output terminals 16*a* to 16*c* are equal at each time point.

Embodiment 2

In FIG. 3, the example in which as the circuits each having a high input impedance, the amplifiers 18*a*-1 to 18*c*-1 are connected between the output terminals 7*a* to 7*c* of the T-branch units 6*a* to 6*c* and the input terminals 14*a*-1 to 14*c*-1 of the mixers 13*a* to 13*c*, and the amplifiers 18*c*-2 to 18*a*-2 are connected between the output terminals 11*a* to 11*c* of the T-branch units 10*a* to 10*c* and the input terminals 14*c*-2 to 14*a*-2 of the mixers 13*c* to 13*a* is shown.

Although in the example shown in FIG. 3 the amplifiers 18*a*-1 to 18*c*-1 and 18*a*-2 to 18*c*-2 are connected directly to the input terminals 14*a*-1 to 14*c*-1 and 14*a*-2 to 14*c*-2 of the mixers 13*a* to 13*c*, not via any transmission lines, the amplifiers 18*a*-1 to 18*c*-1 and 18*a*-2 to 18*c*-2 can be connected to the input terminals 14*a*-1 to 14*c*-1 and 14*a*-2 to 14*c*-2 of the mixers 13*a* to 13*c* via transmission lines.

Hereafter, an embodiment configured in this way will be explained as Embodiment 2 by using FIG. 5.

Figure 5:
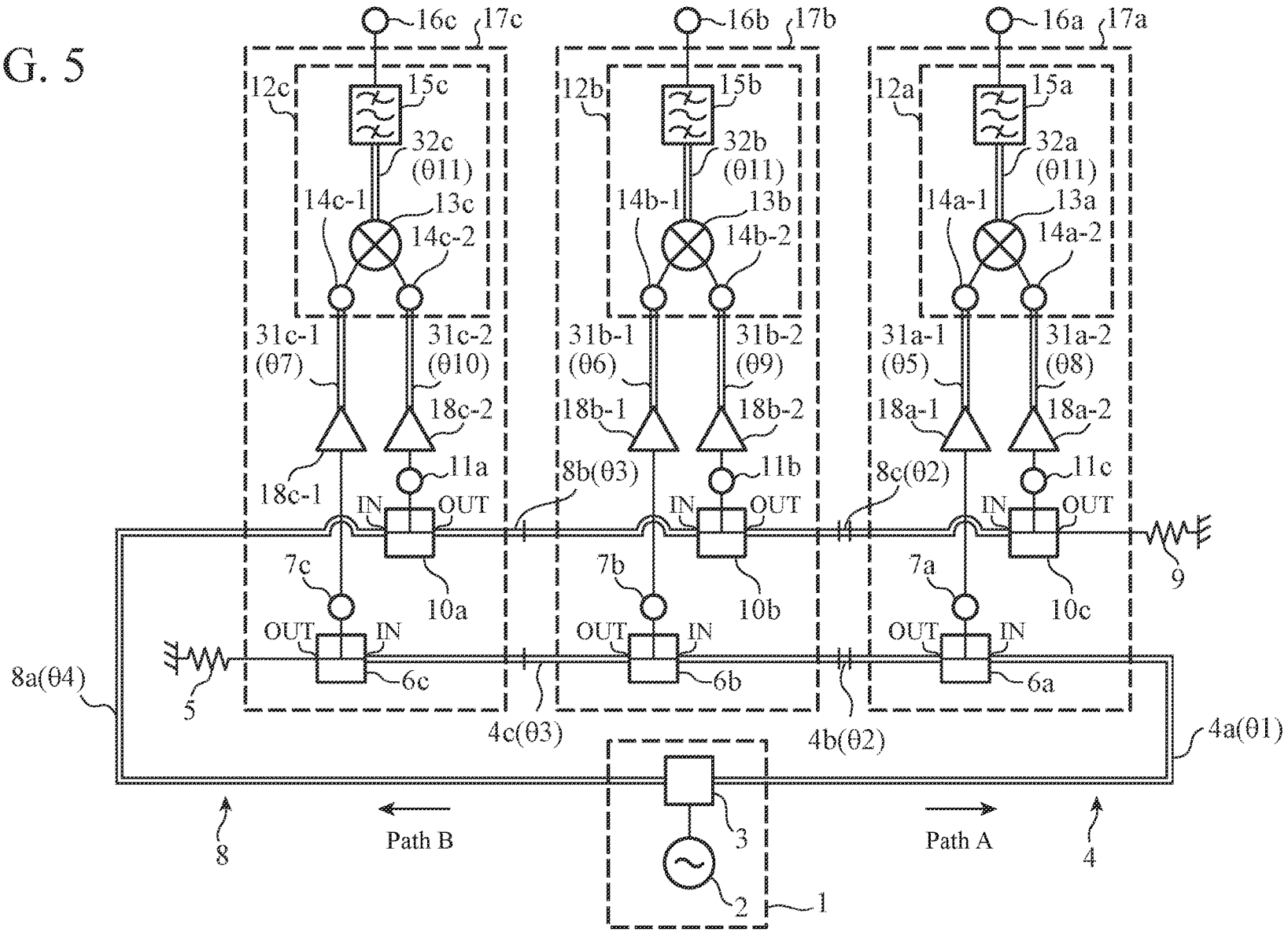
FIG. 5 is a schematic diagram showing an in-phase corporate-feed circuit according to Embodiment 2 of the present invention.

FIG. 5 is a schematic diagram showing an in-phase corporate-feed circuit according to Embodiment 2 of the present invention. In FIG. 5, because the same reference numerals as those shown in FIG. 3 denote the same components or like components, the explanation of the components will be omitted.

A transmission line 31*a*-1 has an end connected to an amplifier 18*a*-1, and another end connected to an input terminal 14*a*-1 of a mixer 13*a*.

A transmission line 31*a*-2 has an end connected to an amplifier 18*a*-2, and another end connected to an input terminal 14*a*-2 of the mixer 13*a*.

A transmission line 31*b*-1 has an end connected to an amplifier 18*b*-1, and another end connected to an input terminal 14*b*-1 of a mixer 13*b*.

A transmission line 31*b*-2 has an end connected to an amplifier 18*b*-2, and another end connected to an input terminal 14*b*-2 of the mixer 13*b*.

A transmission line 31*c*-1 has an end connected to an amplifier 18*c*-1, and another end connected to an input terminal 14*c*-1 of a mixer 13*c*.

A transmission line 31*c*-2 has an end connected to an amplifier 18*c*-2, and another end connected to an input terminal 14*c*-2 of the mixer 13*c*.

A transmission line 32*a* has an end connected to the mixer 13*a*, and another end connected to a filter 15*a*.

A transmission line 32*b* has an end connected to the mixer 13*b*, and another end connected to a filter 15*b*.

A transmission line 32*c* has an end connected to the mixer 13*c*, and another end connected to a filter 15*c*.

Next, operations will be explained.

It is assumed in Embodiment 2 that the electric lengths of the transmission lines 31*a*-1, 31*b*-1, 31*c*-1, 31*a*-2, 31*b*-2, and 31*c*-2 and the electric lengths of the transmission lines 32*a*, 32*b*, and 32*c* are as follows.

The electric length of the transmission line 31*a*-1 at an angular frequency $\omega=\theta 5$ The electric length of the transmission line 31*b*-1 at the angular frequency $\omega=\theta 6$ The electric length of the transmission line 31*c*-1 at the angular frequency $\omega=\theta 7$ The electric length of the transmission line 31*a*-2 at the angular frequency $\omega=\theta 8$ The electric length of the transmission line 31*b*-2 at the angular frequency $\omega=\theta 9$ The electric length of the transmission line 31*c*-2 at the angular frequency $\omega=\theta 10$ The electric length of each of the transmission lines 32*a*, 32*b*, and 32*c* at the angular frequency $\omega=\theta 11$ It is further assumed that a relationship shown by the following equation (3) is established among the electric lengths $\theta 5$, $\theta 6$, $\theta 7$, $\theta 8$, $\theta 9$, and $\theta 10$ of the transmission lines 31*a*-1, 31*b*-1, 31*c*-1, 31*a*-2, 31*b*-2, and 31*c*-2.

$$\theta 5+\theta 8=\theta 6+\theta 9=\theta 7+\theta 10=\alpha \text{ (}\alpha\text{ is } a \text{ constant)} \quad (3)$$

More specifically, there is a relationship in which the sum ($\theta 5+\theta 8$) of the electric lengths of the transmission lines 31*a*-1 and 31*a*-2, the sum ($\theta 6+\theta 9$) of the electric lengths of the transmission lines 31*b*-1 and 31*b*-2, and the sum ($\theta 7+\theta 10$) of the electric lengths of the transmission lines 31*c*-1 and 31*c*-2 are equal.

When a signal generator 2 generates a signal, a power divider 3 of a signal generating circuit 1 divides the power of the signal into two parts and outputs signals in phase to a transmission line 4 and a transmission line 8, like that according to above-mentioned Embodiment 1.

The signal outputted from the power divider 3 to the transmission line 4 passes through T-branch units 6*a* to 6*c* and is terminated by a terminator 5.

Further, the signal outputted from the power divider 3 to the transmission line 8 passes through T-branch units 10*a* to 10*c* and is terminated by a terminator 9.

At this time, when a signal is inputted from an input port IN, each of the T-branch units 6*a* to 6*c* inserted onto the transmission line 4 outputs a part of the signal to a corresponding one of output terminals 7*a* to 7*c* because a branch line is disposed for a line connecting between the input port IN and an output port OUT.

Further, when a signal is inputted from an input port IN, each of the T-branch units 10*a* to 10*c* inserted onto the transmission line 8 outputs a part of the signal to a corresponding one of output terminals 11*a* to 11*c* because a branch line is disposed for a line connecting between the input port IN and an output port OUT.

Because the input impedances of the amplifiers 18*a*-1 to 18*c*-1 and 18*a*-2 to 18*c*-2 are high, voltages appear at the output terminals 7*a* to 7*c* and 11*c* to 11*a*, but no currents flow toward the amplifiers 18*a*-1 to 18*c*-1 and 18*a*-2 to 18*c*-2.

The phases of the signals appearing at the output terminals 7*a* to 7*c* and 11*a* to 11*c* of the T-branch units 6*a* to 6*c* and 10*a* to 10*c* are shown by the above-mentioned equation (1), and all of the phases of these signals differ from one another, like in the case of above-mentioned Embodiment 1.

The amplifiers 18*a*-1 to 18*c*-1 and 18*a*-2 to 18*c*-2 amplify the voltages of the signals appearing at the output terminals 7*a* to 7*c* and 11*a* to 11*c* of the T-branch units 6*a* to 6*c* and 10*a* to 10*c*, and output the signals whose voltages are amplified thereby to the transmission lines 31*a*-1 to 31*c*-1 and 31*a*-2 to 31*c*-2.

When a signal passing through the transmission line 31*a*-1 is inputted from the input terminal 14*a*-1 and a signal passing through the transmission line 31*a*-2 is inputted from the input terminal 14*a*-2, the mixer 13*a* mixes the two signals inputted thereto and outputs a mixed signal to the transmission line 32*a*.

When a signal passing through the transmission line 31*b*-1 is inputted from the input terminal 14*b*-1 and a signal passing through the transmission line 31*b*-2 is inputted from the input terminal 14*b*-2, the mixer 13*b* mixes the two signals inputted thereto and outputs a mixed signal to the transmission line 32*b*.

When a signal passing through the transmission line 31*c*-1 is inputted from the input terminal 14*c*-1 and a signal passing through the transmission line 31*c*-2 is inputted from the input terminal 14*c*-2, the mixer 13*c* mixes the two signals inputted thereto and outputs a mixed signal to the transmission line 32*c*.

When receiving the mixed signal from the mixer 13*a* via the transmission line 32*a*, the filter 15*a* prevents the passage of a component having a phase which is the difference between the phases of the two signals and higher-order mixed wave components, which are included in the mixed signal, and passes only a component having a phase which is the sum of the phases of the two signals, which is included in the mixed signal. As a result, the component passing through the filter 15*a* and having a phase which is the sum of the phases of the two signals is outputted from an output terminal 16*a*.

When receiving the mixed signal from the mixer 13*b* via the transmission line 32*b*, the filter 15*b* prevents the passage of a component having a phase which is the difference between the phases of the two signals and higher-order mixed wave components, which are included in the mixed signal, and passes only a component having a phase which is the sum of the phases of the two signals, which is included in the mixed signal. As a result, the component passing through the filter 15*b* and having a phase which is the sum of the phases of the two signals is outputted from an output terminal 16*b*.

When receiving the mixed signal from the mixer 13*c* via the transmission line 32*c*, the filter 15*c* prevents the passage of a component having a phase which is the difference between the phases of the two signals and higher-order mixed wave components, which are included in the mixed signal, and passes only a component having a phase which is the sum of the phases of the two signals, which is included in the mixed signal. As a result, the component passing through the filter 15*c* and having a phase which is the sum of the phases of the two signals is outputted from an output terminal 16*c*.

The phases of the signals appearing at the output terminals 16*a* to 16*c* of circuit elements 17*a* to 17*c* are shown by the following equation (4).

$$\text{Output terminal } 16a\text{: } (\omega t+\theta 1+\theta 5)+(\omega t+\theta 4+\theta 3+\theta 2+\theta 8)+\theta 11=2\ \omega t+\theta 1+\theta 2+\theta 3+\theta 4+\theta 5+\theta 8+\theta 11$$

$$\text{Output terminal } 16b\text{: } (\omega t+\theta 1+\theta 2+\theta 6)+(\omega t+\theta 4+\theta 3+\theta 9)+\theta 11=2\ \omega t+\theta 1+\theta 2+\theta 3+\theta 4+\theta 6+\theta 9+\theta 11$$

$$\text{Output terminal } 16c\text{: } (\omega t+\theta 1+\theta 2+\theta 3+\theta 7)+(\omega t+\theta 4+\theta 10)+\theta 11=2\ \omega t+\theta 1+\theta 2+\theta 3+\theta 4+\theta 7+\theta 10+\theta 11 \quad (4)$$

Because it is seen from the equation (3) that $\theta 5+\theta 8=\theta 6+\theta 9=\theta 7+\theta 10=\alpha$, all of the phases of the signals appearing at the output terminals 16*a* to 16*c* of the circuit elements 17*a* to 17*c* are shown by the following equation (5), and equal.

$$2\ \omega t+\theta 1+\theta 2+\theta 3+\theta 4+\alpha+\theta 11 \quad (5)$$

Therefore, even in a case in which the amplifiers 18*a*-1 to 18*c*-1 and 18*a*-2 to 18*c*-2 are arranged separately from the input terminals 14*a*-1 to 14*c*-1 and 14*a*-2 to 14*c*-2 of the mixers 13*a* to 13*c*, and it is therefore necessary to connect between the amplifiers and the input terminals by using the transmission lines 31*a*-1 to 31*c*-1 and 31*a*-2 to 31*c*-2, the signals in phase can be outputted from the output terminals 16*a* to 16*c* of the circuit elements 17*a* to 17*c* by simply causing the electric lengths of the transmission lines 31*a*-1 to 31*c*-1 and 31*a*-2 to 31*c*-2 to have a relationship shown by the equation (3), in addition to equalizing the electric lengths of the transmission lines between circuit elements 17.

Embodiment 3

Although in above-mentioned Embodiment 1 the in-phase corporate-feed circuit in which the frequency of the signal appearing at each of the output terminals 16*a* to 16*c* of the circuit elements 17*a* to 17*c* is twice as high as that of the signal generated by the signal generator 2 is shown, an in-phase corporate-feed circuit in which the frequency of a signal appearing at each of output terminals 16*a* to 16*c* of circuit elements 17*a* to 17*c* is equal to that of a signal generated by a signal generator 2 will be explained in Embodiment 3.

Figure 6:
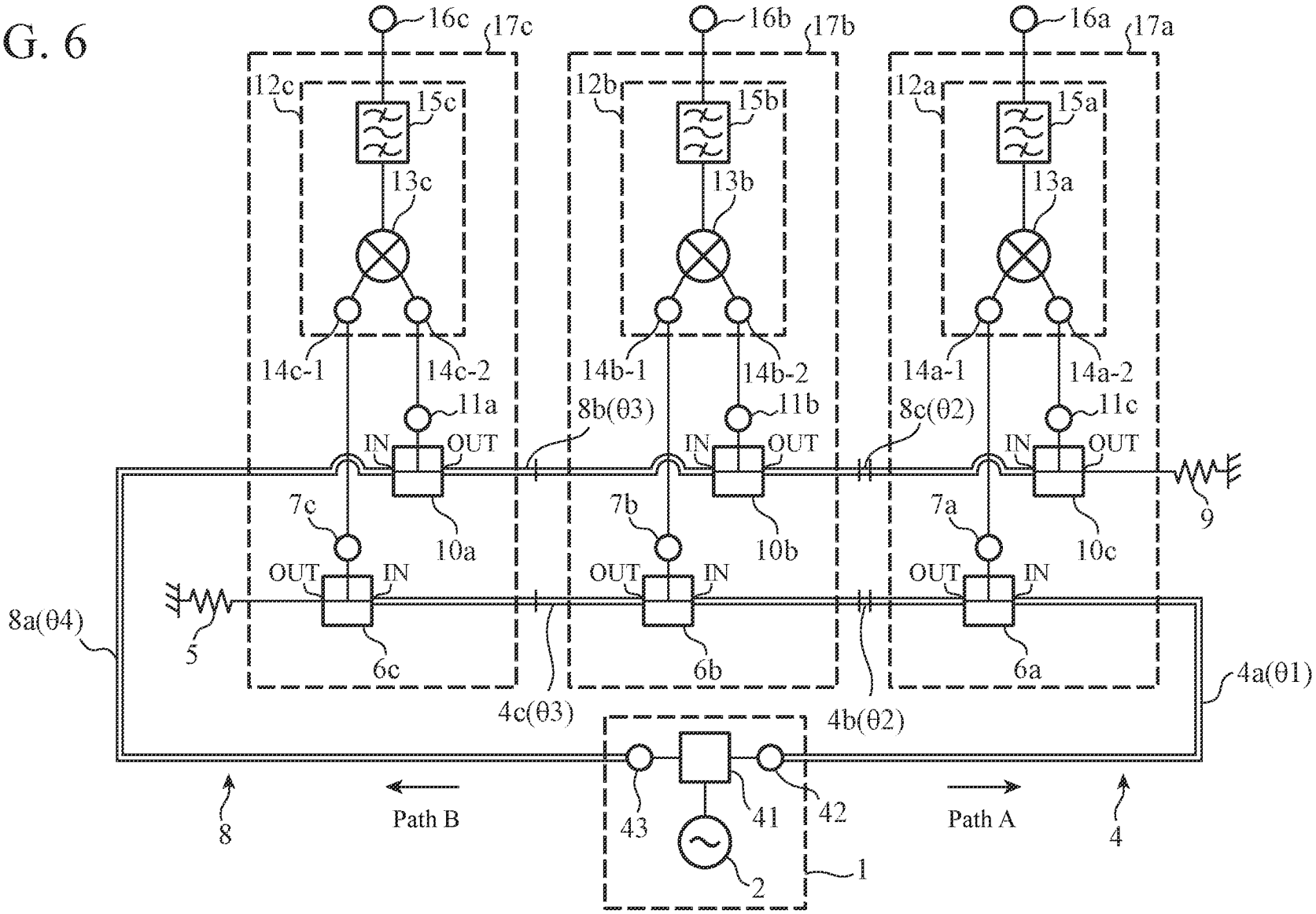
FIG. 6 is a schematic diagram showing an in-phase corporate-feed circuit according to Embodiment 3 of the present invention.

FIG. 6 is a schematic diagram showing the in-phase corporate-feed circuit according to Embodiment 3 of the present invention. In FIG. 6, because the same reference numerals as those shown in FIG. 1 denote the same components or like components, the explanation of the components will be omitted.

In Embodiment 3, a signal generating circuit 1 includes the signal generator 2 and a ½ frequency divider 41.

The ½ frequency divider 41 reduces the frequency of the signal generated by the signal generator 2 to one-half of the frequency and, after that, divides the signal into two signals, and outputs one of the signals after division to a noninverting output terminal 42 and outputs the other one of the signals after division to an inverting output terminal 43.

The phase of the signal outputted from the noninverting output terminal 42 of the ½ frequency divider 41 and the phase of the signal outputted from the inverting output terminal 43 differ from each other by 180 degrees.

Although in FIG. 6 the noninverting output terminal 42 and the inverting output terminal 43 are illustrated as if they are disposed outside the ½ frequency divider 41, the noninverting output terminal and the inverting output terminal can be disposed inside the ½ frequency divider 41.

Further, although in FIG. 6 the example in which the noninverting output terminal 42 of the ½ frequency divider 41 is connected to a transmission line 4*a* and the inverting output terminal 43 of the ½ frequency divider 41 is connected to a transmission line 8*a* is shown, the noninverting output terminal 42 of the ½ frequency divider 41 can be connected to the transmission line 8*a* and the inverting output terminal 43 of the ½ frequency divider 41 can be connected to the transmission line 4*a*.

Next, operations will be explained.

When the signal generator 2 generates a signal, the ½ frequency divider 41 of the signal generating circuit 1 reduces the frequency of the signal to one-half of the frequency and, after that, divides the signal into two signals, and outputs one of the signals after division to the noninverting output terminal 42 and outputs the other one of the signals after division to the inverting output terminal 43.

When the angular frequency of the signal outputted from the signal generator 2 is ω, and it is assumed that, at a time t, the voltage of the signal outputted from the signal generator 2 is expressed by cos(ωt), the voltage of the signal outputted from the noninverting output terminal 42 of the ½ frequency divider 41 is expressed by cos (0.5 ωt) and the voltage of the signal outputted from the inverting output terminal 43 of the ½ frequency divider 41 is expressed by cos(0.5 ωt+π).

It is assumed in Embodiment 3 that the electric length of the transmission line 4*a* at an angular frequency 0.5∫ is θ1, the electric length of a transmission line 4*b* at the angular frequency 0.5ω is θ2, and the electric length of a transmission line 4*c* at the angular frequency 0.5ω is θ3.

It is further assumed that the electric length of the transmission line 8*a* at the angular frequency 0.5ω is θ4, the electric length of a transmission line 8*b* at the angular frequency 0.5ω is θ3, and the electric length of a transmission line 8*c* at the angular frequency 0.5ω is θ2.

A signal outputted from the ½ frequency divider 41 to a transmission line 4 passes through T-branch units 6*a* to 6*c* and is terminated by a terminator 5.

Further, a signal outputted from the ½ frequency divider 41 to a transmission line 8 passes through T-branch units 10*a* to 10*c* and is terminated by a terminator 9.

At this time, when a signal is inputted from an input port IN, each of the T-branch units 6*a* to 6*c* inserted onto the transmission line 4 outputs a part of the signal to a corresponding one of output terminals 7*a* to 7*c* because a branch line is disposed for a line connecting between the input port IN and an output port OUT.

Further, when a signal is inputted from an input port IN, each of the T-branch units 10*a* to 10*c* inserted onto the transmission line 8 outputs a part of the signal to a corresponding one of output terminals 11*a* to 11*c* because a branch line is disposed for a line connecting between the input port IN and an output port OUT.

Mixers 13*a* to 13*c* of phase adding circuits 12*a* to 12*c* have input terminals 14*a*-1 to 14*c*-1 connected to the output terminals 7*a* to 7*c*, and input terminals 14*a*-2 to 14*c*-2 connected to the output terminals 11*c* to 11*a*.

However, because the input impedances of the mixers 13*a* to 13*c* are high, voltages appear at the output terminals 7*a* to 7*c* and 11*c* to 11*a*, but no currents flow toward the input terminal 14*a*-1 to 14*c*-1 and 14*a*-2 to 14*c*-2 of the mixers 13*a* to 13*c*.

The phases of the signals appearing at the output terminals 7*a* to 7*c* and 11*a* to 11*c* of the T-branch units 6*a* to 6*c* and 10*a* to 10*c* are shown by the following equation (6), and all of the phases of these signals differ from one another.

Output terminal 7*a*:0.5 ω*t*+θ1

Output terminal 7*b*:0.5 ω+θ1+θ2

Output terminal 7*c*:0.5 ω*t*+θ1+θ2+θ3

Output terminal 11*a*:0.5 ω*t*+θ4+π

Output terminal 11*b*:0.5 ω*t*+θ4+θ3+π

Output terminal 11*c*:0.5 ω*t*+θ4+θ3+θ2+π (6)

Because the voltage of the signal outputted from the inverting output terminal 43 of the ½ frequency divider 41 is expressed by cos(0.5 ωt+π), π is included in the phase of the signal appearing at each of the output terminals 11*a* to 11*c* of the T-branch units 10*a* to 10*c*.

Each of the mixers 13*a* to 13*c* mixes two signals inputted thereto and outputs a mixed signal to a corresponding one of filters 15*a* to 15*c*, like that according to above-mentioned Embodiment 1.

When receiving the mixed signal from a corresponding one of the mixers 13*a* to 13*c*, each of the filters 15*a* to 15*c* prevents the passage of a component having a phase which is the difference between the phases of the two signals and higher-order mixed wave components, which are included in the mixed signal, and passes only a component having a phase which is the sum of the phases of the two signals, which is included in the mixed signal, like that according to above-mentioned Embodiment 1. As a result, the components passing through the filters 15*a* to 15*c* and each having a phase which is the sum of the phases of the two signals are outputted from the output terminals 16*a* to 16*c*.

The phases of the signals appearing at the output terminals 16*a* to 16*c* of the circuit elements 17*a* to 17*c* are shown by the following equation (7).

Output terminal 16*a*: (0.5 ω*t*+θ1)+(0.5 ω*t*+θ4+θ3+θ2+π)=ω*t*+θ1+θ2+θ3+θ4+π

Output terminal 16*b*: (0.5 ω*t*+θ1+θ2)+(0.5 ω*t*+θ4+θ3+π)=ω*t*+θ1+θ2+θ3+θ4+π

Output terminal 16*c*: (0.5 ω*t*+θ1+θ2+θ3)+(0.5 ω*t*+θ4+π)=ω*t*+θ1+θ2+θ3+θ4+π (7)

As is clear from the equation (7), all of the phases of the signals appearing at the output terminals 16*a* to 16*c* of the circuit elements 17*a* to 17*c* are equal.

Therefore, even in the case of using the ½ frequency divider 41 instead of the power divider 3, the signals in phase can be outputted from the output terminals 16*a* to 16*c* of the circuit elements 17*a* to 17*c*, like in the case of above-mentioned Embodiment 1. Further, the signals each having a frequency equal to the frequency of the signal generated by the signal generator 2 can be outputted from the output terminals 16*a* to 16*c* of the circuit elements 17*a* to 17*c*. More specifically, the angular frequency ω of the signal generated by the signal generator 2 can be made to match the angular frequency ω of the signals outputted from the output terminals 16*a* to 16*c* of the circuit elements 17*a* to 17*c*.

Figure 7:
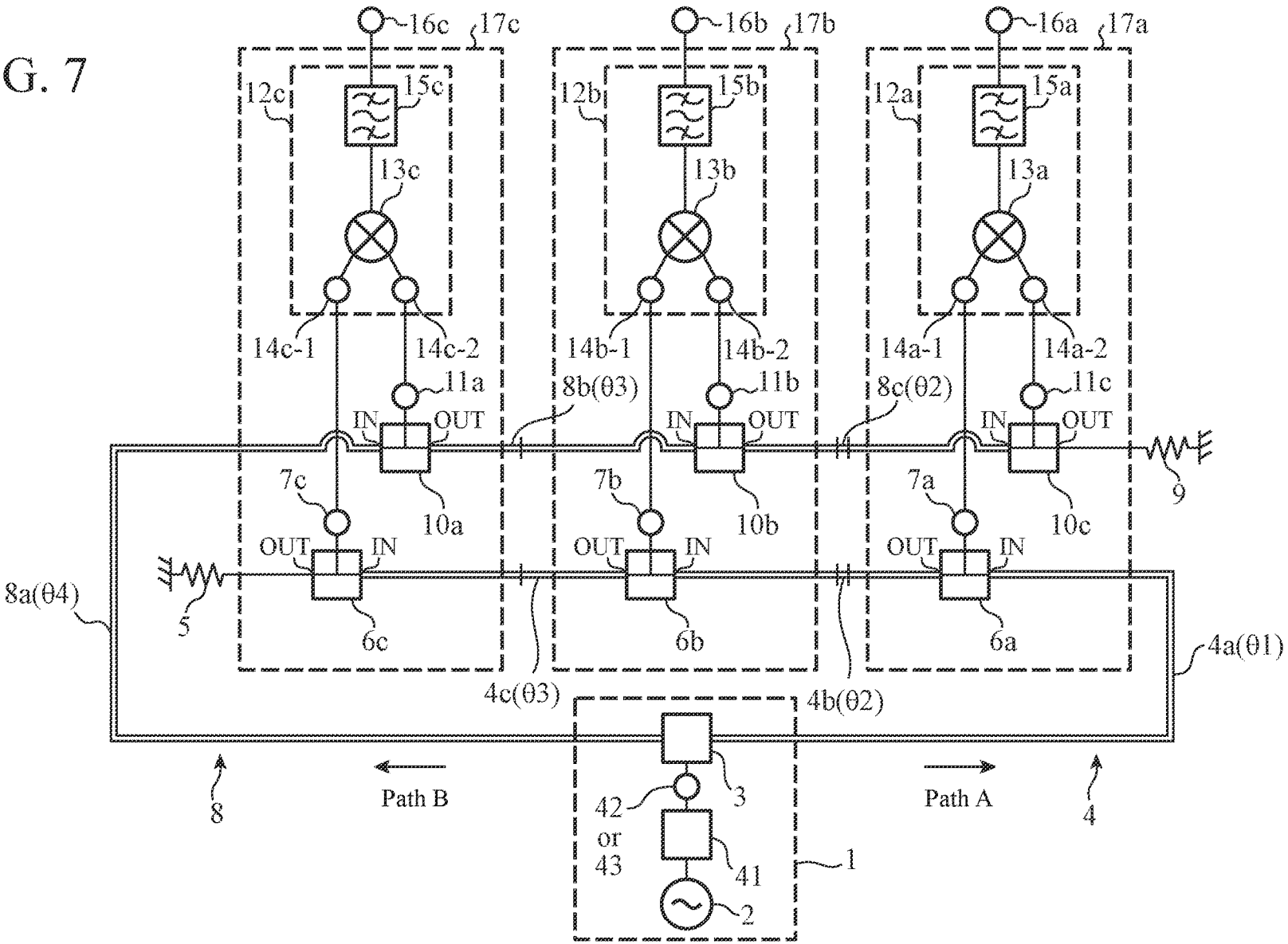
FIG. 7 is a schematic diagram showing an in-phase corporate-feed circuit according to Embodiment 3 of the present invention.

Although in Embodiment 3 the example in which the ½ frequency divider 41 is used instead of the power divider 3, the noninverting output terminal 42 of the ½ frequency divider 41 is connected to the transmission line 4*a*, and the inverting output terminal 43 is connected to the transmission line 8*a* is shown, the noninverting output terminal 42 or the inverting output terminal 43 of the ½ frequency divider 41 can be connected to a power divider 3, and the power divider 3 can divide the signal outputted from the ½ frequency divider 41 to signals to the transmission lines 4*a* and 8*a*, as shown in FIG. 7.

Further, a 1/N frequency divider (where N is an integer or a rational number) can be used instead of the ½ frequency divider 41. However, in this case, the angular frequency of the signals outputted from the output terminals 16*a* to 16*c* of the circuit elements 17*a* to 17*c* is 2×ω/N, and differs from the angular frequency ω of the signal generated by the signal generator 2. The 1/N frequency divider can be a fixed frequency divider or a variable frequency divider.

Further, a direct digital synthesizer can be used instead of the ½ frequency divider 41. Hereafter, the direct digital synthesizer is referred to as the DDS (Direct Digital Synthesizer).

The DDS has a control signal input terminal, a clock signal input terminal, and an output terminal. Because the DDS can vary the frequency of a clock signal inputted from the clock signal input terminal in accordance with a control signal inputted from the control signal input terminal, and output the clock signal after frequency variation from the output terminal, the DDS can be provided with a function equivalent to that of the variable frequency divider.

In addition, the variable frequency divider or the DDS which is connected instead of the ½ frequency divider 41 can be configured to vary the frequency of the signal outputted from the output terminal with time. Even if the frequency is varied with time, all of the phases of the signals appearing at the output terminals 16*a* to 16*c* of the circuit elements 17*a* to 17*c* can be made to be equal at each time point, like in the case of above-mentioned Embodiment 1.

Although in Embodiment 3 the variant of above-mentioned Embodiment 1 in which the signal generating circuit 1 includes the signal generator 2 and the ½ frequency divider 41 is explained, above-mentioned Embodiment 2 can be modified by applying the signal generating circuit 1 including the signal generator 2 and the ½ frequency divider 41 to above-mentioned Embodiment 2.

Embodiment 4

Although in above-mentioned Embodiments 1 and 2 the example in which the amplifiers 18*a*-1 to 18*c*-1 are connected between the output terminals 7*a* to 7*c* of the T-branch units 6*a* to 6*c* and the input terminals 14*a*-1 to 14*c*-1 of the mixers 13*a* to 13*c*, and the amplifiers 18*a*-2 to 18*c*-2 are connected between the output terminals 11*c* to 11*a* of the T-branch units 10*c* to 10*a* and the input terminals 14*a*-2 to 14*c*-2 of the mixers 13*a* to 13*c* is shown, attenuators can be further connected between the amplifiers 18*a*-1 to 18*c*-1 and 18*a*-2 to 18*c*-2 and the input terminals 14*a*-1 to 14*c*-1 and 14*a*-2 to 14*c*-2 of the mixers 13*a* to 13*c*.

Figure 8:
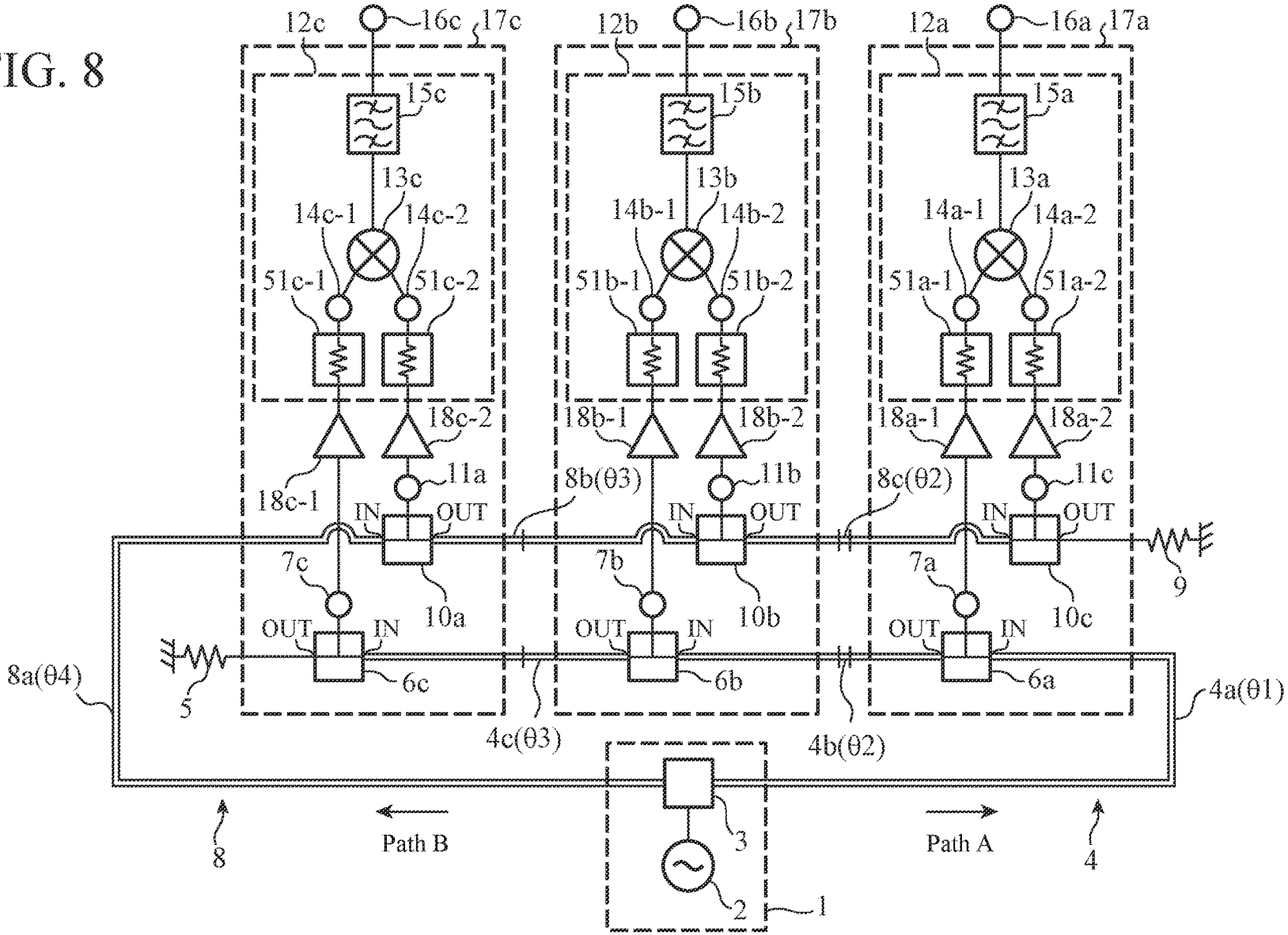
FIG. 8 is a schematic diagram showing an in-phase corporate-feed circuit according to Embodiment 4 of the present invention.

FIG. 8 is a schematic diagram showing an in-phase corporate-feed circuit according to Embodiment 4 of the present invention. In FIG. 8, because the same reference numerals as those shown in FIGS. 3 and 5 denote the same components or like components, the explanation of the components will be omitted.

An attenuator 51*a*-1 is connected between an amplifier 18*a*-1 and an input terminal 14*a*-1 of a mixer 13*a*, and attenuates the amplitude of a signal outputted from the amplifier 18*a*-1 and provides the signal after amplitude attenuation for the input terminal 14*a*-1 of the mixer 13*a*.

An attenuator 51*a*-2 is connected between an amplifier 18*a*-2 and an input terminal 14*a*-2 of the mixer 13*a*, and attenuates the amplitude of a signal outputted from the amplifier 18*a*-2 and provides the signal after amplitude attenuation for the input terminal 14*a*-2 of the mixer 13*a*.

An attenuator 51*b*-1 is connected between an amplifier 18*b*-1 and an input terminal 14*b*-1 of a mixer 13*b*, and attenuates the amplitude of a signal outputted from the amplifier 18*b*-1 and provides the signal after amplitude attenuation for the input terminal 14*b*-1 of the mixer 13*b*.

An attenuator 51*b*-2 is connected between an amplifier 18*b*-2 and an input terminal 14*b*-2 of the mixer 13*b*, and attenuates the amplitude of a signal outputted from the amplifier 18*b*-2 and provides the signal after amplitude attenuation for the input terminal 14*b*-2 of the mixer 13*b*.

An attenuator 51*c*-1 is connected between an amplifier 18*c*-1 and an input terminal 14*c*-1 of a mixer 13*c*, and attenuates the amplitude of a signal outputted from the amplifier 18*c*-1 and provides the signal after amplitude attenuation for the input terminal 14*c*-1 of the mixer 13*c*.

An attenuator 51*c*-2 is connected between an amplifier 18*c*-2 and an input terminal 14*c*-2 of the mixer 13*c*, and attenuates the amplitude of a signal outputted from the amplifier 18*c*-2 and provides the signal after amplitude attenuation for the input terminal 14*c*-2 of the mixer 13*c*.

Next, operations will be explained.

For example, in a case in which the amplitudes of two signals after division by a power divider 3 are not equal, and in a case in which the amplitudes of the two signals after division by the power divider 3 are attenuated depending on the lengths of transmission lines 4*a* to 4*c* and 8*a* to 8*c* because there is a loss in each of the transmission lines 4*a* to 4*c* and 8*a* to 8*c*, the combination of the amplitudes of the two signals inputted to each of the mixers 13*a* to 13*c* is different.

When the combination of the amplitudes of the two signals inputted to each of the mixers 13*a* to 13*c* is different, there is a case in which the operating points of nonlinear elements which construct the mixers 13*a* to 13*c* are different, and the phases of signals outputted from the mixers 13*a* to 13*c* are different even if the sum of the phases of the two signals inputted to each of the mixers 13*a* to 13*c* is equal.

In Embodiment 4, by appropriately setting the amounts of attenuation of the attenuators 51*a*-1 to 51*c*-1 and 51*a*-2 to 51*c*-2, the combination of the amplitudes of the two signals inputted to each of the mixers 13*a* to 13*c* is adjusted to be equal. For example, when the amplitude of the signal inputted to the input terminal 14*a*-1 of the mixer 13*a* is A and the amplitude of the signal inputted to the input terminal 14*a*-2 is B, the amplitude of the signal inputted to each of the input terminals 14*b*-1 and 14*c*-1 of the mixers 13*b* and 13*c* is adjusted to be A and the amplitude of the signal inputted to each of the input terminals 14*b*-2 and 14*c*-2 is adjusted to be B.

As a result, because the operating points of the nonlinear elements which construct the mixers 13*a* to 13*c* are the same as one another, the phases of the signals outputted from the mixers 13*a* to 13*c* can be made to be equal.

Although in Embodiment 4 the example in which the attenuators 51*a*-1 to 51*c*-1 and 51*a*-2 to 51*c*-2 that attenuate the amplitudes of the signals outputted from the amplifiers 18*a*-1 to 18*c*-1 and 18*a*-2 to 18*c*-2 are disposed is shown, the combination of the amplitudes of the two signals inputted to each of the mixers 13*a* to 13*c* can be made to be equal without disposing the attenuators 51*a*-1 to 51*c*-1 and 51*a*-2 to 51*c*-2, by appropriately setting the gains of the amplifiers 18*a*-1 to 18*c*-1 and 18*a*-2 to 18*c*-2.

Figure 9:
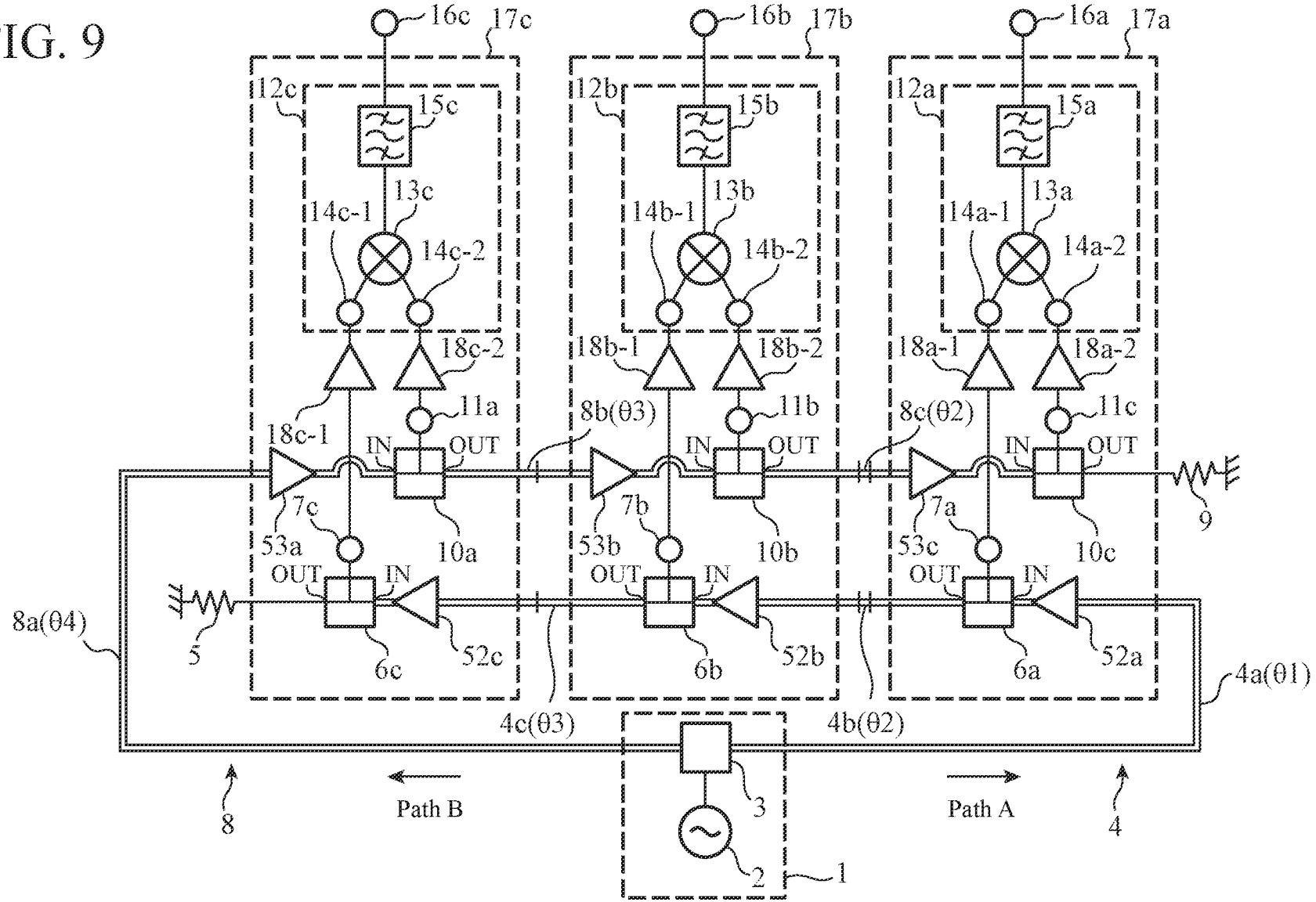
FIG. 9 is a schematic diagram showing the in-phase corporate-feed circuit according to Embodiment 4 of the present invention.

Although in Embodiment 4 the example in which the attenuators 51*a*-1 to 51*c*-1 and 51*a*-2 to 51*c*-2 that attenuate the amplitudes of the signals outputted from the amplifiers 18*a*-1 to 18*c*-1 and 18*a*-2 to 18*c*-2 are disposed is shown, the combination of the amplitudes of the two signals inputted to each of the mixers 13*a* to 13*c* can be made to be equal without disposing the attenuators 51*a*-1 to 51*c*-1 and 51*a*-2 to 51*c*-2, by inserting amplifiers 52*a*, 52*b*, and 52*c* onto the transmission lines 4*a*, 4*b*, and 4*c* and also inserting amplifiers 53*a*, 53*b*, and 53*c* onto the transmission lines 8*a*, 8*b*, and 8*c*, as shown in FIG. 9, and appropriately setting the gains of the amplifiers 52*a* to 52*c* and 53*a* to 53*c*.

Although in Embodiment 4 the example in which, in the configuration shown in FIG. 8, the attenuators 51*a*-1 to 51*c*-1 and 51*a*-2 to 51*c*-2 are connected to the sets of the two input terminals of the mixers 13*a* to 13*c* is shown, an attenuator can be connected to either of the two input terminals of each of the mixers.

Further, in the configuration shown in FIG. 9, only either the amplifiers 52*a* to 52*c* or the amplifiers 53*a* to 53*c* can be connected.

Although in Embodiment 4 the example in which the attenuators 51*a*-1 to 51*c*-1 and 51*a*-2 to 51*c*-2 are connected between the amplifiers 18*a*-1 to 18*c*-1 and 18*a*-2 to 18*c*-2, and the input terminals 14*a*-1 to 14*c*-1 and 14*a*-2 to 14*c*-2 of the mixers 13*a* to 13*c* is shown, the attenuators 51*a*-1 to 51*c*-1 and 51*a*-2 to 51*c*-2 can also be applied to the in-phase corporate-feed circuit shown in any of above-mentioned Embodiments 1 to 3 as long as the in-phase corporate-feed circuit is equipped with the amplifiers 18*a*-1 to 18*c*-1 and 18*a*-2 to 18*c*-2.

Embodiment 5

Although in above-mentioned Embodiments 1 to 4 the example in which the T-branch units 6*a* to 6*c* and 10*a* to 10*c* are inserted onto the transmission lines 4 and 8 is shown, circulators, instead of the T-branch units 6*a* to 6*c* and 10*a* to 10*c*, can be inserted onto the transmission lines 4 and 8.

Figure 10:
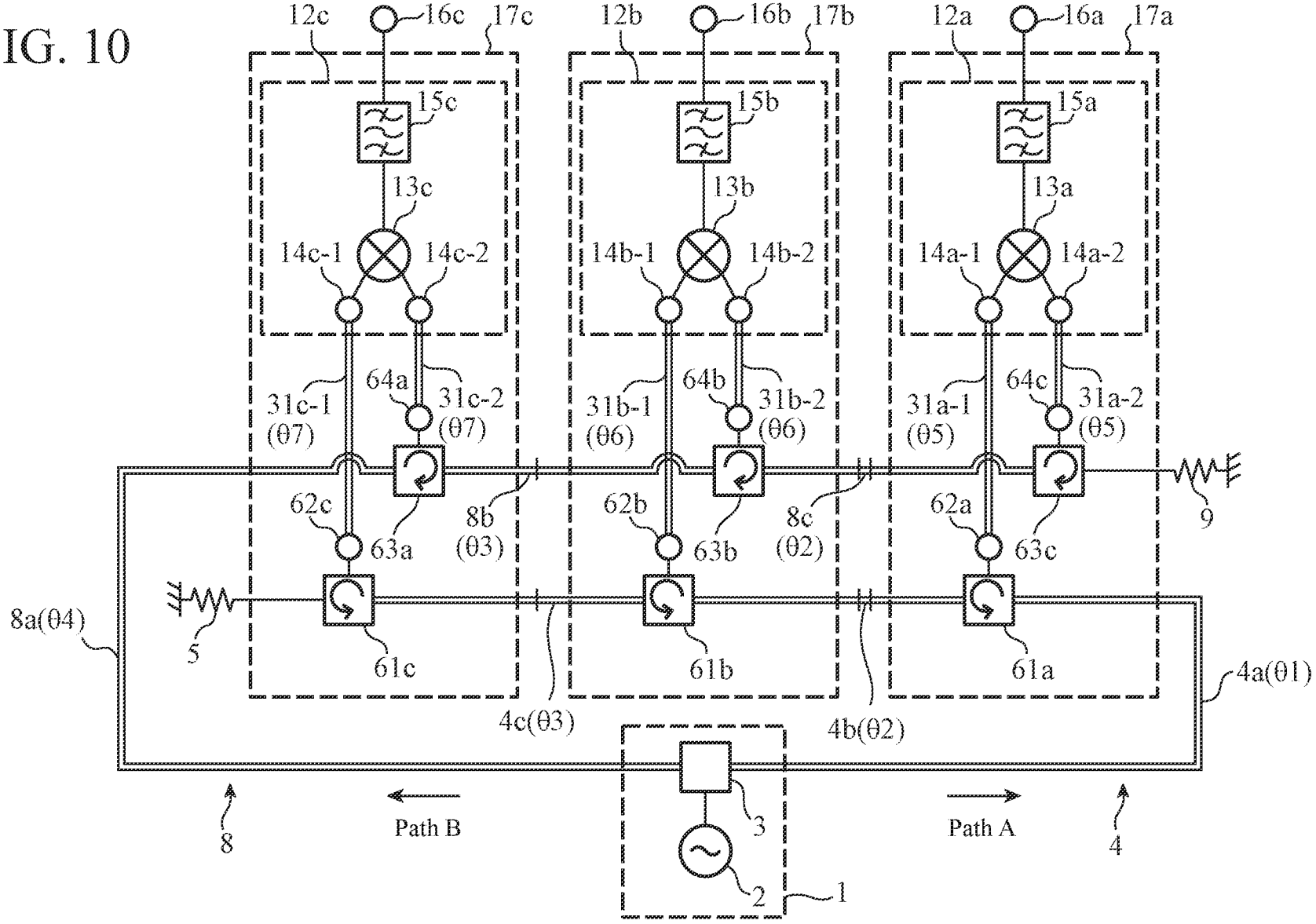
FIG. 10 is a schematic diagram showing an in-phase corporate-feed circuit according to Embodiment 5 of the present invention.

FIG. 10 is a schematic diagram showing an in-phase corporate-feed circuit according to Embodiment 5 of the present invention. In FIG. 10, because the same reference numerals as those shown in FIGS. 1 and 5 denote the same components or like components, the explanation of the components will be omitted.

Figure 11:
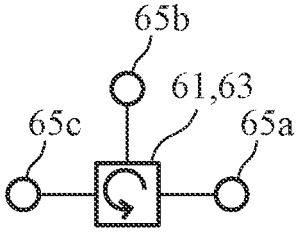
FIG. 11 is an explanatory drawing showing circulators 61 and 63.

FIG. 11 is an explanatory drawing showing each of circulators 61 and 63.

Each of the circulators 61 and 63 is a type of non-reciprocal circuit having a property of transmitting a signal only in a predetermined direction, but not transmitting any signal in an opposite direction.

Each of the circulators 61 and 63 has three terminals 65*a*, 65*b*, and 65*c*. A signal inputted from the terminal 65*a* is outputted from the terminal 65*b*, a signal inputted from the terminal 65*b* is outputted from the terminal 65*c*, and a signal inputted from the terminal 65*c* is outputted from the terminal 65*a*, but no signals are transmitted in opposite directions.

A circulator 61*a* has a terminal 65*a* connected to a transmission line 4*a*, a terminal 65*b* connected to an output terminal 62*a*, and a terminal 65*c* connected to a transmission line 4*b*.

A circulator 61*b* has a terminal 65*a* connected to the transmission line 4*b*, a terminal 65*b* connected to an output terminal 62*b*, and a terminal 65*c* connected to a transmission line 4*c*.

A circulator 61*c* has a terminal 65*a* connected to the transmission line 4*c*, a terminal 65*b* connected to an output terminal 62*c*, and a terminal 65*c* connected to a terminator 5.

The output terminal 62*a* is connected to the terminal 65*b* of the circulator 61*a*, and a transmission line 31*a*-1.

The output terminal 62*b* is connected to the terminal 65*b* of the circulator 61*b*, and a transmission line 31*b*-1.

The output terminal 62*c* is connected to the terminal 65*b* of the circulator 61*c*, and a transmission line 31*c*-1.

The circulators 61*a*, 61*b*, and 61*c* construct first T-branch circuits.

A circulator 63*a* has a terminal 65*a* connected to a transmission line 8*a*, a terminal 65*b* connected to an output terminal 64*a*, and a terminal 65*c* connected to a transmission line 8*b*.

A circulator 63*b* has a terminal 65*a* connected to the transmission line 8*b*, a terminal 65*b* connected to an output terminal 64*b*, and a terminal 65*c* connected to a transmission line 8*c*.

A circulator 63*c* has a terminal 65*a* connected to the transmission line 8*c*, a terminal 65*b* connected to an output terminal 64*c*, and a terminal 65*c* connected to a terminator 9.

The output terminal 64*a* is connected to the terminal 65*b* of the circulator 63*a*, and a transmission line 31*c*-2.

The output terminal 64*b* is connected to the terminal 65*b* of the circulator 63*b*, and a transmission line 31*b*-2.

The output terminal 64*c* is connected to the terminal 65*b* of the circulator 63*c*, and a transmission line 31*a*-2.

The circulators 63*a*, 63*b*, and 63*c* construct second branch circuits.

Next, operations will be explained.

It is assumed in Embodiment 5 that the electric lengths of the transmission lines 31*a*-1, 31*b*-1, 31*c*-1, 31*a*-2, 31*b*-2, and 31*c*-2 are as follows.

The electric length of the transmission line 31*a*-1 at an angular frequency $\omega=\theta 5$ The electric length of the transmission line 31*b*-1 at the angular frequency $\omega=\theta 6$ The electric length of the transmission line 31*c*-1 at the angular frequency $\omega=\theta 7$ The electric length of the transmission line 31*a*-2 at the angular frequency $\omega=\theta 5$ The electric length of the transmission line 31*b*-2 at the angular frequency $\omega=\theta 6$ The electric length of the transmission line 31*c*-2 at the angular frequency $\omega=\theta 7$ Thus, there is a relationship in which the electric lengths of the transmission lines 31*a*-1 and 31*a*-2 are $\theta 5$ and equal, the electric lengths of the transmission lines 31*b*-1 and 31*b*-2 are $\theta 6$ and equal, and the electric lengths of the transmission lines 31*c*-1 and 31*c*-2 are $\theta 7$ and equal.

When a signal generator 2 generates a signal, a power divider 3 of a signal generating circuit 1 divides the power of the signal into two parts and outputs signals in phase to a transmission line 4 and a transmission line 8, like that according to above-mentioned Embodiment 1.

When the signal outputted from the power divider 3 is provided for the terminal 65*a*, the circulator 61*a* outputs this signal from the terminal 65*b*. The signal outputted from the terminal 65*b* of the circulator 61*a* is transmitted to an input terminal 14*a*-1 of a mixer 13*a* via the output terminal 62*a* and the transmission line 31*a*-1. However, because the input impedance of the mixer 13*a* is high, the signal which reaches the input terminal 14*a*-1 of the mixer 13*a* is reflected and transmitted to the terminal 65*b* of the circulator 61*a* via the transmission line 31*a*-1 and the output terminal 62*a*.

When the signal reflected by the mixer 13*a* is provided for the terminal 65*b*, the circulator 61*a* outputs this signal from the terminal 65*c*. The signal outputted from the terminal 65*c* of the circulator 61*a* is transmitted to the terminal 65*a* of the circulator 61*b* via the transmission line 4*b*.

The circulator 61*b* operates in the same way as the circulator 61*a*, and outputs the signal outputted from the circulator 61*a* to the mixer 13*b* via the output terminal 62*b* and the transmission line 31*b*-1 and, after that, outputs the signal which is reflected by the mixer 13*b* and returns thereto to the circulator 61*c* via the transmission line 4*c*.

The circulator 61*c* operates in the same way as the circulator 61*a*, and outputs the signal outputted from the circulator 61*b* to the mixer 13*c* via the output terminal 62*c* and the transmission line 31*c*-1 and, after that, outputs the signal which is reflected by the mixer 13*c* and returns thereto to the terminator 5.

The circulator 63*a* operates in the same way as the circulator 61*a*, and outputs the signal outputted from the power divider 3 to the mixer 13*c* via the output terminal 64*a* and the transmission line 31*c*-2 and, after that, outputs the signal which is reflected by the mixer 13*c* and returns thereto to the circulator 63*b* via the transmission line 8*b*.

The circulator 63*b* operates in the same way as the circulator 61*a*, and outputs the signal outputted from the circulator 63*a* to the mixer 13*b* via the output terminal 64*b* and the transmission line 31*b*-2 and, after that, outputs the signal which is reflected by the mixer 13*b* and returns thereto to the circulator 63*c* via the transmission line 8*c*.

The circulator 63*c* operates in the same way as the circulator 61*a*, and outputs the signal outputted from the circulator 63*b* to the mixer 13*a* via the output terminal 64*c* and the transmission line 31*a*-2 and, after that, outputs the signal which is reflected by the mixer 13*a* and returns thereto to the terminator 9.

The phases of the signals appearing at the input terminals 14*a*-1, 14*b*-1, 14*c*-1, 14*a*-2, 14*b*-2, and 14*c*-2 of the mixers 13*a* to 13*c* are shown by the following equation (8), and all of the phases of these signals differ from one another.

$$\text{Input terminal } 14a\text{-}1{:}\ \omega t+\theta 1+\theta 5$$

$$\text{Input terminal } 14b\text{-}1{:}\ \omega t+\theta 1+2\times\theta 5+\theta 2+\theta 6$$

$$\text{Input terminal } 14c\text{-}1{:}\ \omega t+\theta 1+2\times\theta 5+\theta 2+2\times\theta 6+\theta 3+\theta 7$$

$$\text{Input terminal } 14a\text{-}2{:}\ \omega t+\theta 4+2\times\theta 7+\theta 3+2\times\theta 6+\theta 2+\theta 5$$

$$\text{Input terminal } 14b\text{-}2{:}\ \omega t+\theta 4+2\times\theta 7+\theta 3+\theta 6$$

$$\text{Input terminal } 14c\text{-}2{:}\ \omega t+\theta 4+\theta 7 \tag{8}$$

Each of the mixers 13*a* to 13*c* mixes the two signals inputted thereto and outputs a mixed signal to a corresponding one of filters 15*a* to 15*c*, like that according to above-mentioned Embodiment 1.

When receiving the mixed signal from a corresponding one of the mixers 13*a* to 13*c*, each of the filters 15*a* to 15*c* prevents the passage of a component having a phase which is the difference between the phases of the two signals and higher-order mixed wave components, which are included in the mixed signal, and passes only a component having a phase which is the sum of the phases of the two signals, which is included in the mixed signal, like that according to above-mentioned Embodiment 1. As a result, the components passing through the filters 15*a* to 15*c* and each having a phase which is the sum of the phases of the two signals are outputted from output terminals 16*a* to 16*c*.

The phases of the signals appearing at the output terminals 16*a* to 16*c* of circuit elements 17*a* to 17*c* are shown by the following equation (9).

$$\text{Output terminal } 16a{:}\ (\omega t+\theta 1+\theta 5)+(\omega t+\theta 4+2\times\theta 7+\theta 3+2\times\theta 6+\theta 2+\theta 5)=2\ \omega t+\theta 1+\theta 2+\theta 3+\theta 4+2\times(\theta 5+\theta 6+\theta 7)$$

$$\text{Output terminal } 16b{:}\ (\omega t+\theta 1+2\times\theta 5+\theta 2+\theta 6)+(\omega t+\theta 4+2\times\theta 7+\theta 3+\theta 6)=2\ \omega t+\theta 1+\theta 2+\theta 3+\theta 4+2\times(\theta 5+\theta 6+\theta 7)$$

$$\text{Output terminal } 16c{:}\ (\omega t+\theta 1+2\times\theta 5+\theta 2+2\times\theta 6+\theta 3+\theta 7)+(\omega t+\theta 4+\theta 7)=2\ \omega t=\theta 1+\theta 2+\theta 3+\theta 4+2\times(\theta 5+\theta 6+\theta 7) \tag{9}$$

As is clear from the equation (9), all of the phases of the signals appearing at the output terminals 16*a* to 16*c* of the circuit elements 17*a* to 17*c* are equal.

In the case of using the circulators 61*a* to 61*c* and 63*a* to 63*c*, like in the case of Embodiment 5, in addition to equalizing the electric lengths of the transmission lines between circuit elements 17, the electric lengths of the transmission lines 31*a*-1 and 31*a*-2 are equalized, the electric lengths of the transmission lines 31*b*-1 and 31*b*-2 are equalized, and the electric lengths of the transmission lines 31*c*-1 and 31*c*-2 are equalized. However, in the case where the transmission lines 31*a*-1 to 31*c*-1 and 31*a*-2 to 31*c*-2 are not disposed, the electric lengths of the transmission lines between circuit elements 17 may be preferably equalized, as shown in above-mentioned Embodiment 1.

Embodiment 6

Although in above-mentioned Embodiment 1 the example in which the in-phase corporate-feed circuit includes the transmission line 4 and the transmission line 8, and the power divider 3 divides the signal generated by the signal generator 2 into signals to the transmission line 4 and the transmission line 8 is shown, the in-phase corporate-feed circuit can be configured to include a transmission line which consists of a forward path and a return path, thereby eliminating the need for the power divider 3 and achieving further downsizing of the circuit size.

Figure 12:
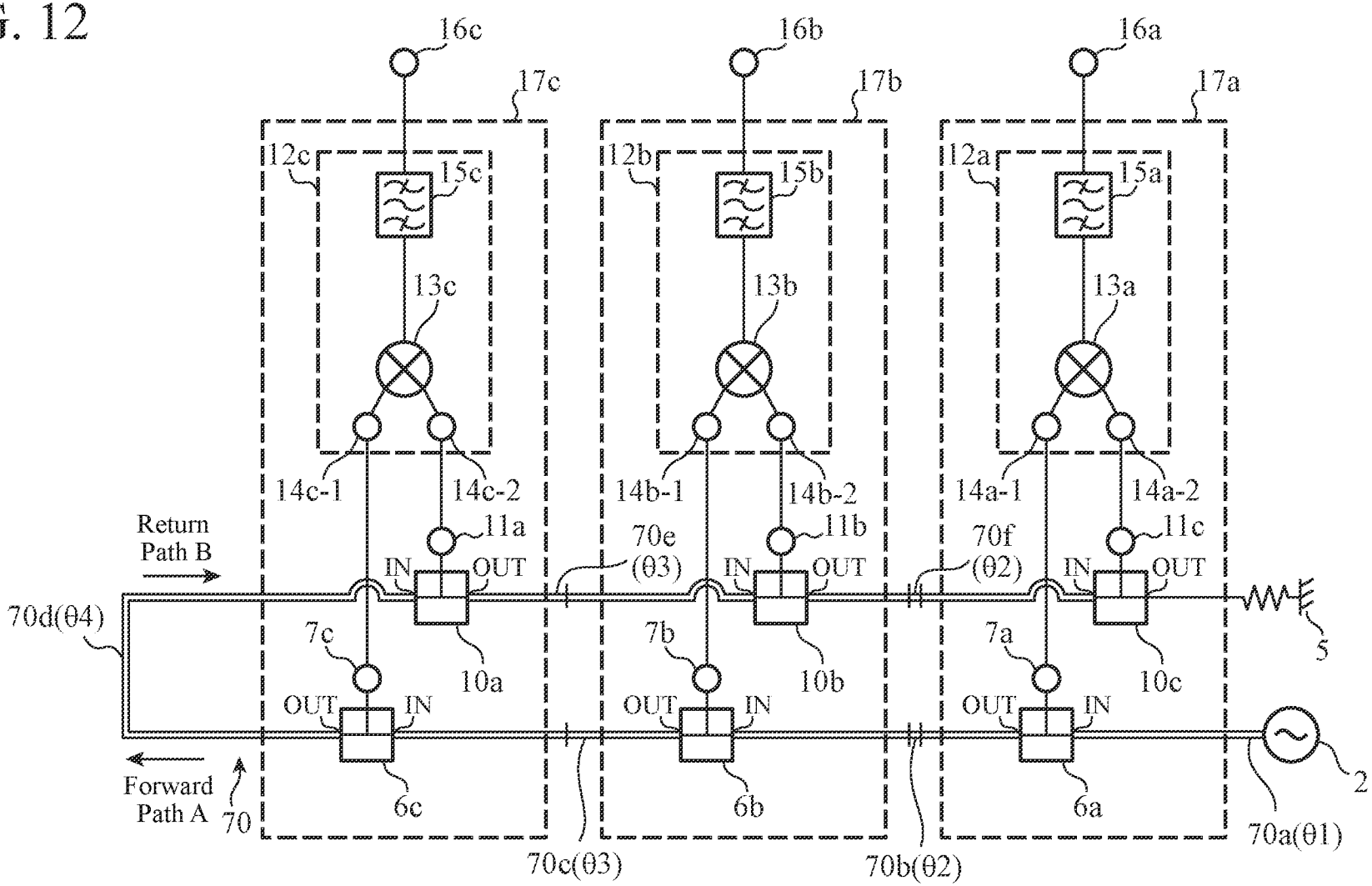
FIG. 12 is a schematic diagram showing an in-phase corporate-feed circuit according to Embodiment 6 of the present invention.

FIG. 12 is a schematic diagram showing an in-phase corporate-feed circuit according to Embodiment 6 of the present invention. In FIG. 12, because the same reference numerals as those shown in FIG. 1 denote the same components or like components, the explanation of the components will be omitted.

A transmission line 70 is one along which signals propagate bidirectionally. This transmission line consists of, for example, a coaxial cable, a waveguide, a microstrip line formed on a printed circuit board, or the like, and includes transmission lines 70*a*, 70*b*, 70*c*, 70*d*, 70*e*, and 70*f*.

A path which consists of the transmission lines 70*a*, 70*b*, and 70*c*, and a first half extending up to a halfway point of the transmission line 70*d* is a forward path A, and a path which consists of a second half extending from the halfway point of the transmission line 70*d*, and the transmission lines 70*e* and 70*f* is a return path B.

In Embodiment 6, T-branch units 6*a*, 6*b*, and 6*c* are inserted onto the forward path A of the transmission line 70, and T-branch units 10*a*, 10*b*, and 10*c* are inserted onto the return path B of the transmission line 70.

In Embodiment 6, the angular frequency of a signal outputted from a signal generator 2 is ω, and it is assumed that, at a time t, the voltage of the signal outputted from the signal generator 2 is expressed by cos (ωt).

Further, it is assumed that the electric length of the transmission line 70*a* at the angular frequency ω is θ1, the electric length of the transmission line 70*b* at the angular frequency ω is θ2, and the electric length of the transmission line 70*c* at the angular frequency ω is θ3.

In addition, it is assumed that the electric length of the transmission line 70*d* at the angular frequency ω is θ4, the electric length of the transmission line 70*e* at the angular frequency ω is θ3, and the electric length of the transmission line 70*f* at the angular frequency ω is θ2.

Therefore, the electric length θ2 of the transmission line 70*b* between the T-branch unit 6*a* which is first when counted from an end of the transmission line 70 connected to the signal generator 2, i.e., from a start point of the forward path A, and the T-branch unit 6*b* which is second when counted from the start point of the forward path A, is equal to the electric length θ2 of the transmission line 70*f* between the T-branch unit 10*c* which is first when counted from another end of the transmission line 70 connected to a terminator 5, i.e., from an end point of the return path B, and the T-branch unit 10*b* which is second when counted from the end point of the return path B.

Further, the electric length θ3 of the transmission line 70*c* between the T-branch unit 6*b* which is second when counted from the start point of the forward path A, and the T-branch unit 6*c* which is third when counted from the start point of the forward path A, is equal to the electric length θ3 of the transmission line 70*e* between the T-branch unit 10*b* which is second when counted from the end point of the return path B, and the T-branch unit 10*a* which is third when counted from the end point of the return path B.

Next, operations will be explained.

In Embodiment 6, for the sake of simplicity, it is assumed that phase variations which are caused by the transmission of signals by the T-branch units 6*a* to 6*c* and 10*a* to 10*c*, and filters 15*a* to 15*c* can be neglected.

It is further assumed that the T-branch unit 10*c* is connected directly to the terminator 5, not via any transmission line, and mixers 13*a* to 13*c* are connected directly to the filters 15*a* to 15*c*, not via any transmission lines.

It is further assumed that the input impedances of the mixers 13*a* to 13*c* are high.

The signal generator 2 generates a signal and outputs the signal to the transmission line 70*a*.

The signal outputted from the signal generator 2 to the transmission line 70*a* passes through the T-branch units 6*a* to 6*c* and 10*a* to 10*c*, and is terminated by the terminator 5.

At this time, when a signal is inputted from an input port IN, each of the T-branch units 6*a* to 6*c* inserted onto the forward path A of the transmission line 70 outputs a part of the signal to a corresponding one of output terminals 7*a* to 7*c* because a branch line is disposed for a line connecting between the input port IN and an output port OUT.

Further, when a signal is inputted from an input port IN, each of the T-branch units 10*a* to 10*c* inserted onto the return path B of the transmission line 70 outputs a part of the signal to a corresponding one of output terminals 11*a* to 11*c* because a branch line is disposed for a line connecting between the input port IN and an output port OUT.

The mixers 13*a* to 13*c* of phase adding circuits 12*a* to 12*c* have input terminals 14*a*-1 to 14*c*-1 connected to the output terminals 7*a* to 7*c*, and input terminals 14*a*-2 to 14*c*-2 connected to the output terminals 11*c* to 11*a*.

However, because the input impedances of the mixers 13*a* to 13*c* are high, voltages appear at the output terminals 7*a* to 7*c* and 11*c* to 11*a*, but no currents flow toward the input terminal 14*a*-1 to 14*c*-1 and 14*a*-2 to 14*c*-2 of the mixers 13*a* to 13*c*.

The phases of the signals appearing at the output terminals 7*a* to 7*c* and 11*a* to 11*c* of the T-branch units 6*a* to 6*c* and 10*a* to 10*c* are shown by the following equation (10), and all of the phases of these signals differ from one another.

$$\text{Output terminal } 7a{:}\omega t+\theta 1$$

$$\text{Output terminal } 7b{:}\omega t+\theta 1+\theta 2$$

$$\text{Output terminal } 7c{:}\omega t+\theta 1+\theta 2+\theta 3$$

$$\text{Output terminal } 11a{:}\omega t+\theta 1+\theta 2+\theta 3+\theta 4$$

$$\text{Output terminal } 11b{:}\omega t+\theta 1+\theta 2+2\times\theta 3+\theta 4$$

$$\text{Output terminal } 11c{:}\omega t+\theta 1+2\times\theta 2+2\times\theta 3+\theta 4 \tag{10}$$

Each of the mixers 13*a* to 13*c* mixes two signals inputted thereto and outputs a mixed signal to a corresponding one of the filters 15*a* to 15*c*, like that according to above-mentioned Embodiment 1.

When receiving the mixed signal from a corresponding one of the mixers 13*a* to 13*c*, each of the filters 15*a* to 15*c* prevents the passage of a component having a phase which is the difference between the phases of the two signals and higher-order mixed wave components, which are included in the mixed signal, and passes only a component having a phase which is the sum of the phases of the two signals, which is included in the mixed signal, like that according to above-mentioned Embodiment 1. As a result, the components passing through the filters 15*a* to 15*c* and each having a phase which is the sum of the phases of the two signals are outputted from output terminals 16*a* to 16*c*.

The phases of the signals appearing at the output terminals 16*a* to 16*c* of circuit elements 17*a* to 17*c* are shown by the following equation (11).

$$\text{Output terminal } 16a{:}\ (\omega t+\theta 1)+(\omega t+\theta 1+2\times\theta 2+2\times\theta 3+\theta 4)=2\times(\omega t+\theta 1+\theta 2+\theta 3)+\theta 4$$

$$\text{Output terminal } 16b{:}\ (\omega t+\theta 1+\theta 2)+(\omega t+\theta 1+\theta 2+2\times\theta 3+\theta 4)=2\times(\omega t+\theta 1+\theta 2+\theta 3)+\theta 4$$

$$\text{Output terminal } 16c{:}\ (\omega t+\theta 1+\theta 2+\theta 3)+(\omega t+\theta 1+\theta 2'\theta 2+\theta 3+\theta 4)=2\times(\omega t+\theta 1+\theta 2+\theta 3)+\theta 4 \tag{11}$$

As is clear from the equation (11), all of the phases of the signals appearing at the output terminals 16*a* to 16*c* of the circuit elements 17*a* to 17*c* are equal.

Also in Embodiment 6, as a layout requirement imposed on the in-phase corporate-feed circuit, only a requirement to equalize the electric lengths of the transmission lines between circuit elements 17 is provided, like in the case of above-mentioned Embodiment 1.

Therefore, because it is not necessary to connect plural power dividers in the shape of a binary tree by using transmission lines, unlike in the case of an in-phase corporate-feed circuit having a circuit configuration of tournament type, the in-phase corporate-feed circuit can be formed in a space smaller than that in which an in-phase corporate-feed circuit having a circuit configuration of tournament type is formed, and downsizing of the circuit size can be achieved.

Figure 13:
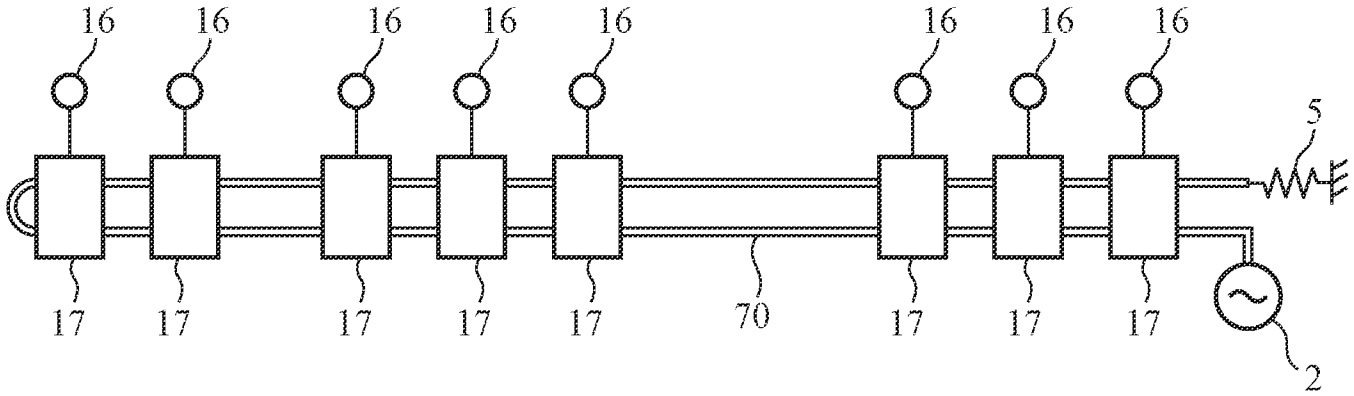
FIG. 13 is an explanatory drawing showing an example of the layout of the in-phase corporate-feed circuit according to Embodiment 6 of the present invention.

FIG. 13 is an explanatory drawing showing an example of the layout of the in-phase corporate-feed circuit according to Embodiment 6 of the present invention.

In the case of above-mentioned Embodiment 1, because the in-phase corporate-feed circuit includes the transmission line 4 and the transmission line 8, and the power divider 3 divides the signal generated by the signal generator 2 into signals to the transmission line 4 and the transmission line 8, it is necessary to route the transmission line 4 and the transmission line 8 up to the two circuit elements 17 arranged at both the ends among the eight circuit elements 17 which are arranged in a straight line, as shown in FIG. 2.

In contrast with this, in the case of Embodiment 6, because what is necessary is to connect the signal generator 2 to the end of the single transmission line 70, the routing length of the transmission line 70 can be shortened. Further, the power divider 3 is unnecessary. Therefore, the circuit size of the in-phase corporate-feed circuit can be reduced to a size smaller than that of the in-phase corporate-feed circuit of Embodiment 1.

Although in Embodiment 6 the transmission line 70*a* connects between the signal generator 2 and the T-branch unit 6*a*, the signal generator 2 and the T-branch unit 6*a* can be connected directly to each other without using the transmission line 70*a*.

Further, although the transmission line 70*d* connects between the T-branch unit 6*c* and the T-branch unit 10*a*, the T-branch unit 6*c* and the T-branch unit 10*a* can be connected directly to each other without using the transmission line 70*d*.

Although in Embodiment 6 the example of using the T-branch units 6*a*, 6*b*, and 6*c* as the first branch circuits, and also using the T-branch units 10*a* to 10*c* as the second branch circuits is shown, directional couplers can be used instead of the T-branch units 6*a* to 6*c* and 10*a* to 10*c*.

For example, in a case of using such directional couplers 21 or 23 as shown in FIG. 4, by bringing each of the output terminals 7*a* to 7*c* and 11*a* to 11*c* of the T-branch units 6*a* to 6*c* and 10*a* to 10*c* into correspondence with a terminal 22*b* of a directional coupler 21 or 23, and connecting a terminal 22*a* to a transmission line on an input side and also connecting a terminal 22*c* to a transmission line on an output side, the same operations as those performed by the T-branch units 6*a* to 6*c* and 10*a* to 10*c* can be implemented.

Although in Embodiment 6 the example of applying the transmission line 70 along which signals propagate bidirectionally to the in-phase corporate-feed circuit in which the amplifiers 18*a*-1 to 18*c*-1 and 18*a*-2 to 18*c*-2, the attenuators 51*a*-1 to 51*c*-1 and 51*a*-2 to 51*c*-2, the amplifiers 52*a*-1 to 52*c*-1 and 53*a*-2 to 53*c*-2, and so on are not mounted is shown, the transmission line 70 along which signals propagate bidirectionally can be applied to such the in-phase corporate-feed circuits as shown in above-mentioned Embodiments 1 to 4 in each of which some of the following components: the amplifiers 18*a*-1 to 18*c*-1 and 18*a*-2 to 18*c*-2, the attenuators 51*a*-1 to 51*c*-1 and 51*a*-2 to 51*c*-2, the amplifiers 52*a*-1 to 52*c*-1 and 53*a*-2 to 53*c*-2, and so on are mounted.

Embodiment 7

Although in above-mentioned Embodiment 6 the example in which the T-branch units 6*a* to 6*c* and 10*a* to 10*c* are inserted onto the transmission line 70 is shown, circulators, instead of the T-branch units 6*a* to 6*c* and 10*a* to 10*c*, can be inserted onto the transmission line 70.

Figure 14:
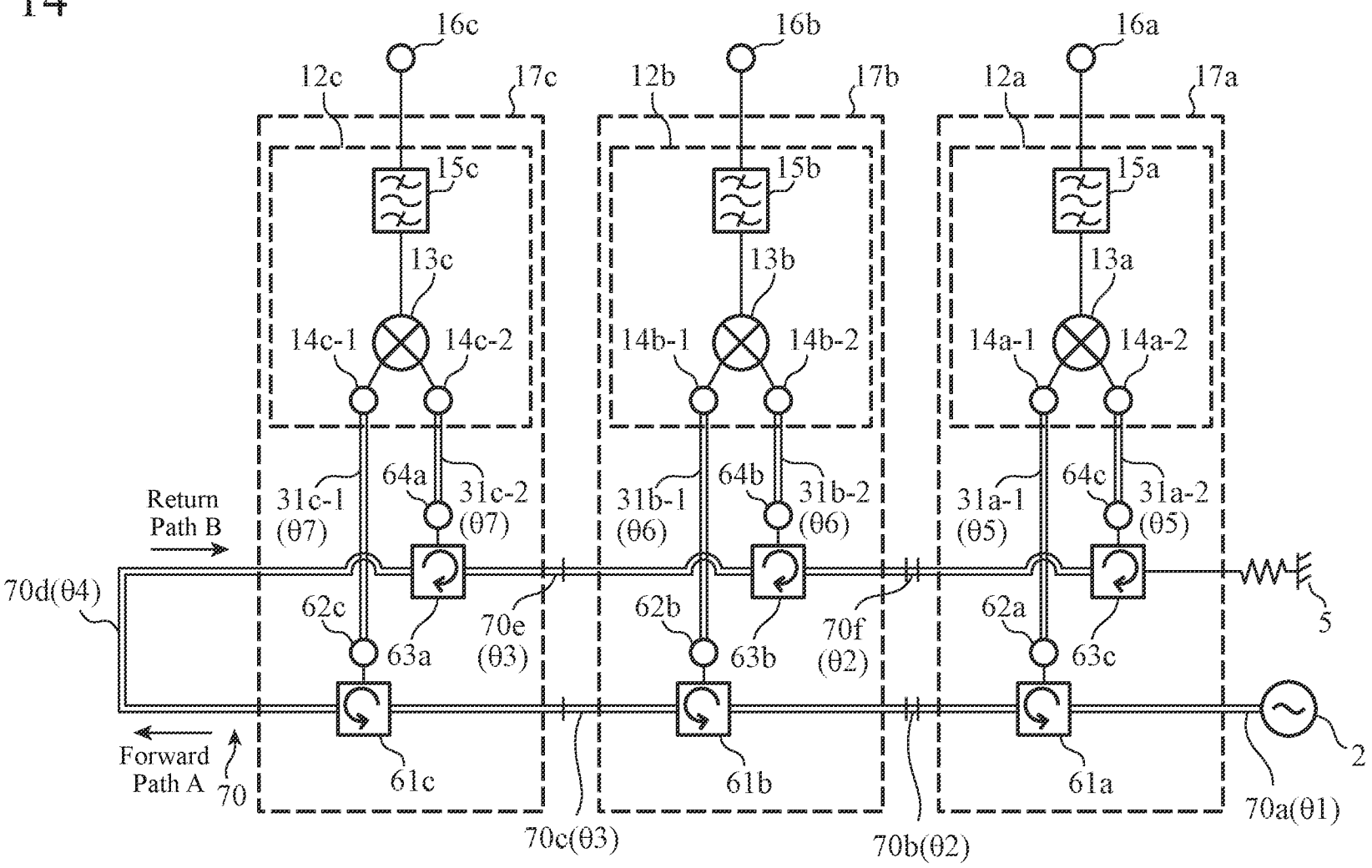
FIG. 14 is a schematic diagram showing an in-phase corporate-feed circuit according to Embodiment 7 of the present invention.

FIG. 14 is a schematic diagram showing an in-phase corporate-feed circuit according to Embodiment 7 of the present invention. In FIG. 14, because the same reference numerals as those shown in FIGS. 10 and 12 denote the same components or like components, the explanation of the components will be omitted hereafter.

In Embodiment 7, it is assumed that the electric length of a transmission line 70*a* at an angular frequency ω is θ1, the electric length of a transmission line 70*b* at the angular frequency ω is θ2, and the electric length of a transmission line 70*c* at the angular frequency ω is θ3, like in the case of above-mentioned Embodiment 6. It is further assumed that the electric length of a transmission line 70*d* at the angular frequency ω is θ4, the electric length of a transmission line 70*e* at the angular frequency ω is θ3, and the electric length of a transmission line 70*f* at the angular frequency ω is θ2.

Further, in Embodiment 7, it is assumed that the electric lengths of transmission lines 31*a*-1 and 31*a*-2 at the angular frequency ω are θ5, the electric lengths of transmission lines 31*b*-1 and 31*b*-2 at the angular frequency ω are θ6, and the electric lengths of transmission lines 31*c*-1 and 31*c*-2 at the angular frequency ω are θ7, like in the case of above-mentioned Embodiment 5.

Next, operations will be explained.

Each of circulators 61*a* to 61*c* and 63*a* to 63*c* has the same terminals 65*a* to 65*c* as those of a circulator shown in FIG. 11.

A signal generator 2 generates a signal and outputs the signal to the transmission line 70*a*.

When the signal outputted from the signal generator 2 is provided for the terminal 65*a*, the circulator 61*a* outputs this signal from the terminal 65*b*. The signal outputted from the terminal 65*b* of the circulator 61*a* is transmitted to an input terminal 14*a*-1 of a mixer 13*a* via an output terminal 62*a* and the transmission line 31*a*-1. However, because the input impedance of the mixer 13*a* is high, the signal which reaches the input terminal 14*a*-1 of the mixer 13*a* is reflected and transmitted to the terminal 65*b* of the circulator 61*a* via the transmission line 31*a*-1 and the output terminal 62*a*.

When the signal reflected by the mixer 13*a* is provided for the terminal 65*b*, the circulator 61*a* outputs this signal from the terminal 65*c*. The signal outputted from the terminal 65*c* is transmitted to the terminal 65*a* of the circulator 61*b* via the transmission line 70*b*.

The circulator 61*b* operates in the same way as the circulator 61*a*, and outputs the signal outputted from the circulator 61*a* to a mixer 13*b* via an output terminal 62*b* and the transmission line 31*b*-1 and, after that, outputs the signal which is reflected by the mixer 13*b* and returns thereto to the circulator 61*c* via the transmission line 70*c*.

The circulator 61*c* operates in the same way as the circulator 61*a*, and outputs the signal outputted from the circulator 61*b* to a mixer 13*c* via an output terminal 62*c* and the transmission line 31*c*-1 and, after that, outputs the signal which is reflected by the mixer 13*c* and returns thereto to the circulator 63*a* via the transmission line 70*d*.

The circulator 63*a* operates in the same way as the circulator 61*a*, and outputs the signal outputted from the circulator 61*c* to the mixer 13*c* via an output terminal 64*a* and the transmission line 31*c*-2 and, after that, outputs the signal which is reflected by the mixer 13*c* and returns thereto to the circulator 63*b* via the transmission line 70*e*.

The circulator 63*b* operates in the same way as the circulator 61*a*, and outputs the signal outputted from the circulator 63*a* to the mixer 13*b* via an output terminal 64*b* and the transmission line 31*b*-2 and, after that, outputs the signal which is reflected by the mixer 13*b* and returns thereto to the circulator 63*c* via the transmission line 70*f*.

The circulator 63*c* operates in the same way as the circulator 61*a*, and outputs the signal outputted from the circulator 63*b* to the mixer 13*a* via an output terminal 64*c* and the transmission line 31*a*-2 and, after that, outputs the signal which is reflected by the mixer 13*a* and returns thereto to a terminator 5.

The phases of the signals appearing at the input terminals 14*a*-1, 14*b*-1, 14*c*-1, 14*a*-2, 14*b*-2, and 14*c*-2 of the mixers 13*a* to 13*c* are shown by the following equation (12), and all of the phases of these signals differ from one another.

Input terminal 14*a*-1: $\omega t+\theta 1+\theta 5$

Input terminal 14*b*-1: $\omega t+\theta 1+2\times\theta 5+\theta 2+\theta 6$

Input terminal 14*c*-1: $\omega t+\theta 1+2\times\theta 5+\theta 2+2\times\theta 6+\theta 3+\theta 7$ Input terminal 14*a*-2: $\omega t+\theta 1+3\times\theta 5+2\times\theta 2+4\times\theta 6+2\times\theta 3+4\times\theta 7+\theta 4$ Input terminal 14*b*-2: $\omega t+\theta 1+2\times\theta 5+\theta 2+3\times\theta 6+2\times\theta 3+4\times\theta 7+\theta 4$ Input terminal 14*c*-2: $\omega t+\theta 1+2\times\theta 5+\theta 2+2\times\theta 6+\theta 3+3\times\theta 7+\theta 4$ (12)

Each of the mixers 13*a* to 13*c* mixes two signals inputted thereto and outputs a mixed signal to a corresponding one of filters 15*a* to 15*c*, like that according to above-mentioned Embodiment 1.

When receiving the mixed signal from a corresponding one of the mixers 13*a* to 13*c*, each of the filters 15*a* to 15*c* prevents the passage of a component having a phase which is the difference between the phases of the two signals and higher-order mixed wave components, which are included in the mixed signal, and passes only a component having a phase which is the sum of the phases of the two signals, which is included in the mixed signal, like that according to above-mentioned Embodiment 1. As a result, the components passing through the filters 15*a* to 15*c* and each having a phase which is the sum of the phases of the two signals are outputted from output terminals 16*a* to 16*c*.

The phases of the signals appearing at the output terminals 16*a* to 16*c* of circuit elements 17*a* to 17*c* are shown by the following equation (13).

Output terminal 16*a*: $(\omega t+\theta 1+\theta 5)+(\omega t+\theta 1+3\times\theta 5+2\times\theta 2+4\times\theta 6+2\times\theta 3+4\times\theta 7+\theta 4)=2\times(\omega t+\theta 1+\theta 2+\theta 3)+\theta 4+4\times(\theta 5+\theta 6+\theta 7)$ Output terminal 16*b*: $(\omega t+\theta 1+2\times\theta 5+\theta 2+\theta 6)+(\omega t+\theta 1+2\times\theta 5+\theta 2+3\times\theta 6+2\times\theta 3+4\times\theta 7+\theta 4)=2\times(\omega t+\theta 1+\theta 2+\theta 3)+\theta 4'4\times(\theta 5+\theta 6+\theta 7)$ Output terminal 16*c*: $(\omega t+\theta 1+2\times\theta 5+\theta 2+2\times\theta 6+\theta 3+\theta 7)+(\omega t+\theta 1+2\times\theta 5+\theta 2+2\times\theta 6+\theta 3+3\times\theta 7+\theta 4)=2\times(\omega t+\theta 1+\theta 2+\theta 3)+\theta 4'4\times(\theta 5+\theta 6+\theta 7)$ (13)

As is clear from the equation (13), all of the phases of the signals appearing at the output terminals 16*a* to 16*c* of the circuit elements 17*a* to 17*c* are equal.

In Embodiment 7, as layout requirements imposed on the in-phase corporate-feed circuit, only a requirement to equalize the electric lengths of the transmission lines between circuit elements 17, and a requirement to equalize the electric lengths of the transmission lines 31*a*-1 and 31*a*-2, equalize the electric lengths of the transmission lines 31*b*-1 and 31*b*-2, and equalize the electric lengths of the transmission lines 31*c*-1 and 31*c*-2 are provided.

Therefore, because it is not necessary to connect plural power dividers in the shape of a binary tree by using transmission lines, unlike in the case of an in-phase corporate-feed circuit having a circuit configuration of tournament type, the in-phase corporate-feed circuit can be formed in a space smaller than that in which an in-phase corporate-feed circuit having a circuit configuration of tournament type is formed, and downsizing of the circuit size can be achieved.

Embodiment 8

Although in above-mentioned Embodiments 1 to 5 the example in which the in-phase corporate-feed circuit includes the two transmission lines 4 and 8 which are physically different is shown, the in-phase corporate-feed circuit can be configured to include a single transmission line along which signals propagate bidirectionally.

Figure 15:
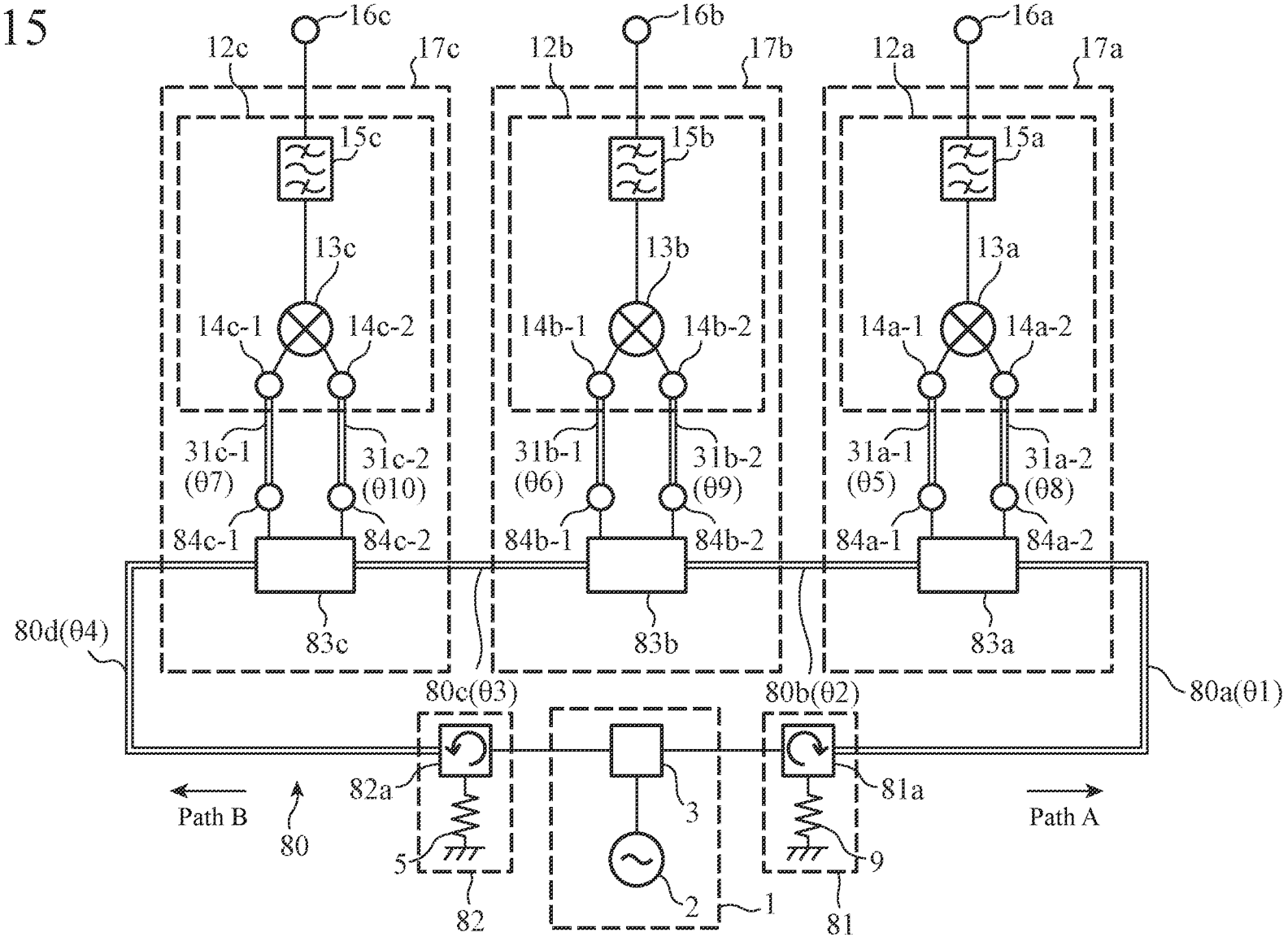
FIG. 15 is a schematic diagram showing an in-phase corporate-feed circuit according to Embodiment 8 of the present invention.

FIG. 15 is a schematic diagram showing an in-phase corporate-feed circuit according to Embodiment 8 of the present invention. In FIG. 15, because the same reference numerals as those shown in FIGS. 1 and 5 denote the same components or like components, the explanation of the components will be omitted hereafter.

A transmission line 80 consists of, for example, a coaxial cable, a waveguide, a microstrip line formed on a printed circuit board, or the like. The transmission line 80 is one along which signals propagate bidirectionally, and has an end connected to a circulator 81*a* and another end connected to a circulator 82*a*.

Directional couplers 83*a*, 83*b*, and 83*c* are inserted at points of the transmission line 80, a path through which a signal flows in a first direction, i.e., a path through which a signal flows from the circulator 81*a* toward the directional coupler 83*a*→ the directional coupler 83*b*→ the directional coupler 83*c*→ the circulator 82*a* is referred to as a path A, and a path through which a signal flows in a second direction, i.e., a path through which a signal flows from the circulator 82*a* toward the directional coupler 83*c*→ the directional coupler 83*b*→ the directional coupler 83*a*→ the circulator 81*a* is referred to as a path B.

Hereafter, a transmission line between the circulator 81*a* and the directional coupler 83*a* is denoted by 80*a*, a transmission line between the directional coupler 83*a* and the directional coupler 83*b* is denoted by 80*b*, a transmission line between the directional coupler 83*b* and the directional coupler 83*c* is denoted by 80*c*, and a transmission line between the directional coupler 83*c* and the circulator 82*a* is denoted by 80*d*. Thus, the transmission line 80 includes the transmission lines 80*a*, 80*b*, 80*c*, and 80*d*. It is desirable that all of the characteristic impedances of the transmission lines 80*a*, 80*b*, 80*c*, and 80*d* are equal.

An isolator 81 is a first isolator that includes the circulator 81*a* and a terminator 9, and that outputs one of signals after division by a power divider 3 to an end of the transmission line 80*a* and also blocks the transmission of a signal outputted from the end of the transmission line 80*a*.

The circulator 81*a* outputs the one of the signals after division by the power divider 3 to the end of the transmission line 80*a*, and also outputs the signal outputted from the end of the transmission line 80*a* to the terminator 9.

The circulator 81*a* has three terminals 65*a*, 65*b*, and 65*c*, as shown in FIG. 11, and the terminal 65*a* of the circulator 81*a* is connected to the power divider 3, the terminal 65*b* of the circulator is connected to the end of the transmission line 80*a*, and the terminal 65*c* of the circulator is connected to the terminator 9. As a result, because the signal on the path B which is outputted from the power divider 3 is terminated by the terminator 9, no signal is reflected by the end of the transmission line 80*a* and flows backward toward the power divider 3.

An isolator 82 is a second isolator that includes the circulator 82*a* and a terminator 5, and that outputs the other one of the signals after division by the power divider 3 to another end of the transmission line 80*d* and also blocks the transmission of a signal outputted from the other end of the transmission line 80*d*.

The circulator 82*a* outputs the other one of the signals after division by the power divider 3 to the other end of the transmission line 80*d*, and also outputs the signal outputted from the other end of the transmission line 80*d* to the terminator 5. The circulator 82*a* has three terminals 65*a*, 65*b*, and 65*c*, as shown in FIG. 11, and the terminal 65*a* of the circulator 82*a* is connected to the power divider 3, the terminal 65*b* of the circulator is connected to the other end of the transmission line 80*d*, and the terminal 65*c* of the circulator is connected to the terminator 5. As a result, because the signal on the path A which is outputted from the power divider 3 is terminated by the terminator 5, no signal is reflected by the other end of the transmission line 80*d* and flows backward toward the power divider 3.

Although in FIG. 15 the example in which the power divider 3 and the circulators 81*a* and 82*a* are connected directly to each other is shown, transmission lines can be connected between the power divider 3 and the circulators 81*a* and 82*a*.

The directional coupler 83*a* outputs a part of the signal on the path A which is outputted from the power divider 3 to an output terminal 84*a*-1 (first terminal), and outputs a part of the signal on the path B which is outputted from the power divider 3 to an output terminal 84*a*-2 (second terminal).

The directional coupler 83*a* has four terminals, as shown in FIG. 4A, and the terminal 22*a* is connected to another end of the transmission line 80*a*, the terminal 22*b* is connected to the output terminal 84*a*-1, the terminal 22*c* is connected to an end of the transmission line 80*b*, and the terminal 22*d* is connected to the output terminal 84*a*-2.

The directional coupler 83*b* outputs a part of the signal on the path A which is outputted from the power divider 3 to an output terminal 84*b*-1 (first terminal), and outputs a part of the signal on the path B which is outputted from the power divider 3 to an output terminal 84*b*-2 (second terminal).

The directional coupler 83*b* has four terminals, as shown in FIG. 4A, and the terminal 22*a* is connected to another end of the transmission line 80*b*, the terminal 22*b* is connected to the output terminal 84*b*-1, the terminal 22*c* is connected to an end of the transmission line 80*c*, and the terminal 22*d* is connected to the output terminal 84*b*-2.

The directional coupler 83*c* outputs a part of the signal on the path A which is outputted from the power divider 3 to an output terminal 84*c*-1 (first terminal), and outputs a part of the signal on the path B which is outputted from the power divider 3 to an output terminal 84*c*-2 (second terminal).

The directional coupler 83*c* has four terminals, as shown in FIG. 4A, and the terminal 22*a* is connected to another end of the transmission line 80*c*, the terminal 22*b* is connected to the output terminal 84*c*-1, the terminal 22*c* is connected to an end of the transmission line 80*d*, and the terminal 22*d* is connected to the output terminal 84*c*-2.

The directional couplers 83*a*, 83*b*, and 83*c* construct branch circuits.

Next, operations will be explained.

In Embodiment 8, it is assumed that the electric lengths of the transmission lines 80*a*, 80*b*, 80*c*, and 80*d* and the electric lengths of transmission lines 31*a*-1, 31*b*-1, 31*c*-1, 31*a*-2, 31*b*-2, and 31*c*-2 are as follows.

The electric length of the transmission line 80*a* at an angular frequency $\omega=\theta 1$ The electric length of the transmission line 80*b* at the angular frequency $\omega=\theta 2$ The electric length of the transmission line 80*c* at the angular frequency $\omega=\theta 3$ The electric length of the transmission line 80*d* at the angular frequency $\omega=\theta 4$ The electric length of the transmission line 31*a*-1 at the angular frequency $\omega=\theta 5$ The electric length of the transmission line 31*b*-1 at the angular frequency $\omega=\theta 6$ The electric length of the transmission line 31*c*-1 at the angular frequency $\omega=\theta 7$ The electric length of the transmission line 31*a*-2 at the angular frequency $\omega=\theta 8$ The electric length of the transmission line 31*b*-2 at the angular frequency $\omega=\theta 9$ The electric length of the transmission line 31*c*-2 at the angular frequency $\omega=\theta 10$ It is further assumed that a relationship shown by the equation (3) is established among the electric lengths $\theta 5$, $\theta 6$, $\theta 7$, $\theta 8$, $\theta 9$, and $\theta 10$ of the transmission lines 31*a*-1, 31*b*-1, 31*c*-1, 31*a*-2, 31*b*-2, and 31*c*-2, like in the case of above-mentioned Embodiment 2.

More specifically, there is a relationship in which the sum ($\theta 5+\theta 8$) of the electric lengths of the transmission lines 31*a*-1 and 31*a*-2, the sum ($\theta 6+\theta 9$) of the electric lengths of the transmission lines 31*b*-1 and 31*b*-2, and the sum ($\theta 7+\theta 10$) of the electric lengths of the transmission lines 31*c*-1 and 31*c*-2 are all $\alpha$ and equal.

When a signal generator 2 generates a signal, the power divider 3 of a signal generating circuit 1 divides the power of the signal into two parts and outputs signals in phase to the circulator 81*a* and the circulator 82*a*.

When receiving the signal from the power divider 3, the circulator 81*a* outputs the signal to the end of the transmission line 80*a*. As a result, the signal outputted from the power divider 3 is transmitted to the transmission line 80 as a signal on the path A.

When receiving the signal from the power divider 3, the circulator 82*a* outputs the signal to the other end of the transmission line 80*d*. As a result, the signal outputted from the power divider 3 is transmitted to the transmission line 80 as a signal on the path B.

When a signal on the path A which flows through the transmission line 80*a* is inputted, the directional coupler 83*a* outputs a part of the signal to the transmission line 80*b*, and also outputs the remaining part of the signal to an input terminal 14*a*-1 of a mixer 13*a* via the output terminal 84*a*-1 and the transmission line 31*a*-1.

Further, when a signal on the path B which flows through the transmission line 80*b* is inputted, the directional coupler 83*a* outputs a part of the signal to the transmission line 80*a*, and also outputs the remaining signal to an input terminal 14*a*-2 of the mixer 13*a* via the output terminal 84*a*-2 and the transmission line 31*a*-2.

When a signal on the path A which flows through the transmission line 80*b* is inputted, the directional coupler 83*b* outputs a part of the signal to the transmission line 80*c*, and also outputs the remaining signal to an input terminal 14*b*-1 of a mixer 13*b* via the output terminal 84*b*-1 and the transmission line 31*b*-1.

Further, when a signal on the path B which flows through the transmission line 80*c* is inputted, the directional coupler

83*b* outputs a part of the signal to the transmission line 80*b*, and also outputs the remaining signal to an input terminal 14*b*-2 of the mixer 13*b* via the output terminal 84*b*-2 and the transmission line 31*b*-2.

When a signal on the path A which flows through the transmission line 80*c* is inputted, the directional coupler 83*c* outputs a part of the signal to the transmission line 80*d*, and also outputs the remaining signal to an input terminal 14*c*-1 of a mixer 13*c* via the output terminal 84*c*-1 and the transmission line 31*c*-1.

Further, when a signal on the path B which flows through the transmission line 80*d* is inputted, the directional coupler 83*c* outputs a part of the signal to the transmission line 80*c*, and also outputs the remaining signal to an input terminal 14*c*-2 of the mixer 13*c* via the output terminal 84*c*-2 and the transmission line 31*c*-2.

Because the signal on the path A which is outputted from the directional coupler 83*c* to the transmission line 80*d* is outputted to the terminator 5 via the circulator 82*a*, the signal is terminated by the terminator 5.

Further, because the signal on the path B which is outputted from the directional coupler 83*a* to the transmission line 80*a* is outputted to the terminator 9 via the circulator 81*a*, the signal is terminated by the terminator 9.

The phases of the signals appearing at the output terminals 84*a*-1, 84*b*-1, 84*c*-1, 84*a*-2, 84*b*-2, and 84*c*-2 of the directional couplers 83*a*, 83*b*, and 83*c* are shown by the following equation (14), and all of the phases of these signals differ from one another.

$$\text{Output terminal } 84a\text{-}1{:}\ \omega t+\theta 1$$

$$\text{Output terminal } 84b\text{-}1{:}\ \omega t+\theta 1+\theta 2$$

$$\text{Output terminal } 84c\text{-}1{:}\ \omega t\theta 1+\theta 2+\theta 3$$

$$\text{Output terminal } 84a\text{-}2{:}\ \omega t+\theta 4+\theta 3+\theta 2$$

$$\text{Output terminal } 84b\text{-}2{:}\ \omega t+\theta 4+\theta 3$$

$$\text{Output terminal } 84c\text{-}2{:}\ \omega t+\theta 4 \tag{14}$$

Each of the mixers 13*a* to 13*c* mixes two signals inputted thereto and outputs a mixed signal to a corresponding one of filters 15*a* to 15*c*, like that according to above-mentioned Embodiment 1.

When receiving the mixed signal from a corresponding one of the mixers 13*a* to 13*c*, each of the filters 15*a* to 15*c* prevents the passage of a component having a phase which is the difference between the phases of the two signals and higher-order mixed wave components, which are included in the mixed signal, and passes only a component having a phase which is the sum of the phases of the two signals, which is included in the mixed signal, like that according to above-mentioned Embodiment 1. As a result, the components passing through the filters 15*a* to 15*c* and each having a phase which is the sum of the phases of the two signals are outputted from output terminals 16*a* to 16*c*.

In consideration of the electric lengths of the transmission lines 31*a*-1 to 31*c*-1 and 31*a*-2 to 31*c*-2, the phases of the signals appearing at the output terminals 16*a* to 16*c* of circuit elements 17*a* to 17*c* are shown by the following equation (15).

$$\text{Output terminal } 16a{:}\ (\omega t+\theta 1+\theta 5)+(\omega t+\theta 4+\theta 3+\theta 2+\theta 8)=2\ \omega t+\theta 1+\theta 2+\theta 3+\theta 4+\theta 5+\theta 8$$

$$\text{Output terminal } 16b{:}\ (\omega t+\theta 1+\theta 2+\theta 6)+(\omega t+\theta 4+\theta 3+\theta 9)=2\ \omega t+\theta 1+\theta 2+\theta 3+\theta 4+\theta 6+\theta 9$$

$$\text{Output terminal } 16c{:}\ (\omega t+\theta 1+\theta 2+\theta 3+\theta 7)+(\omega t+\theta 4+\theta 10)=2\ \omega t+\theta 1+\theta 2+\theta 3+\theta 4+\theta 7+\theta 10 \tag{15}$$

In Embodiment 8, because $\theta 5+\theta 8=\theta 6+\theta 9=\theta 7+\theta 10=\alpha$, all of the phases of the signals appearing at the output terminals 16*a* to 16*c* of the circuit elements 17*a* to 17*c* are shown by the following equation (16), and equal.

$$2\omega t+\theta 1+\theta 2+\theta 3+\theta 4+\alpha \tag{16}$$

In above-mentioned Embodiments 1 to 5, the in-phase corporate-feed circuit needs to include the two transmission lines 4 and 8 which are physically different, and it is necessary to connect between the circuit elements 17 by using equal-length transmission lines. Therefore, when a variation occurs between the electric lengths of the transmission lines each connecting between circuit elements 17, there is a case in which the phases of the signals appearing at the output terminals 16*a* to 16*c* are not equal.

In contrast with this, in Embodiment 8, because the electric lengths of the transmission lines 80*b* and 80*c* each connecting between circuit elements 17 are certainly equal regardless of the directions of the paths A and B, there is provided an advantage of eliminating the necessity to take into consideration a variation in the electric lengths of the transmission lines.

Further, because the configuration in Embodiment 8 can use the single transmission line 80, there is provided an advantage of being able to reduce the number of transmission lines.

By connecting the output terminals 84*a*-1 to 84*c*-1 and 84*a*-2 to 84*c*-2 of the directional couplers 83*a* to 83*c* directly to the input terminals 14*a*-1 to 14*c*-1 and 14*a*-2 to 14*c*-2 of the mixers 13*a* to 13*c*, thereby removing the transmission lines 31*a*-1 to 31*c*-1 and 31*a*-2 to 31*c*-2, there is also provided an advantage of eliminating the necessity to take into consideration a variation in the electric lengths of the transmission lines 31*a*-1 to 31*c*-1 and 31*a*-2 to 31*c*-2.

Figure 16:
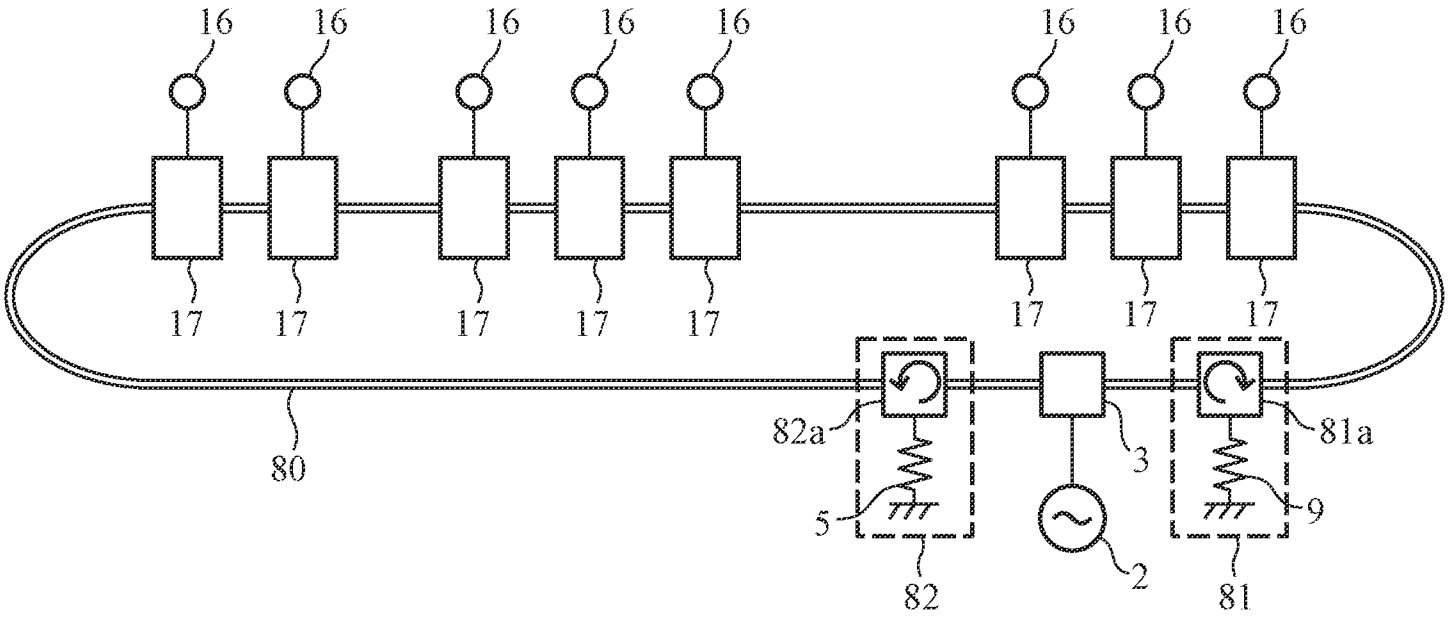
FIG. 16 is an explanatory drawing showing an example of the layout of the in-phase corporate-feed circuit according to Embodiment 8 of the present invention.

FIG. 16 is an explanatory drawing showing an example of the layout of the in-phase corporate-feed circuit according to Embodiment 8 of the present invention.

In Embodiment 8, because the layout requirement imposed on the in-phase corporate-feed circuit is eased, like in the case of above-mentioned Embodiments 1 to 7, the plural circuit elements 17 can be arranged in a straight line, as shown in FIG. 16. Therefore, it is not necessary to ensure a large space in two dimensions.

Embodiment 9

Although in above-mentioned Embodiment 8 the example in which the directional couplers 83*a*, 83*b*, and 83*c* are inserted at points of the transmission line 80 is shown, circulators can be alternatively inserted at points of the transmission line 80.

Figure 17:
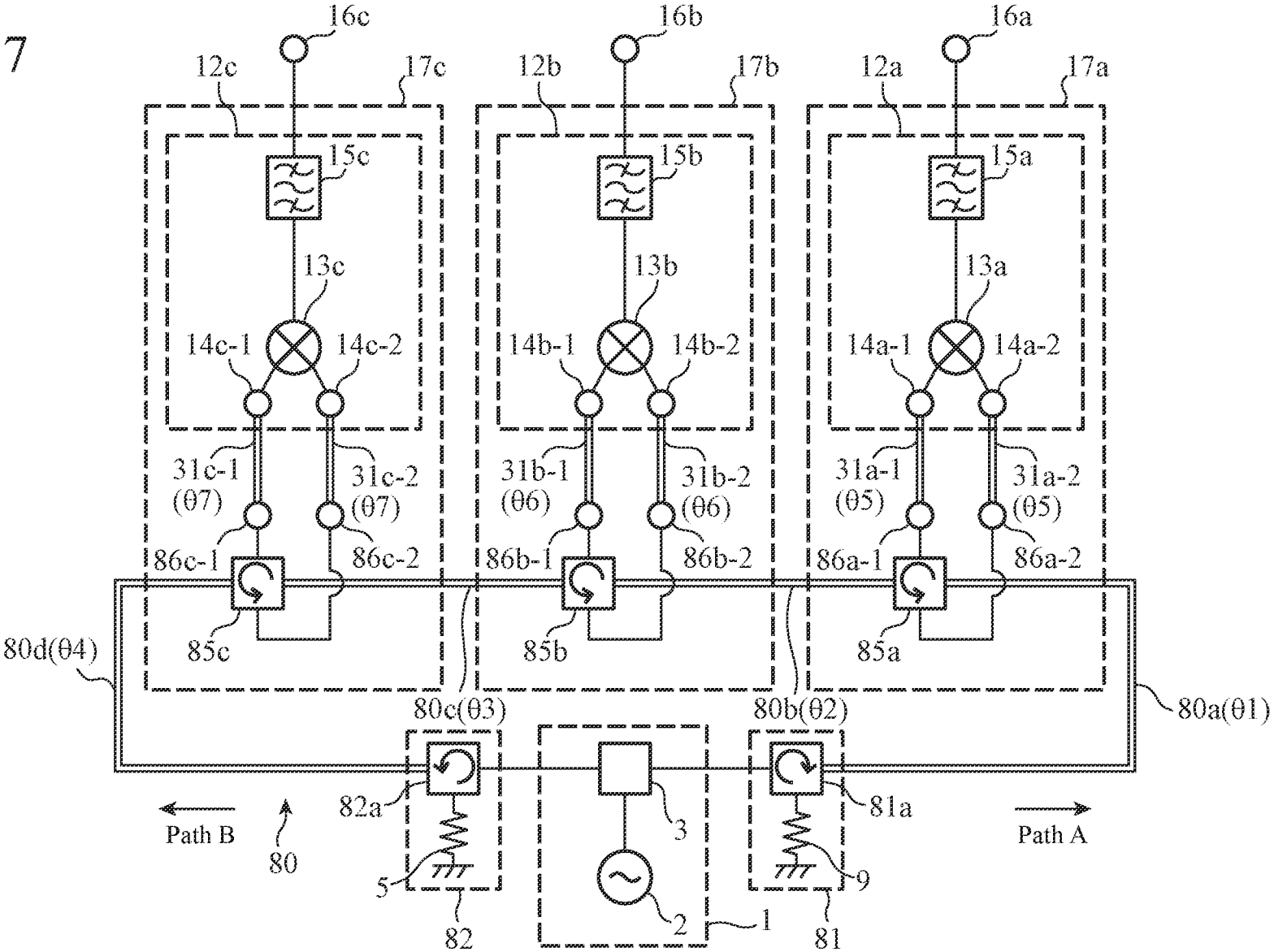
FIG. 17 is a schematic diagram showing an in-phase corporate-feed circuit according to Embodiment 9 of the present invention.

FIG. 17 is a schematic diagram showing an in-phase corporate-feed circuit according to Embodiment 9 of the present invention. In FIG. 17, because the same reference numerals as those shown in FIG. 15 denote the same components or like components, the explanation of the components will be omitted hereafter.

A circulator 85*a* outputs a signal on a path A which is outputted from a power divider 3 to an output terminal 86*a*-1 (first terminal), and, after that, outputs a signal which is reflected by an input terminal 14*a*-1 of a mixer 13*a* and returns to the output terminal 86*a*-1 to a transmission line 80*b* as a signal on the path A.

Further, the circulator 85*a* outputs a signal on a path B which is outputted from a circulator 85*b* to an output terminal 86*a*-2 (second terminal), and, after that, outputs a signal which is reflected by an input terminal 14*a*-2 of the mixer 13*a* and returns to the output terminal 86*a*-2 to a transmission line 80*a* as a signal on the path B.

The circulator 85*b* outputs the signal on the path A which is outputted from the circulator 85*a* to an output terminal 86*b*-1 (first terminal), and, after that, outputs a signal which is reflected by an input terminal 14*b*-1 of a mixer 13*b* and returns to the output terminal 86*b*-1 to a transmission line 80*c* as a signal on the path A.

Further, the circulator 85*b* outputs a signal on the path B which is outputted from a circulator 85*c* to an output terminal 86*b*-2 (second terminal), and, after that, outputs a signal which is reflected by an input terminal 14*b*-2 of the mixer 13*b* and returns to the output terminal 86*b*-2 to the transmission line 80*b* as a signal on the path B.

The circulator 85*c* outputs the signal on the path A which is outputted from the circulator 85*b* to an output terminal 86*c*-1 (first terminal), and, after that, outputs a signal which is reflected by an input terminal 14*c*-1 of a mixer 13*c* and returns to the output terminal 86*c*-1 to a transmission line 80*d* as a signal on the path A.

Further, the circulator 85*c* outputs a signal on the path B which is outputted from the power divider 3 to an output terminal 86*c*-2 (second terminal), and, after that, outputs a signal which is reflected by an input terminal 14*c*-2 of the mixer 13*c* and returns to the output terminal 86*c*-2 to the transmission line 80*c* as a signal on the path B.

The circulators 85*a*, 85*b*, and 85*c* construct branch circuits.

FIG. 18 is an explanatory drawing showing each circulator 85.

Figure 18A:
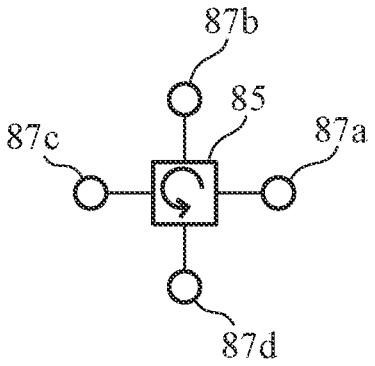
FIG. 18A is an explanatory drawing showing a circulator 85 having four terminals.
Figure 18B:
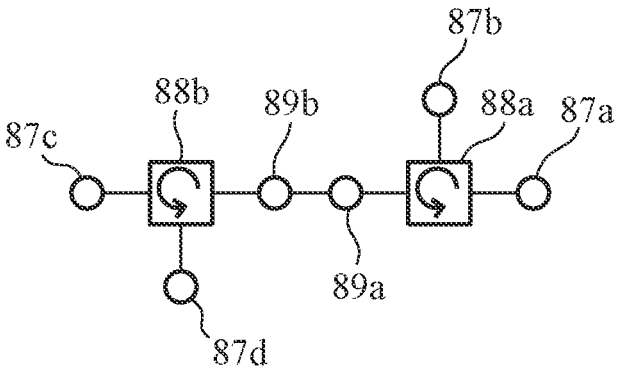
FIG. 18B is an explanatory drawing showing a circulator 85 which consists of two circulators.

FIG. 18A is an explanatory drawing showing each circulator 85 having four terminals, and FIG. 18B is an explanatory drawing showing each circulator 85 comprised of two circulators each having three terminals.

In the case of having four terminals 87*a* to 87*d*, as shown in FIG. 18A, each circulator 85 outputs a signal inputted from the terminal 87*a* from the terminal 87*b*, and outputs a signal inputted from the terminal 87*b* from the terminal 87*c*.

Further, a signal inputted from the terminal 87*c* is outputted from the terminal 87*d*, and a signal inputted from the terminal 87*d* is outputted from the terminal 87*a*.

Therefore, in the case in which the circulator 85*a* is configured as shown in FIG. 18A, the terminal 87*a* of the circulator 85*a* is connected to the transmission line 80*a*, the terminal 87*b* of the circulator is connected to the output terminal 86*a*-1, the terminal 87*c* of the circulator is connected to the transmission line 80*b*, and the terminal 87*d* of the circulator is connected to the output terminal 86*a*-2.

Further, in the case in which the circulator 85*b* is configured as shown in FIG. 18A, the terminal 87*a* of the circulator 85*b* is connected to the transmission line 80*b*, the terminal 87*b* of the circulator is connected to the output terminal 86*b*-1, the terminal 87*c* of the circulator is connected to the transmission line 80*c*, and the terminal 87*d* of the circulator is connected to the output terminal 86*b*-2.

Further, in the case in which the circulator 85*c* is configured as shown in FIG. 18A, the terminal 87*a* of the circulator 85*c* is connected to the transmission line 80*c*, the terminal 87*b* of the circulator is connected to the output terminal 86*c*-1, the terminal 87*c* of the circulator is connected to the transmission line 80*d*, and the terminal 87*d* of the circulator is connected to the output terminal 86*c*-2.

Although, as illustrated in FIG. 17, as if the length between the circulator 85*a* (85*b* or 85*c*) and the output terminal 86*a*-1 (86*b*-1 or 86*c*-1) differs from the length between the circulator 85*a* (85*b* or 80*c*) and the output terminal 86*a*-2 (86*b*-2 or 86*c*-2), no difference occurs between the lengths because the terminal 87*b* of the circulator 85*a* (85*b* or 85*c*) is connected directly to the output terminal 86*a*-1 (86*b*-1 or 86*c*-1) and the terminal 87*d* of the circulator 85*a* (85*b* or 85*c*) is connected directly to the output terminal 86*a*-2 (86*b*-2 or 86*c*-2).

Each of the circulators 85*a*, 85*b*, and 85*c* can be alternatively comprised of two circulators 88*a* and 88*b* each having three terminals as shown in FIG. 18B.

In this case, a signal inputted from the terminal 87*a* of the circulator 88*a* is outputted from the terminal 87*b*, and a signal inputted from the terminal 87*b* is outputted from the terminal 89*a*. A signal outputted from the terminal 89*a* of the circulator 88*a* is inputted from the terminal 89*b* of the circulator 88*b*. A signal inputted from the terminal 89*b* of the circulator 88*a* is outputted from the terminal 87*c*.

Further, a signal inputted from the terminal 87*c* of the circulator 88*b* is outputted from the terminal 87*d*, and a signal inputted from the terminal 87*d* is outputted from the terminal 89*b*. A signal outputted from the terminal 89*b* of the circulator 88*b* is inputted from the terminal 89*a* of the circulator 88*a*. A signal inputted from the terminal 89*a* of the circulator 88*a* is outputted from the terminal 87*a*.

Next, operations will be explained.

In Embodiment 9, it is assumed that the electric lengths of transmission lines 31*a*-1 to 31*c*-1 and 31*a*-2 to 31*c*-2 are as follows, like in the case of above-mentioned Embodiment 5.

The electric length of the transmission line 31*a*-1 at an angular frequency $\omega=\theta 5$ The electric length of the transmission line 31*b*-1 at the angular frequency $\omega=\theta 6$ The electric length of the transmission line 31*c*-1 at the angular frequency $\omega=\theta 7$ The electric length of the transmission line 31*a*-2 at the angular frequency $\omega=\theta 5$ The electric length of the transmission line 31*b*-2 at the angular frequency $\omega=\theta 6$ The electric length of the transmission line 31*c*-2 at the angular frequency $\omega=\theta 7$ Thus, there is a relationship in which the electric lengths of the transmission lines 31*a*-1 and 31*a*-2 are $\theta 5$ and equal, the electric lengths of the transmission lines 31*b*-1 and 31*b*-2 are $\theta 6$ and equal, and the electric lengths of the transmission lines 31*c*-1 and 31*c*-2 are $\theta 7$ and equal.

When a signal generator 2 generates a signal, the power divider 3 of a signal generating circuit 1 divides the power of the signal into two parts and outputs signals in phase to the circulator 81*a* and the circulator 82*a*.

When receiving the signal from the power divider 3, the circulator 81*a* outputs the signal to an end of the transmission line 80*a*. As a result, the signal outputted from the power divider 3 is transmitted via the transmission line 80 as a signal on the path A.

When receiving the signal from the power divider 3, the circulator 82*a* outputs the signal to another end of the transmission line 80*d*. As a result, the signal outputted from the power divider 3 is transmitted via the transmission line 80 as a signal on the path B.

When receiving the signal on the path A which is outputted from the power divider 3, the circulator 85*a* outputs the signal to the output terminal 86*a*-1.

At this time, because the input impedance of the mixer 13*a* is high, the signal outputted from the output terminal 86*a*-1 of the circulator 85*a* and inputted to the input terminal 14*a*-1 of the mixer 13*a* is reflected.

As a result, the signal reflected by the mixer 13*a* returns to the output terminal 86*a*-1 of the circulator 85*a*.

The circulator 85*a* outputs the signal which returns to the output terminal 86*a*-1 to the transmission line 80*b* as a signal on the path A.

Further, when receiving the signal on the path B which is outputted from the circulator 85*b*, the circulator 85*a* outputs the signal to the output terminal 86*a*-2.

At this time, because the input impedance of the mixer 13*a* is high, the signal outputted from the output terminal 86*a*-2 of the circulator 85*a* and inputted to the input terminal 14*a*-2 of the mixer 13*a* is reflected.

As a result, the signal reflected by the mixer 13*a* returns to the output terminal 86*a*-2 of the circulator 85*a*.

The circulator 85*a* outputs the signal which returns to the output terminal 86*a*-2 to the transmission line 80*a* as a signal on the path B. The signal on the path B which is outputted to the transmission line 80*a* is outputted to a terminator 9 by the circulator 81*a*, and is terminated by the terminator 9.

When receiving the signal on the path A which is outputted from the circulator 85*a*, the circulator 85*b* outputs the signal to the output terminal 86*b*-1.

At this time, because the input impedance of the mixer 13*b* is high, the signal outputted from the output terminal 86*b*-1 of the circulator 85*b* and inputted to the input terminal 14*b*-1 of the mixer 13*b* is reflected.

As a result, the signal reflected by the mixer 13*b* returns to the output terminal 86*b*-1 of the circulator 85*b*.

The circulator 85*b* outputs the signal which returns to the output terminal 86*b*-1 to the transmission line 80*c* as a signal on the path A.

Further, when receiving the signal on the path B which is outputted from the circulator 85*c*, the circulator 85*b* outputs the signal to the output terminal 86*b*-2.

At this time, because the input impedance of the mixer 13*b* is high, the signal outputted from the output terminal 86*b*-2 of the circulator 85*b* and inputted to the input terminal 14*b*-2 of the mixer 13*b* is reflected.

As a result, the signal reflected by the mixer 13*b* returns to the output terminal 86*b*-2 of the circulator 85*b*.

The circulator 85*b* outputs the signal which returns to the output terminal 86*b*-2 to the transmission line 80*b* as a signal on the path B.

When receiving the signal on the path A which is outputted from the circulator 85*b*, the circulator 85*c* outputs the signal to the output terminal 86*c*-1.

At this time, because the input impedance of the mixer 13*c* is high, the signal outputted from the output terminal 86*c*-1 of the circulator 85*c* and inputted to the input terminal 14*c*-1 of the mixer 13*c* is reflected.

As a result, the signal reflected by the mixer 13*c* returns to the output terminal 86*c*-1 of the circulator 85*c*.

The circulator 85*c* outputs the signal which returns to the output terminal 86*c*-1 to the transmission line 80*d* as a signal on the path A. The signal on the path A which is outputted to the transmission line 80*d* is outputted to a terminator 5 by the circulator 82*a*, and is terminated by the terminator 5.

Further, when receiving the signal on the path B which is outputted from the power divider 3, the circulator 85*c* outputs the signal to the output terminal 86*c*-2.

At this time, because the input impedance of the mixer 13*c* is high, the signal outputted from the output terminal 86*c*-2 of the circulator 85*c* and inputted to the input terminal 14*c*-2 of the mixer 13*c* is reflected.

As a result, the signal reflected by the mixer 13*c* returns to the output terminal 86*c*-2 of the circulator 85*c*.

The circulator 85*c* outputs the signal which returns to the output terminal 86*c*-2 to the transmission line 80*c* as a signal on the path B.

The phases of the signals appearing at the output terminals 86*a*-1, 86*b*-1, 86*c*-1, 86*a*-2, 86*b*-2, and 86*c*-2 of the circulators 85*a*, 85*b*, and 85*c* are shown by the following equation (17), and all of the phases of these signals differ from one another.

Output terminal 86*a*-1: $\omega t+\theta 1$

Output terminal 86*b*-1: $\omega t+\theta 1+2\times\theta 5+\theta 2$

Output terminal 86*c*-1: $\omega t+\theta 1+2\times\theta 5+\theta 2+2\times\theta 6+\theta 3$ Output terminal 86*a*-2: $\omega t+\theta 4+2\times\theta 7+\theta 3+2\times\theta 6+\theta 2$ Output terminal 86*b*-2: $\omega t+\theta 4+2\times\theta 7+\theta 3$ Output terminal 86*c*-2: $\omega t+\theta 4$ Each of the mixers 13*a* to 13*c* mixes two signals inputted thereto and outputs a mixed signal to a corresponding one of filters 15*a* to 15*c*, like that according to above-mentioned Embodiment 1.

When receiving the mixed signal from a corresponding one of the mixers 13*a* to 13*c*, each of the filters 15*a* to 15*c* prevents the passage of a component having a phase which is the difference between the phases of the two signals and higher-order mixed wave components, which are included in the mixed signal, and passes only a component having a phase which is the sum of the phases of the two signals, which is included in the mixed signal, like that according to above-mentioned Embodiment 1. As a result, the components passing through the filters 15*a* to 15*c* and each having a phase which is the sum of the phases of the two signals are outputted from output terminals 16*a* to 16*c*.

In consideration of the electric lengths of the transmission lines 31*a*-1 to 31*c*-1 and 31*a*-2 to 31*c*-2, the phases of the signals appearing at the output terminals 16*a* to 16*c* of circuit elements 17*a* to 17*c* are shown by the following equation (18).

Output terminal 16*a*: $(\omega t+\theta 1+\theta 5)+(\omega t+\theta 4+2\times\theta 7+\theta 3+2\times\theta 6+\theta 2+\theta 5)=2\ \omega t+\theta 1+\theta 2+\theta 3+\theta 4+2\times(\theta 5+\theta 6+\theta 7)$ Output terminal 16*b*: $(\omega t+\theta 1+2\times\theta 5+\theta 2+\theta 6)+(\omega t+\theta 4+2\times\theta 7+\theta 3+\theta 6)=2\ \omega t+\theta 1+\theta 2+\theta 3+\theta 4+2\times(\theta 5+\theta 6+\theta 7)$ Output terminal 16*c*: $(\omega t+\theta 1+2\times\theta 5+\theta 2+\theta 6+\theta 3'\theta 7)+(\omega t+\theta 4+\theta 7)=2\ \omega t+\theta 1+\theta 2+\theta 3+\theta 4+2\times(\theta 5+\theta 6+\theta 7)$ (18)

As is clear from the equation (18), all of the phases of the signals appearing at the output terminals 16*a* to 16*c* of the circuit elements 17*a* to 17*c* are equal.

Also in Embodiment 9, because the electric lengths of the transmission lines 80*b* and 80*c* each connecting between circuit elements 17 are certainly equal regardless of the directions of the paths A and B, there is provided an advantage of eliminating the necessity to take into consideration a variation in the electric lengths of the transmission lines, like in the case of above-mentioned Embodiment 8

Further, because the configuration in Embodiment 9 can use the single transmission line 80, there is provided an advantage of being able to reduce the number of transmission lines.

By connecting the output terminals 86*a*-1 to 86*c*-1 and 86*a*-2 to 86*c*-2 of the circulators 85*a* to 85*c* directly to the input terminals 14*a*-1 to 14*c*-1 and 14*a*-2 to 14*c*-2 of the mixers 13*a* to 13*c*, thereby removing the transmission lines 31*a*-1 to 31*c*-1 and 31*a*-2 to 31*c*-2, there is also provided an advantage of eliminating the necessity to take into consideration a variation in the electric lengths of the transmission lines 31*a*-1 to 31*c*-1 and 31*a*-2 to 31*c*-2.

Embodiment 10

Although in above-mentioned Embodiments 1 to 5 the example in which the in-phase corporate-feed circuit includes the two transmission lines 4 and 8 which are physically different is shown, the in-phase corporate-feed circuit can be configured to include a single transmission line along which signals propagate bidirectionally.

Figure 19:
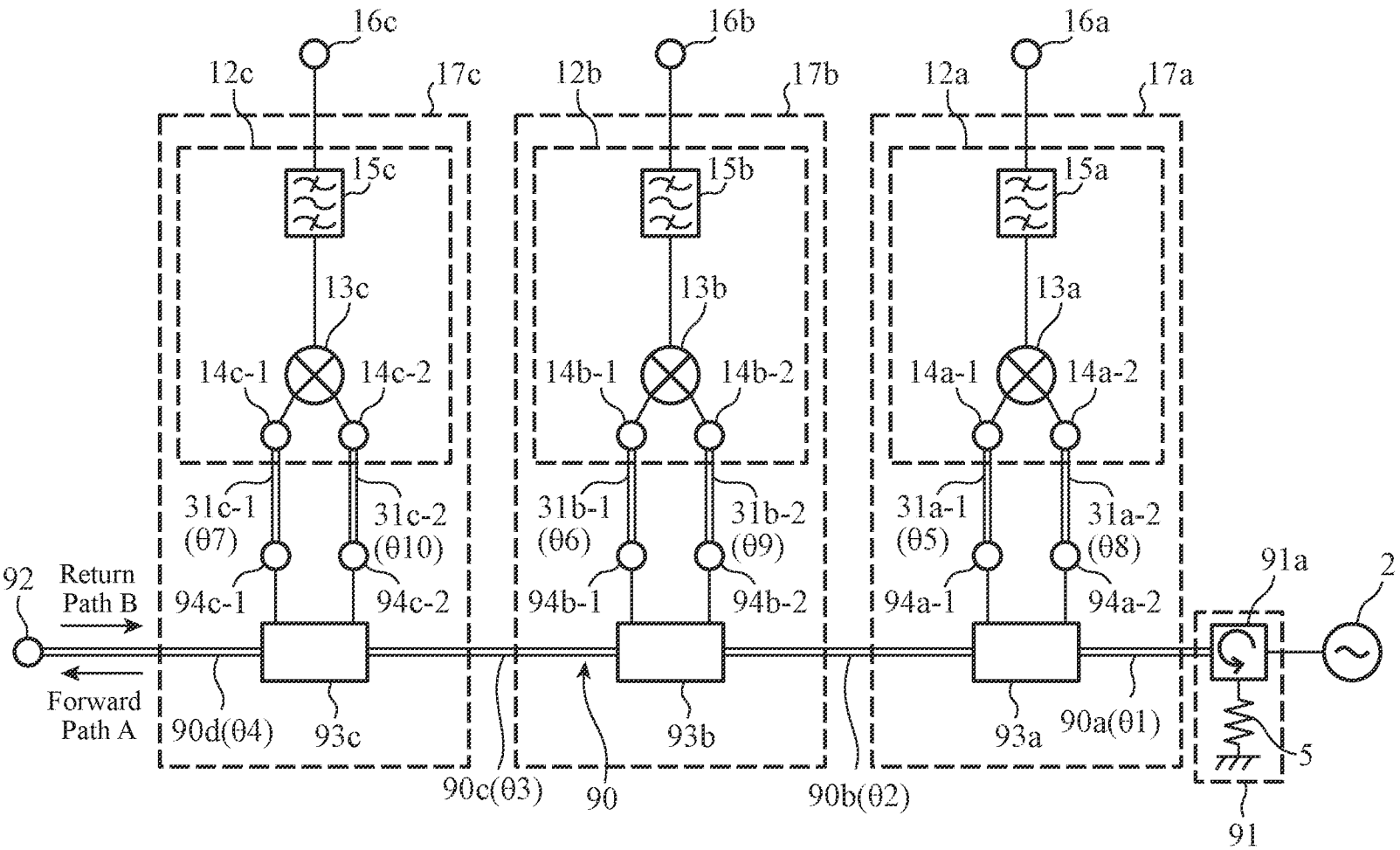
FIG. 19 is a schematic diagram showing an in-phase corporate-feed circuit according to Embodiment 10 of the present invention.

FIG. 19 is a schematic diagram showing an in-phase corporate-feed circuit according to Embodiment 10 of the present invention. In FIG. 19, because the same reference numerals as those shown in FIG. 15 denote the same components or like components, the explanation of the components will be omitted.

A transmission line 90 consists of, for example, a coaxial cable, a waveguide, a microstrip line formed on a printed circuit board, or the like. The transmission line 90 is one along which signals propagate bidirectionally, and has an end connected to a circulator 91*a* and another end connected to a terminal 92 opened. As a result, a signal transmitted via the transmission line 90 is reflected by the other end of the transmission line 90.

Directional couplers 93*a*, 93*b*, and 93*c* are inserted at points of the transmission line 90, a path through which a signal flows in a first direction, i.e., a path through which, after being outputted from a signal generator 2, a signal flows from the signal generator toward the circulator 91*a*→ the directional coupler 93*a*→ the directional coupler 93*b*→ the directional coupler 93*c*→ the terminal 92 is referred to as a forward path A, and a path through which a signal flows in a second direction, i.e., a path through which a signal flows from the terminal 92 toward the directional coupler 93*c*→ the directional coupler 93*b*→ the directional coupler 93*a*→ the circulator 91*a* is referred to as a return path B.

Hereafter, a transmission line between the circulator 91*a* and the directional coupler 93*a* is denoted by 90*a*, a transmission line between the directional coupler 93*a* and the directional coupler 93*b* is denoted by 90*b*, a transmission line between the directional coupler 93*b* and the directional coupler 93*c* is denoted by 90*c*, and a transmission line between the directional coupler 93*c* and the terminal 92 is denoted by 90*d*. Thus, the transmission line 90 includes the transmission lines 90*a*, 90*b*, 90*c*, and 90*d*. It is desirable that all of the characteristic impedances of the transmission lines 90*a*, 90*b*, 90*c*, and 90*d* are equal.

Although in FIG. 19 the example in which the terminal 92 is opened is shown, signals have only to be reflected by the terminal 92, and therefore the terminal 92 can be short-circuited or a load which reflects signals can be connected to the terminal 92.

An isolator 91 includes the circulator 91*a* and a terminator 5, and outputs the signal outputted from the signal generator 2 to an end of the transmission line 90*a* and also blocks the transmission of a signal outputted from the end of the transmission line 90*a*.

The circulator 91*a* outputs the signal outputted from the signal generator 2 to the end of the transmission line 90*a*, and also outputs the signal outputted from the end of the transmission line 90*a* to the terminator 5.

The circulator 91*a* has three terminals 65*a*, 65*b*, and 65*c*, as shown in FIG. 11, and the terminal 65*a* of the circulator 91*a* is connected to the end of the transmission line 90*a*, the terminal 65*b* of the circulator is connected to the terminator 5, and the terminal 65*c* of the circulator is connected to the signal generator 2. As a result, the signal outputted from the signal generator 2 is inputted to the transmission line 90 as a signal on the forward path A, and a signal on the return path B which is outputted from the end of the transmission line 90*a* is terminated by the terminator 5.

The directional coupler 93*a* outputs a part of the signal on the forward path A which is outputted from the circulator 91*a* to an output terminal 94*a*-1 (first terminal), and outputs a part of a signal on the return path B which is outputted from the directional coupler 93*b* to an output terminal 94*a*-2 (second terminal).

The directional coupler 93*a* has four terminals, as shown in FIG. 4A, a terminal 22*a* is connected to another end of the transmission line 90*a*, a terminal 22*b* is connected to the output terminal 94*a*-1, a terminal 22*c* is connected to an end of the transmission line 90*b*, and a terminal 22*d* is connected to the output terminal 94*a*-2.

The directional coupler 93*b* outputs a part of a signal on the forward path A which is outputted from the directional coupler 93*a* to an output terminal 94*b*-1 (first terminal), and outputs a part of a signal on the return path B which is outputted from the directional coupler 93*c* to an output terminal 94*b*-2 (second terminal).

The directional coupler 93*b* has four terminals, as shown in FIG. 4A, a terminal 22*a* is connected to another end of the transmission line 90*b*, a terminal 22*b* is connected to the output terminal 94*b*-1, a terminal 22*c* is connected to an end of the transmission line 90*c*, and a terminal 22*d* is connected to the output terminal 94*b*-2.

The directional coupler 93*c* outputs a part of a signal on the forward path A which is outputted from the directional coupler 93*b* to an output terminal 94*c*-1 (first terminal), and outputs a part of a signal on the return path B which is reflected by the terminal 92 and returns thereto to an output terminal 94*c*-2 (second terminal).

The directional coupler 93*c* has four terminals, as shown in FIG. 4A, a terminal 22*a* is connected to another end of the transmission line 90*c*, a terminal 22*b* is connected to the output terminal 94*c*-1, a terminal 22*c* is connected to an end of the transmission line 90*d*, and a terminal 22*d* is connected to the output terminal 94*c*-2.

The directional couplers 93*a*, 93*b*, and 93*c* construct branch circuits.

Although in FIG. 19 the example in which the signal generator 2 and the circulator 91*a* are connected directly to each other is shown, a transmission line can be connected between the signal generator 2 and the circulator 91*a*.

Although in FIG. 19 the example in which the transmission line 90*d* is connected between the directional coupler 93*c* and the terminal 92 is shown, the directional coupler 93*c* and the terminal 92 can be connected directly to each other, thereby omitting the transmission line 90*d*.

Next, operations will be explained.

In Embodiment 10, it is assumed that the electric lengths of the transmission lines 90*a*, 90*b*, 90*c*, and 90*d* and the electric lengths of transmission lines 31*a*-1, 31*b*-1, 31*c*-1, 31*a*-2, 31*b*-2, and 31*c*-2 are as follows.

The electric length of the transmission line 90*a* at an angular frequency $\omega=\theta 1$ The electric length of the transmission line 90*b* at the angular frequency $\omega=\theta 2$ The electric length of the transmission line 90*c* at the angular frequency $\omega=\theta 3$ The electric length of the transmission line 90*d* at the angular frequency $\omega=\theta 4$ The electric length of the transmission line 31*a*-1 at the angular frequency $\omega=\theta 5$ The electric length of the transmission line 31*b*-1 at the angular frequency $\omega=\theta 6$ The electric length of the transmission line 31*c*-1 at the angular frequency $\omega=\theta 7$ The electric length of the transmission line 31*a*-2 at the angular frequency $\omega=\theta 8$ The electric length of the transmission line 31*b*-2 at the angular frequency $\omega=\theta 9$ The electric length of the transmission line 31*c*-2 at the angular frequency $\omega=\theta 10$ It is further assumed that a relationship shown by the equation (3) is established among the electric lengths θ5, θ6, θ7, θ8, θ9, and θ10 of the transmission lines 31*a*-1, 31*a*-2, 31*b*-1, 31*b*-2, 31*c*-1, and 31*c*-2, like in the case of above-mentioned Embodiment 2.

More specifically, there is a relationship in which the sum (θ5+θ8) of the electric lengths of the transmission lines 31*a*-1 and 31*a*-2, the sum (θ6+θ9) of the electric lengths of the transmission lines 31*b*-1 and 31*b*-2, and the sum (θ7+θ10) of the electric lengths of the transmission lines 31*c*-1 and 31*c*-2 are all α and equal.

The signal generator 2 generates a signal and outputs the signal to the circulator 91*a*.

When receiving the signal from the signal generator 2, the circulator 91*a* outputs the signal to the end of the transmission line 90*a*.

Further, when after being reflected by the terminal 92, a signal on the return path B is outputted from the end of the transmission line 90*a*, the circulator 91*a* outputs the signal to the terminator 5.

As a result, the signal outputted from the signal generator 2 flows through the transmission line 90 as a signal on the forward path A, and the signal on the return path B which is outputted from the end of the transmission line 90*a* is terminated by the terminator 5.

When a signal on the forward path A which flows through the transmission line 90*a* is inputted, the directional coupler 93*a* outputs a part of the signal to the transmission line 90*b*, and also outputs the remaining part of the signal to an input terminal 14*a*-1 of a mixer 13*a* via the output terminal 94*a*-1 and the transmission line 31*a*-1.

Further, when a signal on the return path B which flows through the transmission line 90*b* is inputted, the directional coupler 93*a* outputs a part of the signal to the transmission line 90*a*, and also outputs the remaining signal to an input terminal 14*a*-2 of the mixer 13*a* via the output terminal 94*a*-2 and the transmission line 31*a*-2.

When a signal on the forward path A which flows through the transmission line 90*b* is inputted, the directional coupler 93*b* outputs a part of the signal to the transmission line 90*c*, and also outputs the remaining signal to an input terminal 14*b*-1 of a mixer 13*b* via the output terminal 94*b*-1 and the transmission line 31*b*-1.

Further, when a signal on the return path B which flows through the transmission line 90*c* is inputted, the directional coupler 93*b* outputs a part of the signal to the transmission line 90*b*, and also outputs the remaining signal to an input terminal 14*b*-2 of the mixer 13*b* via the output terminal 94*b*-2 and the transmission line 31*b*-2.

When a signal on the forward path A which flows through the transmission line 90*c* is inputted, the directional coupler 93*c* outputs a part of the signal to the transmission line 90*d*, and also outputs the remaining signal to an input terminal 14*c*-1 of a mixer 13*c* via the output terminal 94*c*-1 and the transmission line 31*c*-1.

Further, when a signal on the return path B which flows through the transmission line 90*d* is inputted, the directional coupler 93*c* outputs a part of the signal to the transmission line 90*c*, and also outputs the remaining signal to an input terminal 14*c*-2 of the mixer 13*c* via the output terminal 94*c*-2 and the transmission line 31*c*-2.

The phases of the signals appearing at the output terminals 94*a*-1, 94*b*-1, 94*c*-1, 94*a*-2, 94*b*-2, and 94*c*-2 of the directional couplers 93*a*, 93*b*, and 93*c* are shown by the following equation (19), and all of the phases of these signals differ from one another.

$$\text{Output terminal } 94a\text{-}1{:}\ \omega t+\theta 1$$

$$\text{Output terminal } 94b\text{-}1{:}\ \omega t+\theta 1+\theta 2$$

$$\text{Output terminal } 94c\text{-}1{:}\ \omega t+\theta 1+\theta 2+\theta 3$$

$$\text{Output terminal } 94a\text{-}2{:}\ \omega t+\theta 1+2\times\theta 2+2\times\theta 3+2\times\theta 4$$

$$\text{Output terminal } 94b\text{-}2{:}\ \omega t+\theta 1+\theta 2+2\times\theta 3+2\times\theta 4$$

$$\text{Output terminal } 94c\text{-}2{:}\ \omega t+\theta 1+\theta 2+\theta 3+2\times\theta 4 \tag{19}$$

Each of the mixers 13*a* to 13*c* mixes two signals inputted thereto and outputs a mixed signal to a corresponding one of filters 15*a* to 15*c*, like that according to above-mentioned Embodiment 1.

When receiving the mixed signal from a corresponding one of the mixers 13*a* to 13*c*, each of the filters 15*a* to 15*c* prevents the passage of a component having a phase which is the difference between the phases of the two signals and higher-order mixed wave components, which are included in the mixed signal, and passes only a component having a phase which is the sum of the phases of the two signals, which is included in the mixed signal, like that according to above-mentioned Embodiment 1. As a result, the components passing through the filters 15*a* to 15*c* and each having a phase which is the sum of the phases of the two signals are outputted from output terminals 16*a* to 16*c*.

In consideration of the electric lengths of the transmission lines 31*a*-1 to 31*c*-1 and 31*a*-2 to 31*c*-2, the phases of the signals appearing at the output terminals 16*a* to 16*c* of circuit elements 17*a* to 17*c* are shown by the following equation (20).

$$\text{Output terminal } 16a{:}\ (\omega t+\theta 1+\theta 5)+(\omega t+\theta 1+2\times\theta 2+2\times\theta 3+2\times\theta 4+\theta 8)=2\times(\omega t+\theta 1+\theta 2+\theta 3+\theta 4)+\theta 5+\theta 8$$

$$\text{Output terminal } 16b{:}\ (\omega t+\theta 1+\theta 2+\theta 6)+(\omega t+\theta 1+\theta 2+2\times\theta 3+2\times\theta 4+\theta 9)=2\times(\omega t+\theta 1+\theta 2+\theta 3+\theta 4)+\theta 6+\theta 9$$

$$\text{Output terminal } 16c{:}\ (\omega t+\theta 1+\theta 2+\theta 3+\theta 7)+(\omega t+\theta 1+\theta 2+\theta 3+2\times\theta 4+\theta 10)=2\times(\omega t+\theta 1+\theta 2+\theta 3+\theta 4)+\theta 7+\theta 10 \tag{20}$$

Also in Embodiment 10, because $\theta 5+\theta 8=\theta 6+\theta 9=\theta 7+\theta 10=\alpha$, like in the case of above-mentioned Embodiment 8, all of the phases of the signals appearing at the output terminals 16*a* to 16*c* of the circuit elements 17*a* to 17*c* are shown by the following equation (21), and equal.

$$2\times(\omega t+\theta 1+\theta 2+\theta 3+\theta 4)+\alpha \tag{21}$$

In above-mentioned Embodiments 1 to 5, the in-phase corporate-feed circuit needs to include the two transmission lines 4 and 8 which are physically different, and it is necessary to connect between the circuit elements 17 by using equal-length transmission lines. Therefore, when a variation occurs between the electric lengths of the transmission lines each connecting between circuit elements 17, there is a case in which the phases of the signals appearing at the output terminals 16*a* to 16*c* are not equal.

In contrast with this, in Embodiment 10, because the electric lengths of the transmission lines 90*b* and 90*c* each connecting between circuit elements 17 are certainly equal regardless of the forward path A and the return path B, there is provided an advantage of eliminating the necessity to take into consideration a variation in the electric lengths of the transmission lines.

Further, because the configuration in Embodiment 10 can use the single transmission line 90, there is provided an advantage of being able to reduce the number of transmission lines.

By connecting the output terminals 94*a*-1 to 94*c*-1 and 94*a*-2 to 94*c*-2 of the directional couplers 93*a* to 93*c* directly to the input terminals 14*a*-1 to 14*c*-1 and 14*a*-2 to 14*c*-2 of the mixers 13*a* to 13*c*, thereby removing the transmission lines 31*a*-1 to 31*c*-1 and 31*a*-2 to 31*c*-2, there is also provided an advantage of eliminating the necessity to take into consideration a variation in the electric lengths of the transmission lines 31*a*-1 to 31*c*-1 and 31*a*-2 to 31*c*-2.

Figure 20:
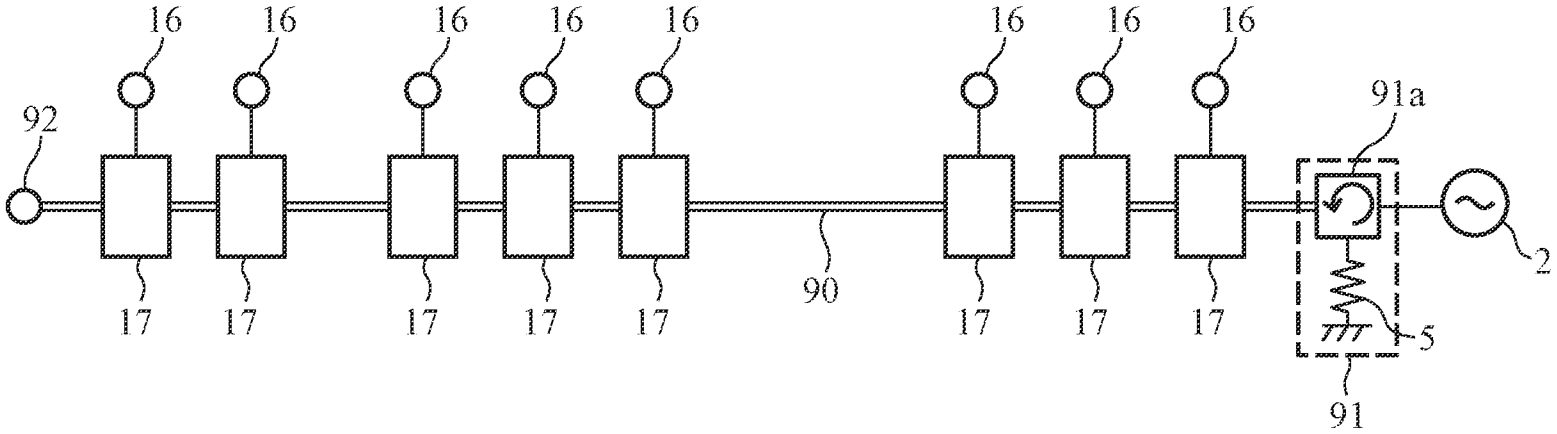
FIG. 20 is an explanatory drawing showing an example of the layout of the in-phase corporate-feed circuit according to Embodiment 10 of the present invention.

FIG. 20 is an explanatory drawing showing an example of the layout of the in-phase corporate-feed circuit according to Embodiment 10 of the present invention.

In Embodiment 10, because the layout requirement imposed on the in-phase corporate-feed circuit is eased, like in the case of above-mentioned Embodiments 1 to 9, the plural circuit elements 17 can be arranged in a straight line, as shown in FIG. 20. Therefore, it is not necessary to ensure a large space in two dimensions.

Embodiment 11

Although in above-mentioned Embodiment 10 the example in which the directional couplers 93*a*, 93*b*, and 93*c* are inserted at points of the transmission line 90 is shown, circulators can be alternatively inserted at points of the transmission line 90.

Figure 21:
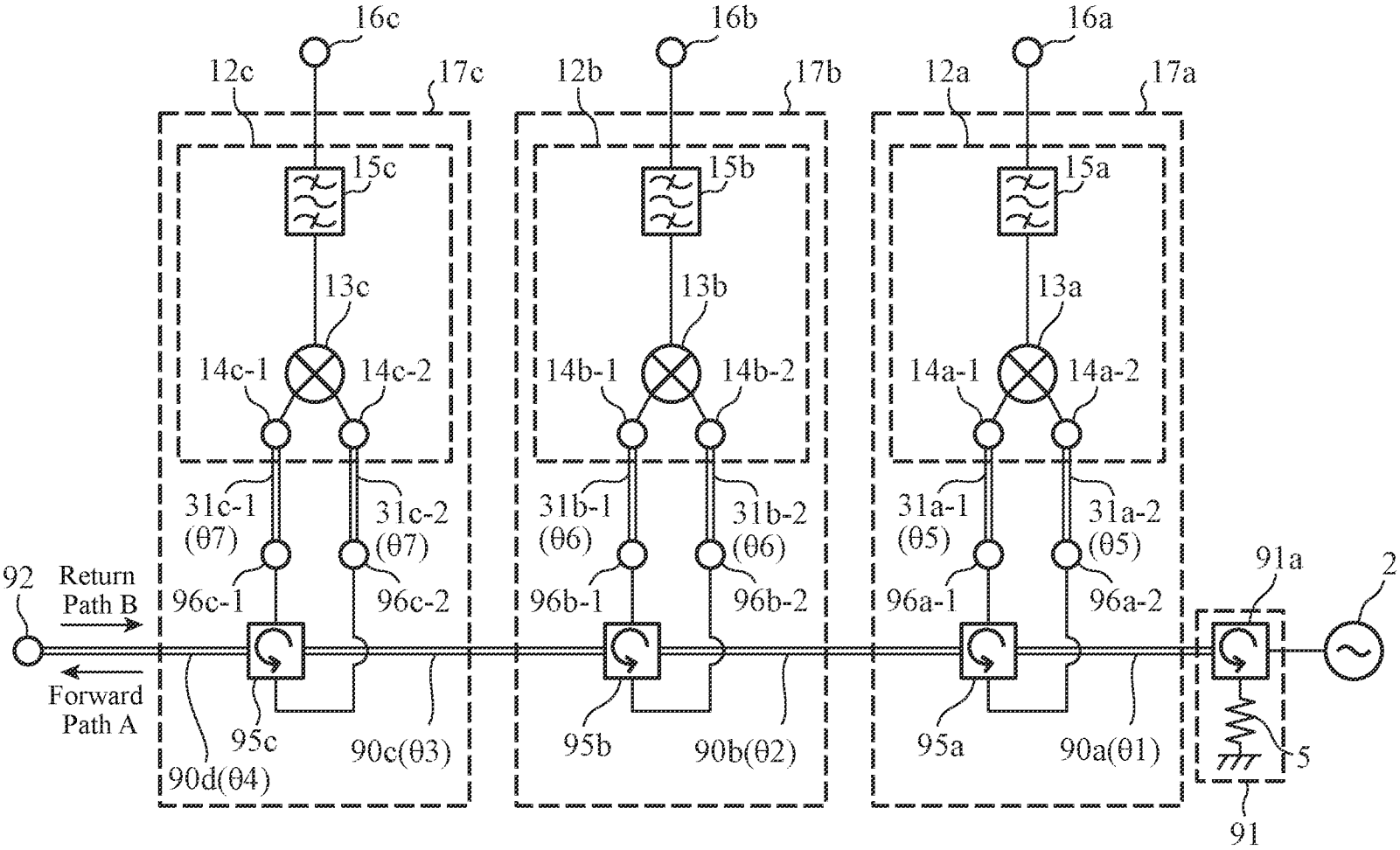
FIG. 21 is a schematic diagram showing an in-phase corporate-feed circuit according to Embodiment 11 of the present invention.

FIG. 21 is a schematic diagram showing an in-phase corporate-feed circuit according to Embodiment 11 of the present invention. In FIG. 21, because the same reference numerals as those shown in FIG. 19 denote the same components or like components, the explanation of the components will be omitted.

A circulator 95*a* outputs a signal on a forward path A which is outputted from a circulator 91*a* to an output terminal 96*a*-1 (first terminal), and, after that, outputs a signal which is reflected by an input terminal 14*a*-1 of a mixer 13*a* and returns to the output terminal 96*a*-1 to a transmission line 90*b* as a signal on the forward path A.

The circulator 95*a* also outputs a signal on a return path B which is outputted from a circulator 95*b* to an output terminal 96*a*-2 (second terminal), and, after that, outputs a signal which is reflected by an input terminal 14*a*-2 of the mixer 13*a* and returns to the output terminal 96*a*-2 to a transmission line 90*a* as a signal on the return path B.

In a case in which the circulator 95*a* has four terminals 87*a* to 87*d*, as shown in FIG. 18A, the terminal 87*a* is connected to another end of the transmission line 90*a*, the terminal 87*b* is connected to the output terminal 96*a*-1, the terminal 87*c* is connected to an end of the transmission line 90*b*, and the terminal 87*d* is connected to the output terminal 96*a*-2.

The circulator 95*b* outputs the signal on the forward path A which is outputted from the circulator 95*a* to an output terminal 96*b*-1 (first terminal), and, after that, outputs a signal which is reflected by an input terminal 14*b*-1 of a mixer 13*b* and returns to the output terminal 96*b*-1 to a transmission line 90*c* as a signal on the forward path A.

The circulator 95*b* also outputs a signal on the return path B which is outputted from a circulator 95*c* to an output terminal 96*b*-2 (second terminal), and, after that, outputs a signal which is reflected by an input terminal 14*b*-2 of the mixer 13*b* and returns to the output terminal 96*b*-2 to the transmission line 90*b* as a signal on the return path B.

In a case in which the circulator 95*b* has four terminals 87*a* to 87*d*, as shown in FIG. 18A, the terminal 87*a* is connected to another end of the transmission line 90*b*, the terminal 87*b* is connected to the output terminal 96*b*-1, the terminal 87*c* is connected to an end of the transmission line 90*c*, and the terminal 87*d* is connected to the output terminal 96*b*-2.

The circulator 95*c* outputs the signal on the forward path A which is outputted from the circulator 95*b* to an output terminal 96*c*-1 (first terminal), and, after that, outputs a signal which is reflected by an input terminal 14*c*-1 of mixer 13*c* and returns to the output terminal 96*c*-1 to a transmission line 90*d* as a signal on the forward path A.

The circulator 95*c* also outputs a signal on the return path B which is reflected by a terminal 92 and returns thereto to an output terminal 96*c*-2 (second terminal), and, after that, outputs a signal which is reflected by an input terminal 14*c*-2 of the mixer 13*c* and returns to the output terminal 96*c*-2 to the transmission line 90*c* as a signal on the return path B.

In a case in which the circulator 95*c* has four terminals 87*a* to 87*d*, as shown in FIG. 18A, the terminal 87*a* is connected to another end of the transmission line 90*c*, the terminal 87*b* is connected to the output terminal 96*c*-1, the terminal 87*c* is connected to an end of the transmission line 90*d*, and the terminal 87*d* is connected to the output terminal 96*c*-2.

The circulators 95*a*, 95*b*, and 95*c* construct branch circuits.

Next, operations will be explained.

In Embodiment 11, it is assumed that the electric lengths of the transmission lines 90*a*, 90*b*, 90*c*, and 90*d* and the electric lengths of transmission lines 31*a*-1, 31*a*-2, 31*b*-1, 31*b*-2, 31*c*-1, and 31*c*-2 are the same as those shown in above-mentioned Embodiment 9.

A signal generator 2 generates a signal and outputs the signal to the circulator 91*a*.

When receiving the signal from the signal generator 2, the circulator 91*a* outputs the signal to an end of the transmission line 90*a*.

Further, when after being reflected by terminal 92, a signal on the return path B is outputted from the end of the transmission line 90*a*, the circulator 91*a* outputs the signal to a terminator 5.

As a result, the signal outputted from the signal generator 2 flows through the transmission line 90 as a signal on the forward path A, and the signal on the return path B which is outputted from the end of the transmission line 90*a* is terminated by the terminator 5.

When receiving the signal on the forward path A which is outputted from the circulator 91*a*, the circulator 95*a* outputs the signal to the output terminal 96*a*-1.

At this time, because the input impedance of the mixer 13*a* is high, the signal outputted from the output terminal 96*a*-1 of the circulator 95*a* and inputted to the input terminal 14*a*-1 of the mixer 13*a* is reflected.

As a result, the signal reflected by the mixer 13*a* returns to the output terminal 96*a*-1 of the circulator 95*a*.

The circulator 95*a* outputs the signal which returns to the output terminal 96*a*-1 to the transmission line 90*b* as a signal on the forward path A.

Further, when receiving the signal on the return path B which is outputted from the circulator 95*b*, the circulator 95*a* outputs the signal to the output terminal 96*a*-2.

At this time, because the input impedance of the mixer 13*a* is high, the signal outputted from the output terminal 96*a*-2 of the circulator 95*a* and inputted to the input terminal 14*a*-2 of the mixer 13*a* is reflected.

As a result, the signal reflected by the mixer 13*a* returns to the output terminal 96*a*-2 of the circulator 95*a*.

The circulator 95*a* outputs the signal which returns to the output terminal 96*a*-2 to the transmission line 90*a* as a signal on the return path B. The signal on the return path B outputted to the transmission line 90*a* is outputted to the terminator 5 by the circulator 91*a*, and is terminated by the terminator 5.

When receiving the signal on the forward path A which is outputted from the circulator 95*a*, the circulator 95*b* outputs the signal to the output terminal 96*b*-1.

At this time, because the input impedance of the mixer 13*b* is high, the signal outputted from the output terminal 96*b*-1 of the circulator 95*b* and inputted to the input terminal 14*b*-1 of the mixer 13*b* is reflected.

As a result, the signal reflected by the mixer 13*b* returns to the output terminal 96*b*-1 of the circulator 95*b*.

The circulator 95*b* outputs the signal which returns to the output terminal 96*b*-1 to the transmission line 90*c* as a signal on the forward path A.

Further, when receiving the signal on the return path B which is outputted from the circulator 95*c*, the circulator 95*b* outputs the signal to the output terminal 96*b*-2.

At this time, because the input impedance of the mixer 13*b* is high, the signal outputted from the output terminal 96*b*-2 of the circulator 95*b* and inputted to the input terminal 14*b*-2 of the mixer 13*b* is reflected.

As a result, the signal reflected by the mixer 13*b* returns to the output terminal 96*b*-2 of the circulator 95*b*.

The circulator 95*b* outputs the signal which returns to the output terminal 96*b*-2 to the transmission line 90*b* as a signal on the return path B.

When receiving the signal on the forward path A which is outputted from the circulator 95*b*, the circulator 95*c* outputs the signal to the output terminal 96*c*-1.

At this time, because the input impedance of the mixer 13*c* is high, the signal outputted from the output terminal 96*c*-1 of the circulator 95*c* and inputted to the input terminal 14*c*-1 of the mixer 13*c* is reflected.

As a result, the signal reflected by the mixer 13*c* returns to the output terminal 96*c*-1 of the circulator 95*c*.

The circulator 95*c* outputs the signal which returns to the output terminal 96*c*-1 to the transmission line 90*d* as a signal on the forward path A. The signal on the forward path A which is outputted to the transmission line 90*d* is reflected by the terminal 92, and the reflected signal is inputted to the circulator 95*c* as a signal on the return path B.

Further, when receiving the signal on the return path B which is reflected by the terminal 92 and returns thereto, the circulator 95*c* outputs the signal to the output terminal 96*c*-2.

At this time, because the input impedance of the mixer 13*c* is high, the signal outputted from the output terminal 96*c*-2 of the circulator 95*c* and inputted to the input terminal 14*c*-2 of the mixer 13*c* is reflected.

As a result, the signal reflected by the mixer 13*c* returns to the output terminal 96*c*-2 of the circulator 95*c*.

The circulator 95*c* outputs the signal which returns to the output terminal 96*c*-2 to the transmission line 90*c* as a signal on the return path B.

The phase of the signals appearing at the output terminals 96*a*-1, 96*b*-1, 96*c*-1, 96*a*-2, 96*b*-2, and 96*c*-2 of the circulators 95*a*, 95*b*, and 95*c* are expressed by the following equation (22), and all of the phase of these signals differ from one another.

$$\text{Output terminal } 96a\text{-}1{:}\ \omega t+\theta 1$$

$$\text{Output terminal } 96b\text{-}1{:}\ \omega t+\theta 1+2\times\theta 5+\theta 2$$

$$\text{Output terminal } 96c\text{-}1{:}\ \omega t+\theta 1+2\times\theta 5+\theta 2+2\times\theta 6+\theta 3$$

$$\text{Output terminal } 96a\text{-}2{:}\ \omega t+\theta 1+2\times\theta 5+2\times\theta 2+4\times\theta 6+2\times\theta 3+2\times\theta 4+2\times\theta 7$$

$$\text{Output terminal } 96b\text{-}2{:}\ \omega t+\theta 1+2\times\theta 5+\theta 2+2\times\theta 6+2\times\theta 3+2\times\theta 4+2\times\theta 7$$

$$\text{Output terminal } 96c\text{-}2{:}\ \omega t+\theta 1+2\times\theta 5+\theta 2+2\times\theta 6+\theta 3+2\times\theta 4 \tag{22}$$

Each of the mixers 13*a* to 13*c* mixes two signals inputted thereto and outputs a mixed signal to a corresponding one of filters 15*a* to 15*c*, like that according to above-mentioned Embodiment 1.

When receiving the mixed signal from a corresponding one of the mixers 13*a* to 13*c*, each of the filters 15*a* to 15*c* prevents the passage of a component having a phase which is the difference between the phases of the two signals and higher-order mixed wave components, which are included in the mixed signal, and passes only a component having a phase which is the sum of the phases of the two signals, which is included in the mixed signal, like that according to above-mentioned Embodiment 1. As a result, the components passing through the filters 15*a* to 15*c* and each having a phase which is the sum of the phases of the two signals are outputted from output terminals 16*a* to 16*c*.

In consideration of the electric lengths of the transmission lines 31*a*-1 to 31*c*-1 and 31*a*-2 to 31*c*-2, the phases of the signals appearing at the output terminals 16*a* to 16*c* of circuit elements 17*a* to 17*c* are shown by the following equation (23).

$$\text{Output terminal } 16a{:}\ (\omega t+\theta 1+\theta 5)+(\omega t+\theta 1+2\times\theta 5+2\times\theta 2+4\times\theta 6+2\times\theta 3+2\times\theta 4+2\times\theta 7+\theta 5)=2\times(\omega t+\theta 1+\theta 2+\theta 3+\theta 4+\theta 5+\theta 6+\theta 7)+2\times(\theta 5+\theta 6)$$

$$\text{Output terminal } 16b{:}\ (\omega t+\theta 1+2\times\theta 5+\theta 2+\theta 6)+(\omega t+\theta 1+2\times\theta 5+\theta 2\times\theta 6+2\times\theta 3+2\times\theta 4+2\times\theta 7+\theta 6)=2\times(\omega t+\theta 1+\theta 2+\theta 3+\theta 4+\theta 5+\theta 6+\theta 7)+2\times(\theta 5+\theta 6)$$

$$\text{Output terminal } 16c{:}\ (\omega t+\theta 1+2\times\theta 5+\theta 2+2\times\theta 6+\theta 3+\theta 7)+(\omega t+\theta 1+2\times\theta 5+\theta 2+2\times\theta 6+\theta 3+2\times\theta 4+\theta 7)=2\times(\omega t+\theta 1+\theta 2+\theta 3+\theta 4+\theta 5+\theta 6+\theta 7)+2\times(\theta 5+\theta 6) \tag{23}$$

As is clear from the equation (23), all of the phases of the signals appearing at the output terminals 16*a* to 16*c* of the circuit elements 17*a* to 17*c* are equal.

Also in Embodiment 11, because the electric lengths of the transmission lines 90*b* and 90*c* each connecting between circuit elements 17 are certainly equal regardless of the forward path A and the return path B, there is provided an advantage of eliminating the necessity to take into consideration a variation in the electric lengths of the transmission lines, like in the case of above-mentioned Embodiment 10.

Further, because the configuration in Embodiment 11 can also use the single transmission line 90, there is provided an advantage of being able to reduce the number of transmission lines.

By connecting the output terminals 96*a*-1 to 96*c*-1 and 96*a*-2 to 96*c*-2 of the circulators 95*a* to 95*c* directly to the input terminals 14*a*-1 to 14*c*-1 and 14*a*-2 to 14*c*-2 of the mixers 13*a* to 13*c*, thereby removing the transmission lines 31*a*-1 to 31*c*-1 and 31*a*-2 to 31*c*-2, there is also provided an advantage of eliminating the necessity to take into consideration a variation in the electric lengths of the transmission lines 31*a*-1 to 31*c*-1 and 31*a*-2 to 31*c*-2.

Embodiment 12

In above-mentioned Embodiments 1 to 11, the in-phase corporate-feed circuit that generates plural signals having equal phases from a single signal is shown. The in-phase corporate-feed circuit according to either of above-mentioned Embodiments 1 to 11 can be mounted in an array antenna apparatus.

Figure 22:
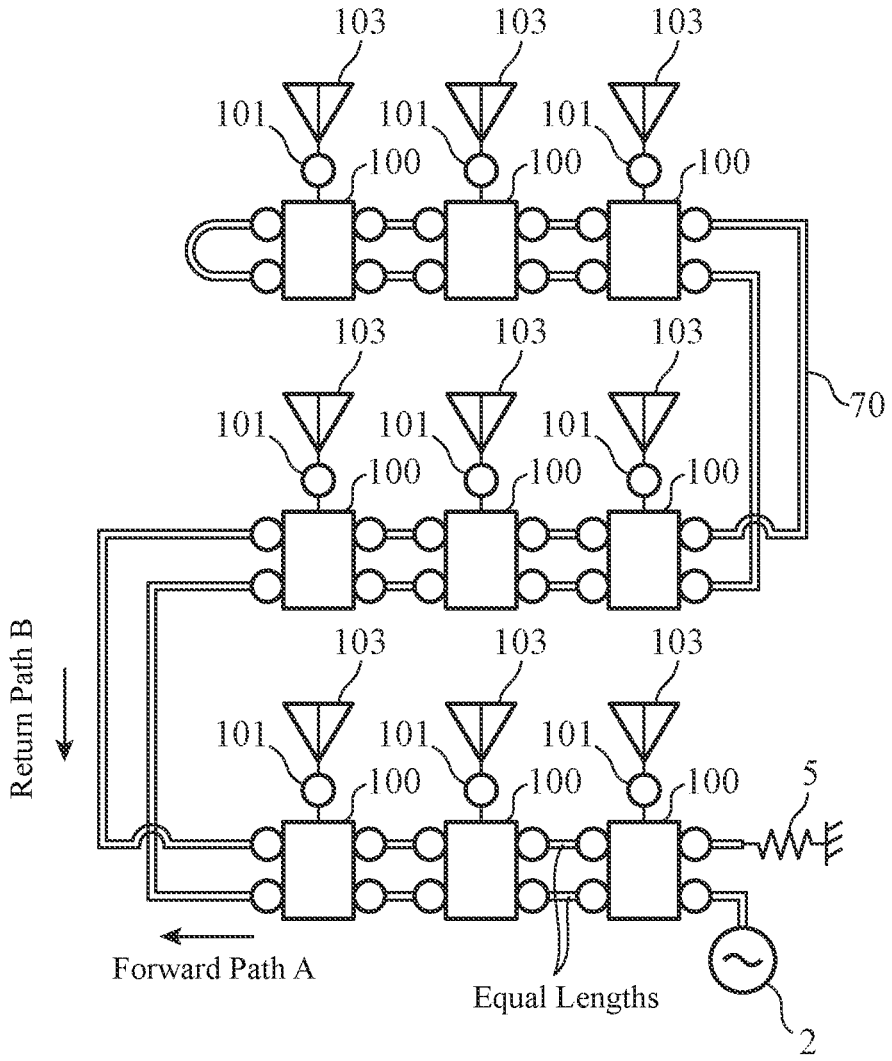
FIG. 22 is a schematic diagram showing an array antenna apparatus according to Embodiment 12 in which transmitters each equipped with a circuit element 17 shown in FIG. 12 are connected to element antennas.

FIG. 22 is a schematic diagram showing an array antenna apparatus according to Embodiment 12 in which transmitters each equipped with a circuit element 17 shown in, for example, FIG. 12 are connected to element antennas.

Figure 23:
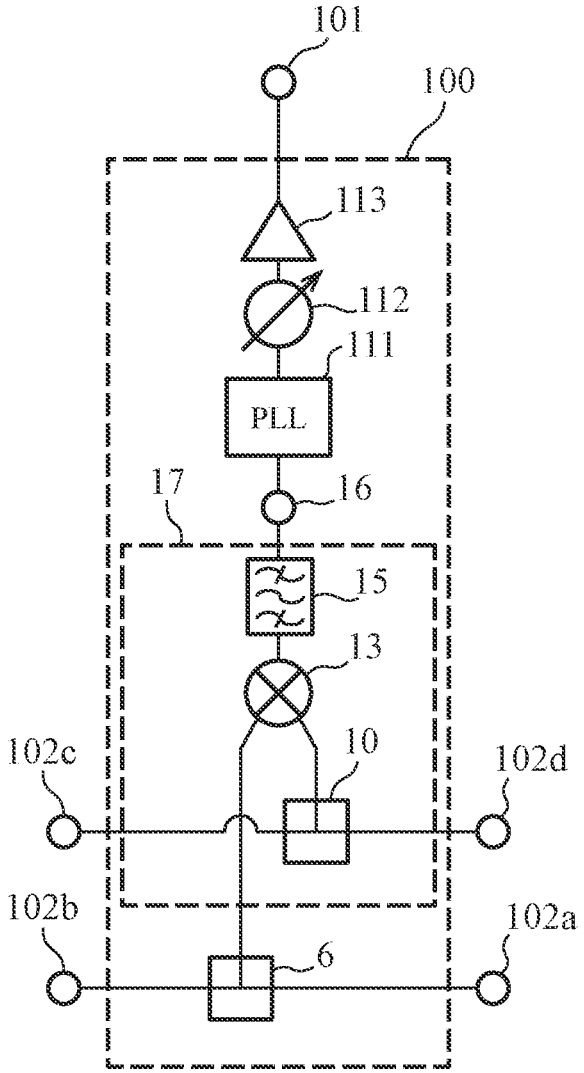
FIG. 23 is a schematic diagram showing the transmitter equipped with the circuit element 17 shown in FIG. 12.

Further, FIG. 23 is a schematic diagram showing each transmitter equipped with a circuit element 17 shown in FIG. 12.

In FIG. 22, the example in which each transmitter 100 is equipped with a circuit element 17 shown in FIG. 12 is shown, and therefore transmission lines 70 which consist of a forward path A and a return path B connect the plural transmitters.

In the configuration shown in FIGS. 22 and 23, a PLL (Phase Locked Loop) 111 which is a phase synchronization circuit receives, as a reference signal, a signal passing through a filter 15 and outputted from an output terminal 16 of a circuit element 17, and outputs a signal synchronized with the reference signal and having a frequency higher than that of the reference signal.

The frequency of the signal outputted from the PLL 111 can be varied depending on the value of a control signal separately inputted from outside.

A phase shifter 112 adjusts the phase of the signal outputted from the PLL 111. A phase shift amount by which the phase shifter 112 adjusts the phase can be varied depending on the value of a control signal separately inputted from outside.

An amplifier 113 amplifies the amplitude of the signal whose phase is adjusted by the phase shifter 112 and outputs the signal amplified thereby to an output terminal 101.

The output terminal 101 of the transmitter 100 is connected to an element antenna 103.

Further, terminals 102*a* and 102*b* of the transmitter 100 are connected to a transmission line 70 which constructs the forward path A, and terminals 102*c* and 102*d* are connected to a transmission line 70 which constructs the return path B.

The electric length of the transmission line 70 which is connected between transmitters 100 having the same configuration and which constructs the forward path A is equal to that of the transmission line 70 which constructs the return path B.

Each element antenna 103 is connected to the output terminal 101 of a transmitter 100, and emits, as an electromagnetic wave, a signal outputted from the output terminal 101 of the transmitter 100 to outside. The array antenna is comprised of the plural element antennas 103.

The plural element antennas 103 which construct the array antenna can be configured independently, like those of a horn antenna, or can be formed in a two dimensional array on a single planar substrate, like, for example, those of a patch antenna.

In the example of the array antenna apparatus shown in FIG. 22, the plural transmitters 100 each equipped with a circuit element 17 shown in FIG. 12 are connected, and therefore the plural transmitters 100 are connected by the transmission lines 70 which consist of the forward path A and the return path B. In contrast, in a case in which transmitters 100 each equipped with a circuit element 17 according to either of above-mentioned Embodiments 1 to 5 are used, the plural transmitters 100 are connected by two transmission lines 4 and 8.

Further, in a case in which transmitters 100 each equipped with a circuit element 17 according to either of above-mentioned Embodiments 8 and 9 are used, the plural transmitters 100 are connected by a single transmission line 80.

In addition, in a case in which transmitters 100 each equipped with a circuit element 17 according to either of above-mentioned Embodiments 10 and 11 are used, the plural transmitters 100 are connected by a single transmission line 90.

Next, operations will be explained.

Because a signal outputted from a signal generator 2 flows through the transmission line 70 which constructs the forward path A, the signal is inputted to one input terminal of a mixer 13 in the circuit element 17 mounted in each of the plural transmitters 100.

Further, because a signal flowing through the transmission line 70 which constructs the forward path A after passing through the plural transmitters 100 flows through the transmission line 70 which constructs the return path B, the signal is inputted to another input terminal of the mixer 13 in the circuit element 17 mounted in each of the plural transmitters 100.

The mixer 13 in the circuit element 17 mounted in each of the plural transmitters 100 operates like those according to above-mentioned Embodiments 1 to 11, and the filter 15 in the circuit element 17 mounted in each of the plural transmitters 100 operates like those according to above-mentioned Embodiments 1 to 11.

Therefore, the frequencies and the phases of the signals outputted from the output terminals 16 of the circuit elements 17 mounted in the plural transmitters 100 are equal.

The PLL 111 mounted in each of the plural transmitters 100 receives, as a reference signal, the signal outputted from the output terminal 16 of the circuit element 17, and outputs a signal having a frequency higher than that of the reference signal and synchronized with the reference signal to the phase shifter 112.

At this time, when the values of control signals separately inputted from outside are equal, the frequencies and the phases of the signals outputted from the PLLs 111 mounted in the plural transmitters 100 are equal.

When receiving the signal from the PLL 111, the phase shifter 112 mounted in each of the plural transmitters 100 adjusts the phase of the signal depending on a control signal separately inputted from outside, and outputs the signal after phase adjustment to the amplifier 113.

When receiving the signal after phase adjustment from the phase shifter 112, the amplifier 113 mounted in each of the plural transmitters 100 amplifies the amplitude of the signal and outputs the signal amplified thereby to the output terminal 101.

As a result, the signal is emitted to space as an electromagnetic wave from the element antenna 103 connected to each of the plural transmitters 100.

By setting the phase shift amount for the signal in the phase shifter 112 mounted in each of the plural transmitters 100 for each transmitter, the directions of the electromagnetic waves emitted from the array antenna can be varied.

Although in Embodiment the example of varying the directions of the electromagnetic waves emitted from the array antenna by controlling the phase shift amount for the signal in the phase shifter 112 mounted in each of the plural transmitters 100 is shown, the directions of the electromagnetic waves emitted from the array antenna can be varied by controlling the phase differences among the plural PLLs 111 by using the control signals provided for the PLLs 111 mounted in the plural transmitters 100, as shown in the following Patent Literature 2. In this case, the phase shifter 112 becomes unnecessary.

[Patent Literature 2] Japanese Patent Application Publication No. 2014-49808.

When all of the phases of the reference signals which are the input signals of the PLLs 111 mounted in the plural transmitters 100 are equal, the directions of the electromagnetic waves emitted from the array antenna can be predicted correctly from the phase shift amounts set to the phase shifters 112.

When the phases of the reference signals inputted to the PLLs 111 are not equal and not known, it is difficult to correctly predict the directions of the electromagnetic waves emitted from the array antenna from the phase shift amounts set to the phase shifters 112.

Because the array antenna apparatus according to Embodiment 12 is equipped with in-phase corporate-feed circuits whose circuit sizes are reduced to be smaller than those of in-phase corporate-feed circuits of tournament type, as explained in above-mentioned Embodiments 1 to 11, the circuit size of the array antenna apparatus is also downsized inevitably.

Within the scope of the invention, an arbitrary combination of two or more of the above-mentioned embodiments can be made, various changes can be made in an arbitrary component according to any one of the above-mentioned embodiments, and an arbitrary component according to any one of the above-mentioned embodiments can be omitted.

INDUSTRIAL APPLICABILITY

The in-phase corporate-feed circuit according to the present invention is suitable for use as in-phase corporate-feed circuit s mounted in an array antenna apparatus for which a large space is hardly ensured.

REFERENCE SIGNS LIST

1: signal generating circuit; 2: signal generator; 3: power divider; 4, 4*a*, 4*b*, 4*c*: transmission lines; 5: terminator; 6*a*, 6*b*, 6*c*: T-branch units (first branch circuits); 7*a*, 7*b*, 7*c*: output terminals; 8, 8*a*, 8*b*, 8*c*: transmission lines; 9: terminator; 10*a*, 10*b*, 10*c*: T-branch units (second branch circuits); 11*a*, 11*b*, 11*c*: output terminals; 12*a*, 12*b*, 12*c*: phase adding circuits; 13*a*, 13*b*, 13*c*: mixers; 14*a*-1, 14*a*-2, 14*b*-1, 14*b*-2, 14*c*-1, 14*c*-2: input terminals; 15*a*, 15*b*, 15*c*: filters; 16*a*, 16*b*, 16*c*: output terminals; 17*a*, 17*b*, 17*c*: circuit elements; 18*a*-1, 18*b*-1, 18*c*-1, 18*a*-2, 18*b*-2, 18*c*-2: amplifiers; 21, 22: directional couplers; 22*a*, 22*b*, 22*c*, 22*d*: terminals; 31*a*-1, 31*a*-2, 31*b*-1, 31*b*-2, 31*c*-1, 31*c*-2: transmission lines; 32*a*, 32*b*, 32*c*: transmission lines; 41: ½ frequency divider; 42: noninverting output terminal; 43: inverting output terminal; 51*a*-1, 51*a*-2, 51*b*-1, 51*b*-2, 51*c*-1, 51*c*-2: attenuators; 52*a*, 52*b*, 52*c*, 53*a*, 53*b*, 53*c*: amplifiers; 61*a*, 61*b*, 61*c*: circulators (first branch circuits); 62*a*, 62*b*, 62*c*: output terminals; 63*a*, 63*b*, 63*c*: circulators (second branch circuits); 64*a*, 64*b*, 64*c*: output terminals; 65*a*, 65*b*, 65*c*: terminals; 70, 70*a*, 70*b*, 70*c*, 70*d*, 70*e*, 70*f*: transmission lines; 80, 80*a*, 80*b*, 80*c*, 80*d*: transmission lines; 81: isolator (first isolator); 81*a*: circulator; 82: isolator (second isolator); 82*a*: circulator; 83*a*, 83*b*, 83*c*: directional couplers (branch circuits); 84*a*-1, 84*b*-1, 84*c*-1: output terminals (first terminals); 84*a*-2, 84*b*-2, 84*c*-2: output terminals (second terminals); 85*a*, 85*b*, 85*c*: circulators (branch circuits); 86*a*-1, 86*b*-1, 86*c*-1: output terminals (first terminals); 86*a*-2, 86*b*-2, 86*c*-2: output terminals (second terminals); 87*a*, 87*b*, 87*c*, 87*d*, 89*a*, 89*b*: terminals; 88*a*, 88*b*: circulators; 90, 90*a*, 90*b*, 90*c*, 90*d*: transmission lines; 91: isolator; 91*a*: circulator; 92: terminal; 93*a*, 93*b*, 93*c*: directional couplers (branch circuits); 94*a*-1, 94*b*-1, 94*c*-1: output terminals (first terminals); 94*a*-2, 94*b*-2, 94*c*-2: output terminals (second terminals); 95*a*, 95*b*, 95*c*: circulators (branch circuits); 96*a*-1, 96*b*-1, 96*c*-1: output terminals (first terminals); 96*a*-2, 96*b*-2, 96*c*-2: output terminals (second terminals); 100: transmitter; 101: output terminal; 102*a*, 102*b*, 102*c*, 102*d*: terminals; 103: element antenna; 111: PLL; 112: phase shifter; and 113: amplifier.

The invention claimed is:

1. An in-phase corporate-feed circuit comprising:

a signal generating circuit configured to divide a signal generated thereby;

a first transmission line having an end connected to the signal generating circuit, and another end terminated;

a second transmission line having an end connected to the signal generating circuit, and another end terminated;

N first branch circuits where N is an integer equal to or greater than 2, each first branch circuit being configured to take, from the first transmission line, a part of one of signals obtained by the division in the signal generating circuit;

N second branch circuits, each second branch circuit being configured to take, from the second transmission line, a part of another one of the signals obtained by the division in the signal generating circuit; and N phase adding circuits, each phase adding circuit being configured to add a phase of a signal taken by one of the N first branch circuits which is n-th when counted from the end of the first transmission line where n is a positive integer equal to or less than N, and a phase of a signal taken by one of the N second branch circuits which is n-th when counted from the other end of the second transmission line, wherein an electric length of the first transmission line between one of the first branch circuits which is m-th when counted from the end of the first transmission line where m is a positive integer equal to or less than N−1, and another one of the first branch circuits which is (m+1)-th when counted from the end of the first transmission line, is equal to an electric length of the second transmission line between one of the second branch circuits which is m-th when counted from the other end of the second transmission line, and another one of the second branch circuits which is (m+1)-th when counted from the other end of the second transmission line.

2. The in-phase corporate-feed circuit according to claim 1, wherein each of the first and second branch circuits includes a T-branch unit, a directional, coupler, or a circulator configured to branch the first or the second transmission line.

3. The in-phase corporate-feed circuit according to claim 1, wherein each of the phase adding circuits includes: a mixer configured to mix the signal taken by the one of the N first branch circuits which is n-th when counted from the end of the first transmission line, and the signal taken by the one of the N second branch circuits which is n-th when counted from the other end of the second transmission line, to output a mixed signal; and a filter configured to pass a component having a phase which is a sum of phases of the two signals included in the mixed signal outputted from the mixer.

4. An array antenna apparatus comprising:

the in-phase corporate-feed circuit according to claim 1, configured to generate plural signals having equal phases from a single signal; and an array antenna configured to transmit the plural signals generated by the in-phase corporate-feed circuit.

5. An in-phase corporate-feed circuit comprising:

a signal generator configured to generate a signal;

a transmission line comprised of a forward path and a return path, a start point of the forward path being connected to the signal generator and an end point of the return path being terminated;

N first branch circuits where N is an integer equal to or greater than 2, each first branch circuit being configured to take, from the forward path of the transmission line, a part of the signal generated by the signal generator;

N second branch circuits, each second branch circuit being configured to take, from the return path of the transmission line, a part of the signal generated by the signal generator; and N phase adding circuits each configured to add a phase of a signal taken by one of the N first branch circuits which is n-th when counted from the start point of the forward path where n is a positive integer equal to or less than N, and a phase of a signal taken by one of the N second branch circuits which is n-th when counted from the end point of the return path, wherein an electric length of a first transmission line between one of the first branch circuits which is m-th when counted from the start point of the forward path where m is a positive integer equal to or less than N−1, and another one of the first branch circuits which is (m+1)-th when counted from the start point of the forward path, is equal to an electric length of a second transmission line between one of the second branch circuits which is m-th when counted from the end point of the return path, and another one of the second branch circuits which is (m+1)-th when counted from the end point of the return path.

6. The in-phase corporate-feed circuit according to claim 5, wherein each of the first and second branch circuits includes a T-branch unit, a directional coupler, or a circulator configured to branch the first or the second transmission line.

7. The in-phase corporate-feed circuit according to claim 5, wherein each of the phase adding circuits includes: a mixer configured to mix the signal taken by the one of the N first branch circuits which is n-th when counted from the start point of the forward path, and the signal taken by the one of the N second branch circuits which is n-th when counted from the end point of the return path, to output a mixed signal; and a filter configured to pass a component having a phase which is a sum of phases of the two signals included in the mixed signal outputted from the mixer.

8. An array antenna apparatus comprising:

the in-phase corporate-feed circuit according to claim 5, configured to generate plural signals having equal phases from a single signal; and an array antenna configured to transmit the plural signals generated by the in-phase corporate-feed circuit.

9. An in-phase corporate-feed circuit comprising:

a transmission line along which signals propagate bidirectionally;

a signal generator configured to generate a signal to be outputted to the transmission line;

N branch circuits where N is an integer equal to or greater than 2, each branch circuit being configured to output a signal flowing through the transmission line in a first direction to a first terminal, and to output a signal flowing through the transmission line in a second direction to a second terminal, and N phase adding circuits, each phase adding circuit having two input terminals connected to the first and second terminals, and configured to add a phase of the signal which is outputted by a corresponding one of the branch circuits from the first terminal, and a phase of the signal which is outputted by the corresponding, one of the branch circuits from the second terminal.

10. The in-phase corporate-feed circuit according to claim 9, further comprising:

a power divider configured to divide the signal generated by the signal generator;

a first isolator configured to output one of signals obtained by the division in the power divider to an end of the transmission line, and to block transmission of a signal outputted from the end of the transmission line; and a second isolator configured to output another one of the signals obtained by the division in the power divider to another end of the transmission line, and to block transmission of a signal outputted from the other end of the transmission line, wherein each of the N branch circuits outputs a signal flowing through the transmission line from the first isolator toward the second isolator to the first terminal, and outputs a signal flowing through the transmission line from the second isolator toward the first isolator to the second terminal.

11. The in-phase corporate-feed circuit according to claim 10, wherein each of the branch circuits includes a directional coupler configured to output a part of a signal flowing through the transmission line from the first isolator toward the second isolator to the first terminal, and to output a part of a signal flowing through the transmission line from the second isolator toward the first isolator to the second terminal.

12. The in-phase corporate-feed circuit according to claim 10, wherein each of the branch circuits includes a circulator configured to output a signal flowing through the transmission line from the first isolator toward the second isolator to the first terminal, and, thereafter, output, as a signal flowing from the first isolator toward the second isolator, a signal inputted from the first terminal to the transmission line, and configured to output a signal flowing through the transmission line from the second isolator toward the first isolator to the second terminal, and thereafter, output, as a signal flowing from the second isolator toward the first isolator, a signal inputted from the second terminal to the transmission line.

13. The in-phase corporate-feed circuit according to claim 9, further comprising an isolator configured to output the signal generated by the signal generator to an end of the transmission line, and to block transmission of a signal outputted from the end of the transmission line, wherein each of the N branch circuits outputs a signal flowing through the transmission line from the isolator toward another end of the transmission line to the first terminal, and outputs a signal flowing, from the other end toward the isolator to the second terminal by reflection at the other end of the transmission line.

14. The in-phase corporate-feed circuit according to claim 13, wherein each of the branch circuits includes a directional coupler configured to output a part of a signal flowing through the transmission line from the isolator toward the other end of the transmission line to the first terminal, and to output a part of a signal flowing from the other end toward the isolator to the second terminal by reflection at the other end of the transmission line.

15. The in-phase corporate-feed circuit according to claim 13, wherein each of the branch circuits includes a circulator configured to:

output a signal flowing through the transmission line from the isolator toward the other end of the transmission line to the first terminal, thereafter output, as a signal flowing from the isolator toward the other end, a signal inputted from the first terminal to the transmission line, output a signal flowing from the other end toward the isolator to the second terminal by reflection the signal generated by the signal generator at the other end of the transmission line, and, thereafter output, as a signal flowing from the other end toward the isolator, a signal inputted from the second terminal to the transmission line.

16. The in-phase corporate-feed circuit according to claim 13, wherein the other end of the transmission line is opened, or a load configured to reflect the signal generated by the signal generator is connected to the other end of the transmission line.

17. The in-phase corporate-feed circuit according to claim 9, wherein each of the phase adding circuits includes:

a mixer having two input terminals connected to the first and second terminals, configured to mix a signal which is outputted by a corresponding one of the branch circuits from the first terminal and a signal which is outputted by the corresponding one of the branch circuits from the second terminal, to output a mixed signal; and a filter configured to pass a component having a phase which is a sum of phases of the two signals included in the mixed signal outputted from the mixer.

18. An array antenna apparatus comprising:

the in-phase corporate-feed circuit according to claim 9, configured to generate plural signals having equal phases from a single signal; and an array antenna configured to transmit the plural signals generated by the in-phase corporate-feed circuit.

* * * * *